US007736283B2

(12) United States Patent
Webb

(10) Patent No.: US 7,736,283 B2
(45) **Date of Patent: *Jun. 15, 2010**

(54) EXERCISE MACHINE HAVING ROTATABLE WEIGHT SELECTION INDEX

(75) Inventor: Gregory M. Webb, Independence, VA (US)

(73) Assignee: Nautilus, Inc., Vancouver, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/867,643

(22) Filed: Oct. 4, 2007

(65) Prior Publication Data

US 2008/0085821 A1 Apr. 10, 2008

Related U.S. Application Data

(60) Provisional application No. 60/849,300, filed on Oct. 4, 2006.

(51) Int. Cl.
*A63B 21/06* (2006.01)

(52) U.S. Cl. ..... 482/97; 482/94; 482/137

(58) Field of Classification Search ..... 482/92–94, 482/97, 106–107, 137, 908; *A63B 21/00*
See application file for complete search history.

(56) References Cited

U.S. PATENT DOCUMENTS

| | | | |
|---|---|---|---|
| 2,855,199 | A | 10/1958 | Noland et al. |
| 2,921,791 | A | 1/1960 | Berne |
| 3,306,611 | A | 2/1967 | Gaul |
| 3,588,101 | A | 6/1971 | Jungreis |
| 3,638,941 | A | 2/1972 | Kulkens |
| 3,662,602 | A | 5/1972 | Weiss |
| 3,822,599 | A | 7/1974 | Brentham |
| 3,856,297 | A | 12/1974 | Schnell |
| 4,076,236 | A | 2/1978 | Ionel |
| 4,290,597 | A | 9/1981 | Schleffendorf |

(Continued)

FOREIGN PATENT DOCUMENTS

| | | | |
|---|---|---|---|
| CN | 2 430 184 | Y | 5/2001 |

(Continued)

OTHER PUBLICATIONS

Cybex International, Inc., Commercial Strength Systems brochure, 4535 Arm Curl, 5255 Rear Delt, 5281 Arm Curl, pp. 9 and 36 (Apr. 2000).

(Continued)

*Primary Examiner*—Fenn C Mathew
*Assistant Examiner*—Andrew M Tecco
(74) *Attorney, Agent, or Firm*—Dorsey & Whitney LLP

(57) ABSTRACT

A weight exercise machine may include an exercise member, one or more weights, and one or more weight selectors. When using the machine to exercise, the user exerts an exercise force against the exercise member. A weight selector may be rotated, pivoted, or otherwise moved to operably couple the exercise member to at least one of the weights such that displacement of the exercise member causes at least one of the weights to displace, thus providing resistance to displacement of the exercise member. The weights may include main weights and add-on weights for operative coupling to the exercise member via a movable frame. The one or more weight selectors allow for selection of different combinations of weights for providing resistance to displacement of the exercise member.

11 Claims, 70 Drawing Sheets

U.S. PATENT DOCUMENTS

| | | | | |
|---|---|---|---|---|
| 4,336,934 | A | 6/1982 | Hanagan et al. | |
| 4,357,010 | A | 11/1982 | Telle | |
| 4,405,128 | A | 9/1983 | McLaughlin et al. | |
| 4,426,077 | A | 1/1984 | Becker | |
| 4,453,710 | A | 6/1984 | Plötz | |
| 4,478,411 | A | 10/1984 | Baldwin | |
| 4,502,681 | A | 3/1985 | Blomqvist | |
| 4,529,197 | A | 7/1985 | Gogarty | |
| 4,529,198 | A | 7/1985 | Hettick, Jr. | |
| 4,538,805 | A | 9/1985 | Parviainen | |
| 4,546,971 | A | 10/1985 | Raasoch | |
| 4,598,908 | A | 7/1986 | Morgan | |
| 4,627,614 | A | 12/1986 | de Angeli | |
| 4,627,615 | A | 12/1986 | Nurkowski | |
| 4,700,944 | A | 10/1987 | Sterba et al. | |
| 4,722,522 | A | 2/1988 | Lundgren | |
| 4,756,526 | A * | 7/1988 | Broussard | 482/108 |
| 4,787,629 | A | 11/1988 | DeMyer | |
| 4,804,179 | A | 2/1989 | Murphy et al. | |
| 4,822,034 | A | 4/1989 | Shields | |
| 4,834,396 | A | 5/1989 | Schnell | |
| 4,854,578 | A | 8/1989 | Fulks | |
| 4,858,915 | A | 8/1989 | Szabo | |
| 4,861,025 | A | 8/1989 | Rockwell | |
| 4,880,229 | A | 11/1989 | Broussard | |
| 4,902,007 | A | 2/1990 | Ferrari | |
| 4,944,511 | A | 7/1990 | Francis | |
| 4,951,939 | A | 8/1990 | Peters | |
| 4,971,305 | A | 11/1990 | Rennex | |
| 4,982,957 | A * | 1/1991 | Shields | 482/104 |
| 5,002,271 | A | 3/1991 | Gonzales | |
| 5,050,873 | A | 9/1991 | Jones | |
| D321,025 | S | 10/1991 | Jones | |
| D321,026 | S | 10/1991 | Jones | |
| D321,027 | S | 10/1991 | Jones | |
| D321,028 | S | 10/1991 | Jones | |
| 5,060,938 | A | 10/1991 | Hawley, Jr. | |
| D321,387 | S | 11/1991 | Jones | |
| D321,389 | S | 11/1991 | Jones | |
| D321,390 | S | 11/1991 | Jones | |
| D321,391 | S | 11/1991 | Jones | |
| 5,066,003 | A | 11/1991 | Jones | |
| 5,066,004 | A | 11/1991 | Jones | |
| 5,094,450 | A | 3/1992 | Stearns | |
| 5,106,080 | A | 4/1992 | Jones | |
| 5,116,297 | A | 5/1992 | Stonecipher | |
| 5,123,885 | A | 6/1992 | Shields | |
| 5,125,881 | A | 6/1992 | Jones | |
| 5,135,449 | A | 8/1992 | Jones | |
| 5,135,456 | A | 8/1992 | Jones | |
| 5,171,198 | A | 12/1992 | Jones | |
| 5,180,354 | A | 1/1993 | Jones | |
| 5,181,896 | A | 1/1993 | Jones | |
| 5,230,680 | A | 7/1993 | Wu | |
| 5,263,915 | A | 11/1993 | Habing | |
| 5,273,504 | A | 12/1993 | Jones | |
| 5,273,505 | A | 12/1993 | Jones | |
| 5,306,221 | A * | 4/1994 | Itaru | 482/98 |
| 5,336,148 | A | 8/1994 | Ish, III | |
| D359,778 | S | 6/1995 | Towley, III et al. | |
| 5,429,570 | A | 7/1995 | Beyer | |
| 5,484,367 | A | 1/1996 | Martinez | |
| 5,554,084 | A | 9/1996 | Jones | |
| 5,554,089 | A | 9/1996 | Jones | |
| 5,554,090 | A | 9/1996 | Jones | |
| 5,562,577 | A | 10/1996 | Nichols, Sr. et al. | |
| 5,628,715 | A | 5/1997 | Simonson | |
| 5,637,064 | A | 6/1997 | Olson et al. | |
| 5,749,813 | A | 5/1998 | Domzalski | |
| 5,769,757 | A | 6/1998 | Fulks | |
| 5,769,762 | A | 6/1998 | Towley, III et al. | |
| 5,779,604 | A | 7/1998 | Towley, III et al. | |
| 5,788,615 | A | 8/1998 | Jones | |
| 5,788,616 | A | 8/1998 | Polidi | |
| 5,810,701 | A | 9/1998 | Ellis et al. | |
| 5,839,997 | A * | 11/1998 | Roth et al. | 482/107 |
| 5,876,313 | A | 3/1999 | Krull | |
| 6,015,367 | A | 1/2000 | Sacramucci | |
| 6,033,350 | A | 3/2000 | Krull | |
| D422,654 | S | 4/2000 | Chen | |
| 6,045,491 | A | 4/2000 | McNergney et al. | |
| 6,095,955 | A | 8/2000 | Lee | |
| 6,099,442 | A | 8/2000 | Krull | |
| 6,117,049 | A | 9/2000 | Lowe | |
| 6,149,558 | A | 11/2000 | Chen | |
| 6,174,265 | B1 | 1/2001 | Alessandri | |
| 6,186,928 | B1 | 2/2001 | Chen | |
| 6,196,952 | B1 | 3/2001 | Chen | |
| 6,203,474 | B1 | 3/2001 | Jones | |
| 6,228,003 | B1 | 5/2001 | Hald et al. | |
| 6,261,022 | B1 | 7/2001 | Dalebout et al. | |
| 6,364,815 | B1 | 4/2002 | Lapcevic | |
| 6,402,666 | B2 | 6/2002 | Krull | |
| 6,416,446 | B1 | 7/2002 | Krull | |
| 6,422,979 | B1 | 7/2002 | Krull | |
| 6,436,013 | B1 | 8/2002 | Krull | |
| 6,440,044 | B1 | 8/2002 | Francis et al. | |
| 6,482,139 | B1 | 11/2002 | Haag | |
| 6,500,101 | B1 | 12/2002 | Chen | |
| 6,500,106 | B1 | 12/2002 | Fulks | |
| 6,517,468 | B1 | 2/2003 | Lapcevic | |
| 6,540,650 | B1 | 4/2003 | Krull | |
| 6,561,960 | B2 | 5/2003 | Webber | |
| 6,595,902 | B1 | 7/2003 | Savage et al. | |
| 6,605,024 | B2 | 8/2003 | Stearns | |
| 6,629,910 | B1 * | 10/2003 | Krull | 482/98 |
| 6,656,093 | B2 | 12/2003 | Chen | |
| 6,669,606 | B2 | 12/2003 | Krull | |
| 6,682,464 | B2 | 1/2004 | Shifferaw | |
| 6,719,672 | B1 | 4/2004 | Ellis et al. | |
| 6,719,674 | B2 | 4/2004 | Krull | |
| 6,733,424 | B2 | 5/2004 | Krull | |
| 6,746,381 | B2 | 6/2004 | Krull | |
| 6,749,547 | B2 | 6/2004 | Krull | |
| 6,802,800 | B1 * | 10/2004 | Hobson | 482/97 |
| D498,272 | S | 11/2004 | Sanford-Schwentke et al. | |
| D500,820 | S | 1/2005 | Krull | |
| 6,855,097 | B2 | 2/2005 | Krull | |
| 7,018,325 | B2 | 3/2006 | Shifferaw | |
| D521,087 | S | 5/2006 | Francis | |
| 7,066,867 | B2 | 6/2006 | Krull | |
| 7,077,791 | B2 | 7/2006 | Krull | |
| 7,090,625 | B2 | 8/2006 | Chermack | |
| 7,121,988 | B2 | 10/2006 | Walkerdine | |
| 7,137,931 | B2 | 11/2006 | Liu | |
| 7,137,932 | B2 | 11/2006 | Doudiet | |
| D533,910 | S | 12/2006 | Dibble et al. | |
| 7,189,190 | B2 | 3/2007 | Lamar et al. | |
| D540,405 | S | 4/2007 | Crawford et al. | |
| D540,894 | S | 4/2007 | Crawford et al. | |
| 7,252,627 | B2 | 8/2007 | Carter | |
| 7,261,678 | B2 | 8/2007 | Crawford et al. | |
| D550,789 | S | 9/2007 | Dibble et al. | |
| 7,285,078 | B1 | 10/2007 | Liu | |
| 7,291,098 | B1 | 11/2007 | Krull | |
| 7,306,549 | B2 | 12/2007 | Francis | |
| 7,377,885 | B2 | 5/2008 | Doudiet | |
| 7,387,595 | B2 * | 6/2008 | Towley et al. | 482/100 |
| 7,413,532 | B1 | 8/2008 | Monsrud et al. | |
| 7,413,533 | B2 | 8/2008 | Lin | |
| 7,429,235 | B2 | 9/2008 | Lin | |
| 7,485,077 | B2 | 2/2009 | Chen | |
| 7,591,770 | B2 | 9/2009 | Stewart et al. | |
| 2002/0025888 | A1 | 2/2002 | Germanton et al. | |

| | | | | |
|---|---|---|---|---|
| 2002/0077230 | A1 | 6/2002 | Lull et al. | |
| 2003/0092542 | A1 | 5/2003 | Bartholomew et al. | |
| 2003/0148862 | A1 | 8/2003 | Chen et al. | |
| 2003/0199368 | A1* | 10/2003 | Krull | 482/106 |
| 2004/0005969 | A1 | 1/2004 | Chen | |
| 2004/0023765 | A1 | 2/2004 | Krull | |
| 2005/0079961 | A1 | 4/2005 | Dalebout et al. | |
| 2005/0085351 | A1 | 4/2005 | Kissel | |
| 2006/0025287 | A1 | 2/2006 | Chermack | |
| 2006/0063650 | A1 | 3/2006 | Francis | |
| 2006/0100069 | A1 | 5/2006 | Dibble et al. | |
| 2006/0105889 | A1 | 5/2006 | Webb | |
| 2006/0116249 | A1 | 6/2006 | Dibble et al. | |
| 2006/0135328 | A1 | 6/2006 | Doudiet | |
| 2006/0205571 | A1* | 9/2006 | Krull | 482/94 |
| 2006/0217245 | A1 | 9/2006 | Golesh et al. | |
| 2007/0275836 | A1 | 11/2007 | Parviainen | |
| 2008/0254952 | A1 | 10/2008 | Webb | |

FOREIGN PATENT DOCUMENTS

| | | | |
|---|---|---|---|
| EP | 121902 | A1 | 10/1984 |
| EP | 0 617 986 | A1 | 10/1994 |
| FR | 1468902 | | 4/1967 |
| FR | 2613237 | | 10/1988 |
| GB | 2 232 089 | A | 12/1990 |
| JP | 10118222 | | 5/1998 |
| SE | 455 573 | | 7/1988 |
| SU | 1258447 | A1 | 9/1986 |
| SU | 1367987 | A1 | 1/1988 |
| SU | 1389789 | A2 | 4/1988 |
| SU | 1643024 | A1 | 4/1991 |
| SU | 1780780 | A1 | 12/1992 |
| TW | 379572 | Y | 1/2000 |

OTHER PUBLICATIONS

Nautilus Super Smooth Technology, "Equipment Comparison", undated brochure, one page (undated).

Non-Final Office Action and Notice of References Cited, U.S. Appl. No. 11/242,320, Oct. 24, 2008, 9 pages.

Amendment and Response to Office Action, U.S. Appl. No. 11/242,320, Feb. 24, 2009, 9 pages.

Final Office Action and Notice of References Cited, U.S. Appl. No. 11/242,320, May 13, 2009, 9 pages.

Amendment and Response to Final Office Action, U.S. Appl. No. 11/242,320, Jul. 13, 2009, 10 pages.

Advisory Action Before the Filing of an Appeal Brief, U.S. Appl. No. 11/242,320, Jul. 22, 2009, 8 pages.

Non-Final Office Action, U.S. Appl. No. 12/142,904, May 13, 2009, 6 pages.

Amendment and Response to Final Office Action and Advisory Action, U.S. Appl. No. 11/242,320, Aug. 12, 2009, 10 pages.

Amendment and Response to Office Action, U.S. Appl. No. 12/142,904, Aug. 12, 2009, 7 pages.

Non-Final Office Action and PTO-892, U.S. Appl. No. 11/242,320, mailed Sep. 28, 2009, 9 pages.

Notice of Allowance and Fee(s) Due, Notice of Allowability, Examiner-Initiated Interview Summary, Examiner's Amendment, and PTO-892, U.S. Appl. No. 12/142,904, mailed Nov. 5, 2009, 7 pages.

Amendment and Response to Non-Final Office Action, U.S. Appl. No. 11/242,320, dated Dec. 16, 2009, 8 pages.

* cited by examiner

EXERCISE MACHINE HAVING ROTATABLE WEIGHT SELECTION INDEX

CROSS-REFERENCE TO RELATED APPLICATIONS

This application claims the benefit under 35 U.S.C. §119(e) to U.S. Provisional Application No. 60/849,300 entitled "Exercise Machine Having Rotatable Weight Selection Index" and filed on Oct. 4, 2006, the disclosure of which is hereby incorporated by reference herein in its entirety.

INCORPORATION BY REFERENCE

This application is related to U.S. application Ser. No. 11/242,320, filed Oct. 3, 2005, which application claims the benefit of U.S. Provisional Patent Application No. 60/616,003, filed Oct. 4, 2004, and U.S. Provisional Patent Application 60/616,387, filed Oct. 5, 2004, all of which are hereby incorporated herein by reference.

FIELD OF THE INVENTION

The present invention relates to exercise equipment and methods of making and using such equipment. More particularly, the present invention relates to weight exercise equipment and methods of using and making such equipment.

BACKGROUND OF THE INVENTION

Traditional weight machines are either plate loaded, where the user mounts the desired amount of weight plates on the machine manually, or weight-stack loaded, where the user selects the desired amount of weight from a weight stack using a removable pin. Both have their drawbacks.

While the plate-loaded machines allow smooth operation and a wide variety of load to be applied, even allowing the use of load increments as small as two and a half pound plates, it requires locating the various increments of the proper weight plates in a sometimes busy and disorganized weight room. Also, the plate-loaded machines require the user to load and unload the machine, which presents an injury hazard and wastes energy of the user better reserved for the actual exercise movement performed on the machine.

The weight-stack loaded machines are convenient, but most often only allow relatively large increments of weights (mostly 10 pounds) to be selected using the pin. Some weight-stack loaded machines have supplemental weights to allow for application of smaller increments of weights, but often require the actuation of a second weight selection structure for the supplemental weights. The weight-stack loaded machines typically have tall profiles. Also, the weight-stack loaded machines utilize tubular columns along which the weights displace. This arrangement results in relatively high friction generation and weight movement that is less smooth than plate-loaded machines.

SUMMARY OF THE INVENTION

Described herein are various embodiments of a weight exercise machine. One embodiment of a weight exercise machine may take the form of a first frame, a second frame, at least one first weight, a first shaft, and a weight selector. The second frame may be operatively associated with the first frame and movable relative to the first frame. The first shaft may include at least one cam thereon operatively associated with at least one of the at least one first weight to selectively operatively associate and to selectively disassociate the at least one of the at least one first weight with the second frame.

The weight selector may be operatively associated with the first shaft and rotatable around an axis. The axis may be substantially co-axial with the first shaft. When the second frame is moved relative to the first frame, the at least one weight moves relative to the first frame when operatively associated with the second frame, and the at least one weight remains substantially stationary with respect to the first frame when the at least one weight is disassociated from the second frame.

While multiple embodiments are disclosed, still other embodiments of the weight exercise machine will become apparent to those skilled in the art from the following detailed description, which shows and describes various embodiments of a weight exercise machine. As will be realized, the invention is capable of modifications in various aspects, all without departing from the spirit and scope of the present invention. Accordingly, the drawings and detailed description are to be regarded as illustrative in nature and not restrictive.

DETAILED DESCRIPTION OF THE INVENTION a. Overview of the Weight Exercise Machine

The present invention is a weight exercise machine for use by a person. The machine includes a plurality of weight plates, a weight indexing mechanism, and an exercise member against which the person exerts an exercise force when using the machine to exercise. In one embodiment, the weight indexing mechanism is rotatable to selectively operably couple the exercise member with various weight plate combinations such that displacement of the exercise member causes a selected weight plate combination to displace.

Due to the machine's configuration, the machine generates less friction than conventional weight exercise machines and, as a result, offers very smooth operation. The machine's configuration also allows the selection of incremental weight changes that are substantially smaller than conventional weight exercise machines. Also, the machine's configuration results in a substantially decreased vertical profile as compared to conventional weight exercise machines. For at least these reasons, the weight exercise machine of the present invention is advantageous over the conventional weight exercise machines known in the art.

b. First Embodiment of the Weight Exercise Machine

Figure 1:
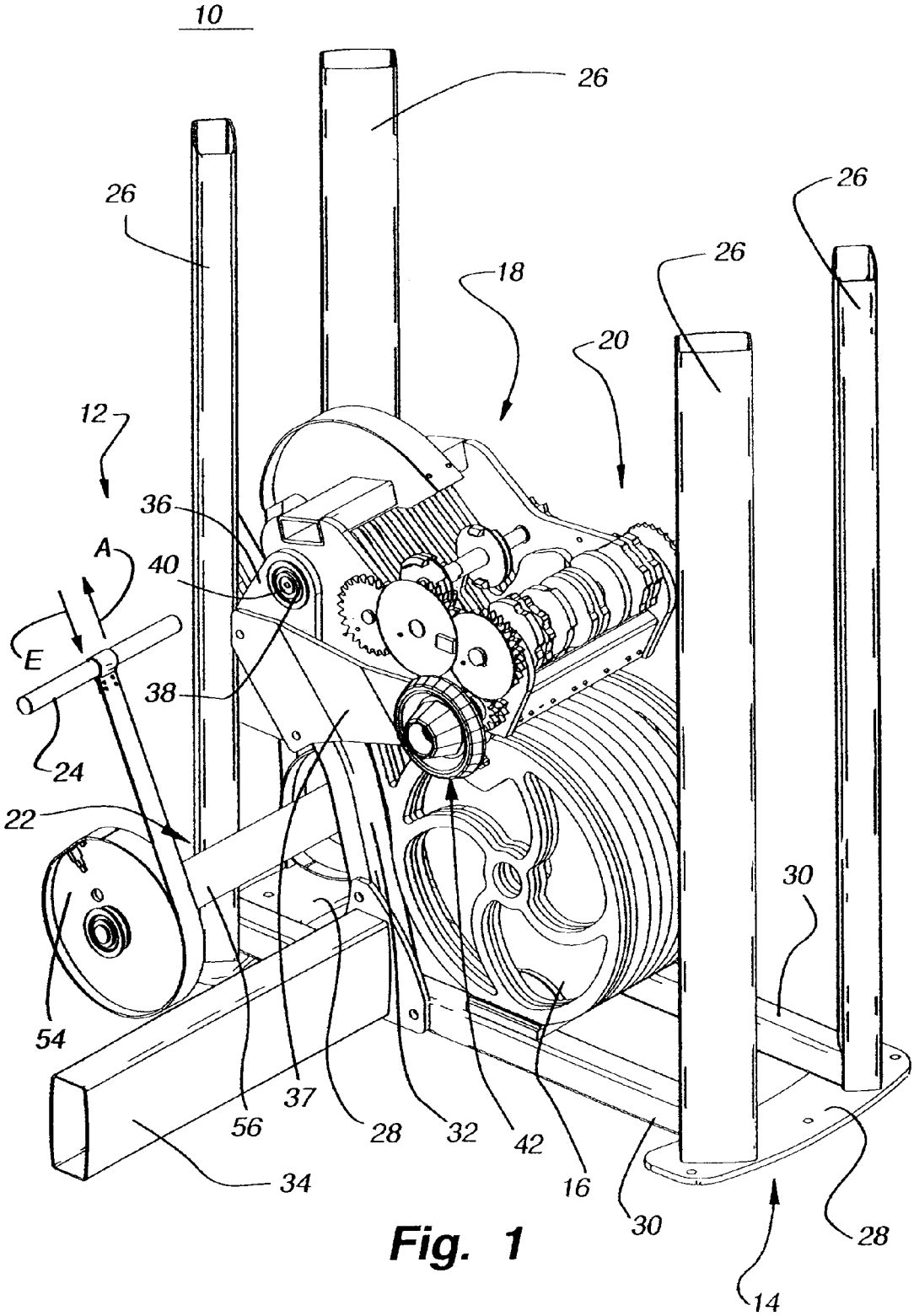
FIG. 1 is an isometric view of the weight exercise machine as viewed from the front/user side of the machine.
Figure 2:
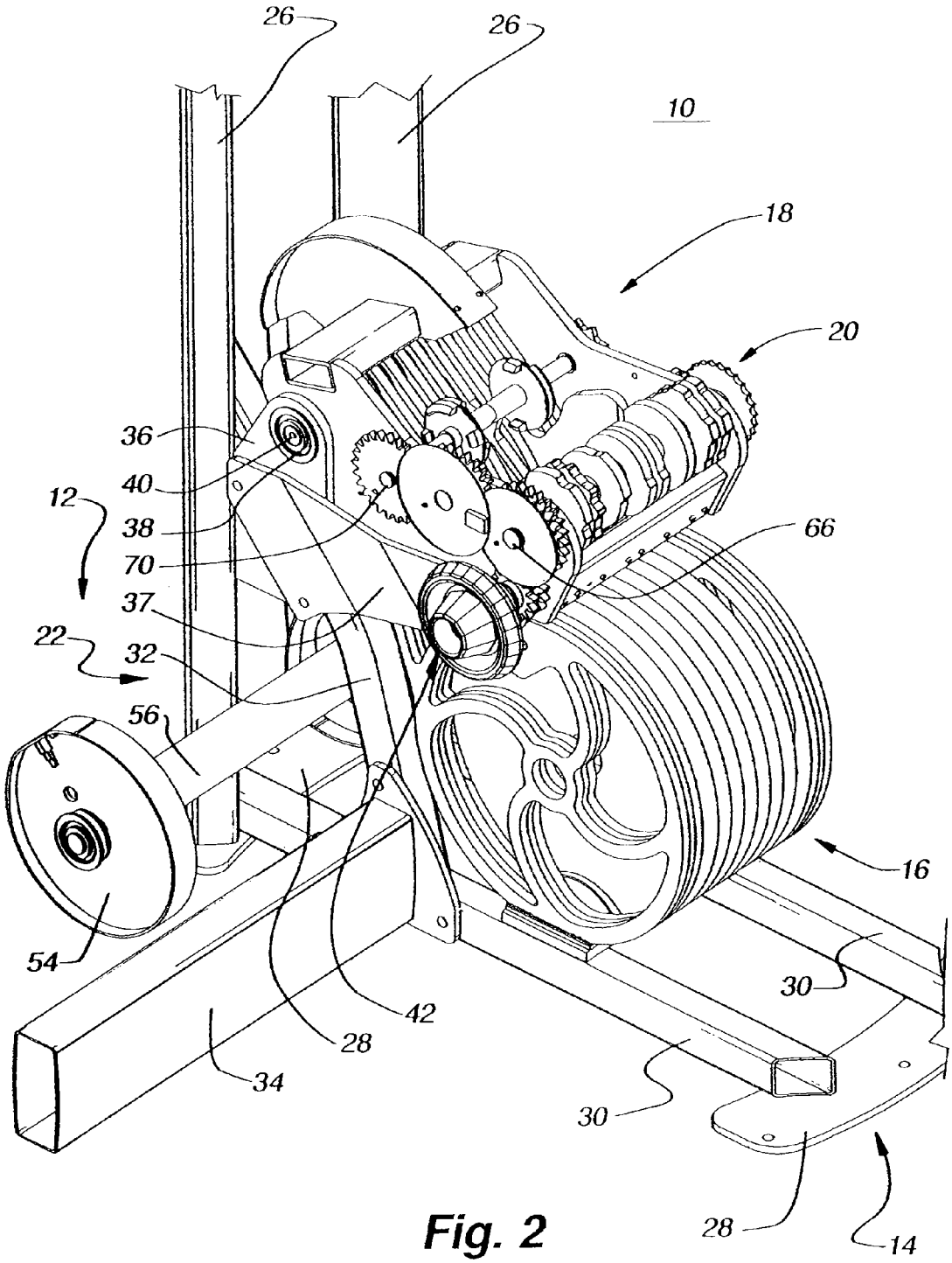
FIG. 2 is the same view depicted in FIG. 1, except, for clarity purposes, the view has been enlarged and the front vertical posts of the base frame have been removed.
Figure 3:
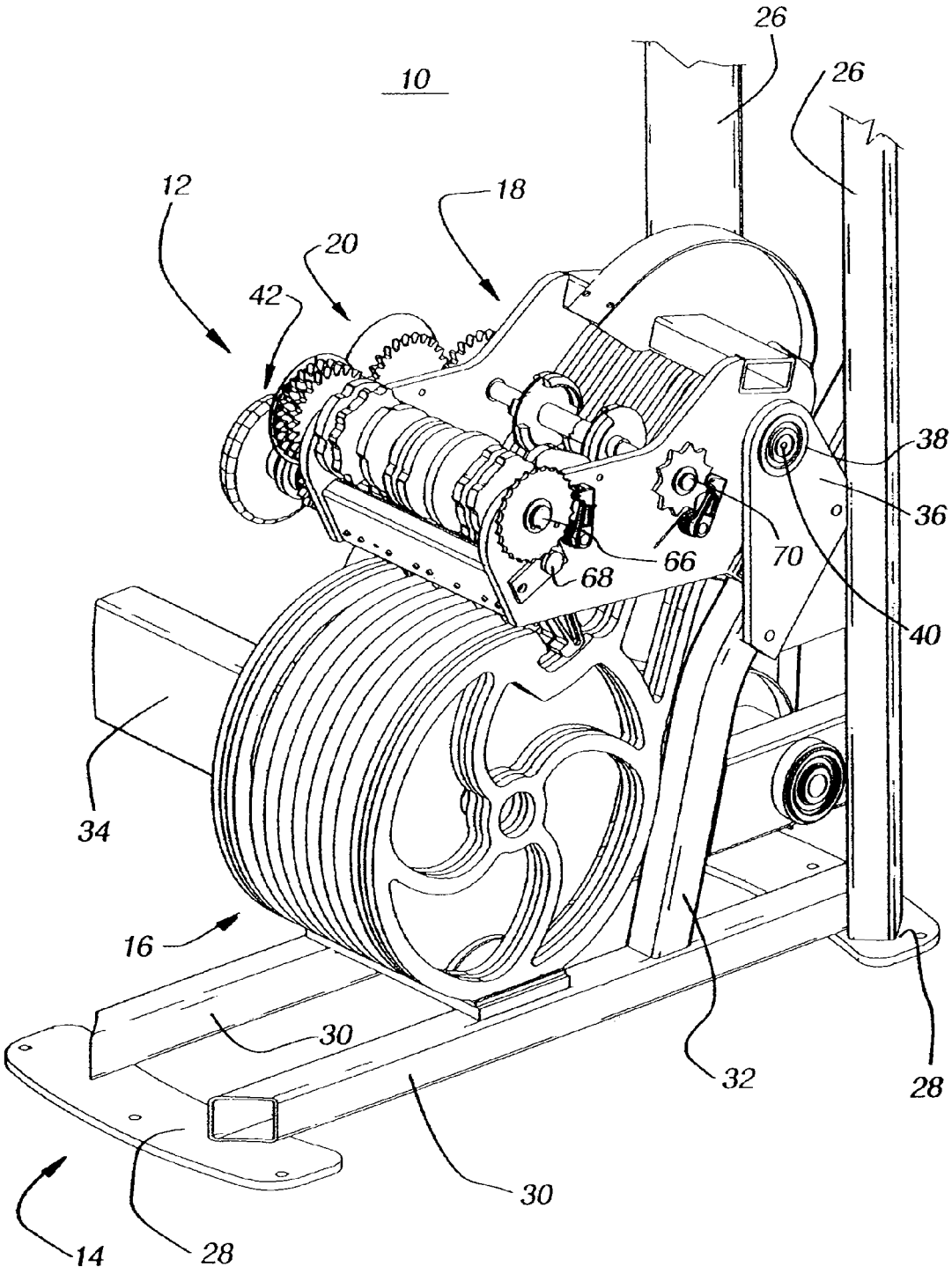
FIG. 3 is an isometric view of the exercise machine as viewed from the front/non-user side of the machine, wherein the front vertical posts of the base frame have been removed for clarity purposes.
Figure 4:
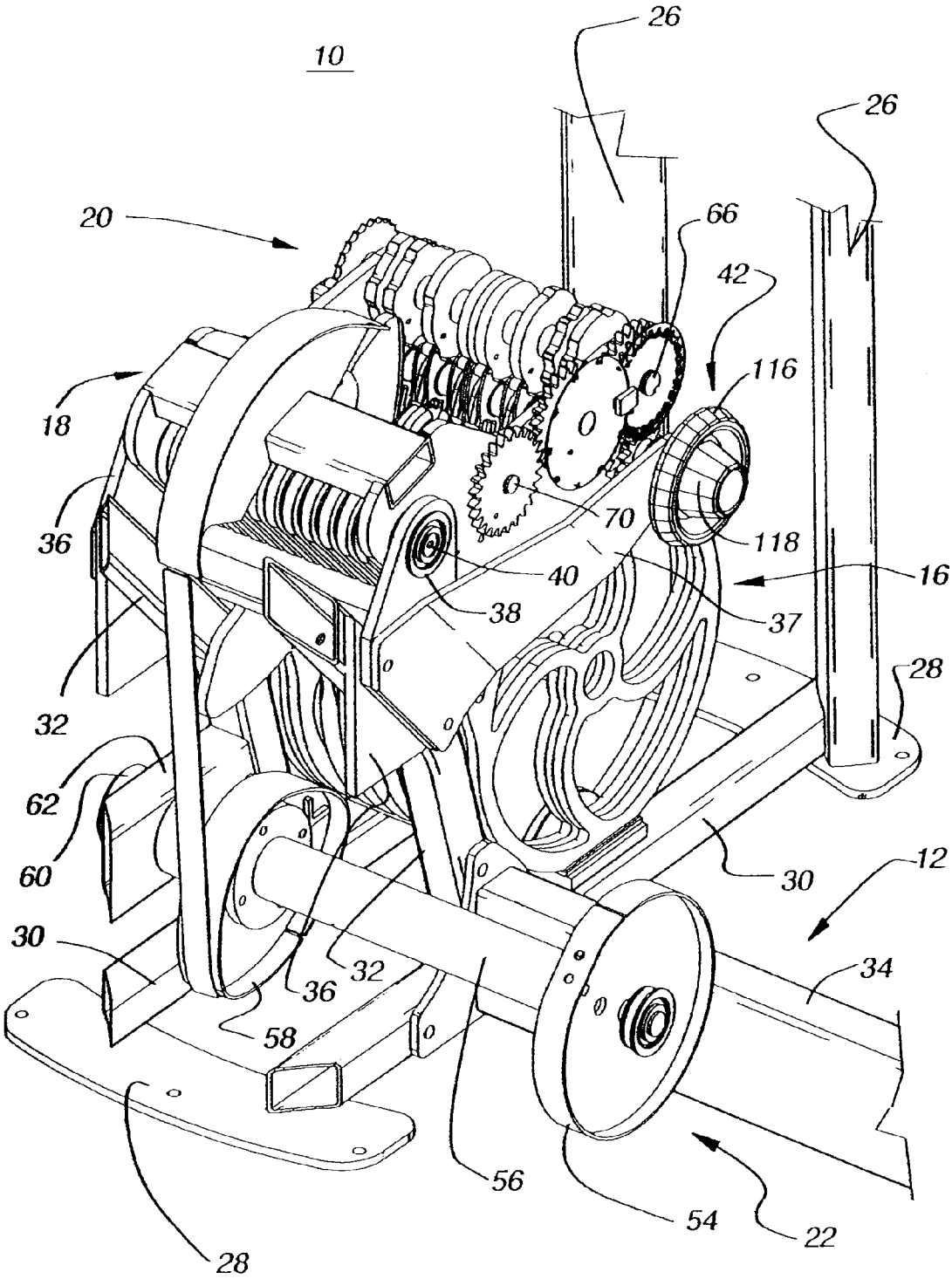
FIG. 4 is an isometric view of the exercise machine as viewed from the rear/user side of the machine, wherein the rear vertical posts of the base frame have been removed for clarity purposes.
Figure 5:
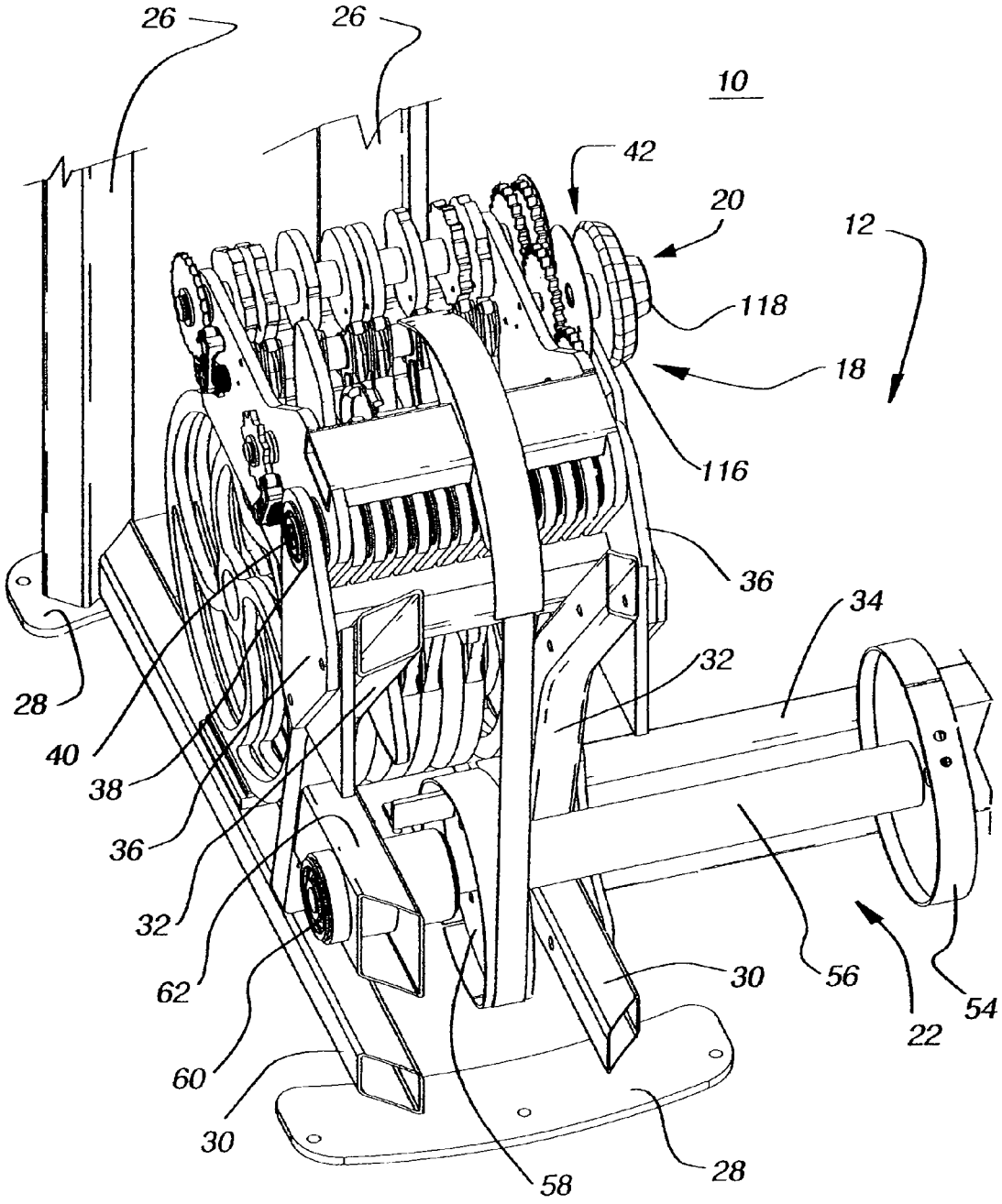
FIG. 5 is an isometric view of the exercise machine as viewed from the rear/non-user side of the machine, wherein the rear vertical posts of the base frame have been removed for clarity purposes.

For an understanding of the overall configuration the first embodiment of the weight exercise machine 10 of the present invention and the relationships between the machine's various elements, reference is made to FIGS. 1-5. FIG. 1 is an isometric view of the weight exercise machine 10 as viewed from the front/user side of the machine 10. FIG. 2 is the same view depicted in FIG. 1, except, for clarity purposes, the view has been enlarged and the front vertical posts of the base frame have been removed. FIG. 3 is an isometric view of the exercise machine 10 as viewed from the front/non-user side of the machine 10, wherein the front vertical posts of the base frame have been removed for clarity purposes. FIG. 4 is an isometric view of the exercise machine 10 as viewed from the rear/user side of the machine 10, wherein the rear vertical posts of the base frame have been removed for clarity purposes. FIG. 5 is an isometric view of the exercise machine 10 as viewed from the rear/non-user side of the machine 10, wherein the rear vertical posts of the base frame have been removed for clarity purposes.

As illustrated in FIG. 1, the machine 10 includes a workstation 12, a base frame 14, weights 16, a weight arm assembly 18, a weight indexing mechanism 20, and a force transfer mechanism 22. The workstation 12 is located on the user side of the machine 10 and includes an exercise member 24 that a user engages and displaces to exercise with the machine 10. For example, where the machine 10 is an embodiment intended to exercise portions of the upper body (e.g., shoulders, chest, back, arms, traps, etc.), the exercise member 24 will be configured for engagement by the user's hands and/or arms. Where the machine 10 is an embodiment intended to exercise portions of the mid and lower torso (e.g., abdominals, lower back, etc.) the exercise member 24 will be configured for engagement by the user's hands, arms, and/or upper torso. Where the machine 10 is an embodiment intended to exercise portions of the lower body (e.g., upper and lower legs, glutes, etc.), the exercise member 24 will be configured for engagement by the user's legs, feet or shoulders. Where the machine 10 is an embodiment intended to exercise the neck, the exercise member 24 will be configured for engagement with the user's head.

As shown in FIGS. 1-5, the base frame 14 supports the moving parts of the machine 10 and includes front and rear vertical posts 26, front and rear foot plates 28, horizontal members 30, diagonal members 32, a work station member 34, pivot support plates 36, and an index wheel support arm 37. The front and rear foot plates 28 extend side-to-side between the bottoms of each pair of front vertical posts 26 and each pair of rear vertical posts 26. The horizontal members 30 extend front-to-back between the lower ends of the vertical posts 26. The diagonal members 32 extend from near the longitudinal middle of each rear vertical post 26 to near the longitudinal middle of the adjacent horizontal member 30. Each pivot support plate 36 extends vertically upward from a diagonal member 32 and includes a bearing/busing 38 for pivotally receiving a axle 40 about which the weight arm assembly 18 and the weights 16 pivot, as will be discussed in greater detail later in this Detailed Description. The index wheel support 37 extends forwardly and generally horizontal from the upper portion of the user side diagonal member 32. An index wheel assembly 42, which will be described in greater detail later in this Detailed Description, is rotatably mounted in the free end of the index wheel support 37.

As depicted in FIGS. 1-5, the workstation member 34 is on the user side of the base frame 14 and extends from the intersection between the diagonal member 32 and the horizontal member 30. As can be understood from FIG. 1, the workstation member 34 serves to couple the machine 10 to a workstation bench or seat (not shown) for supporting the user when displacing the exercise member 24 during the performance of an exercise movement.

Figure 6:
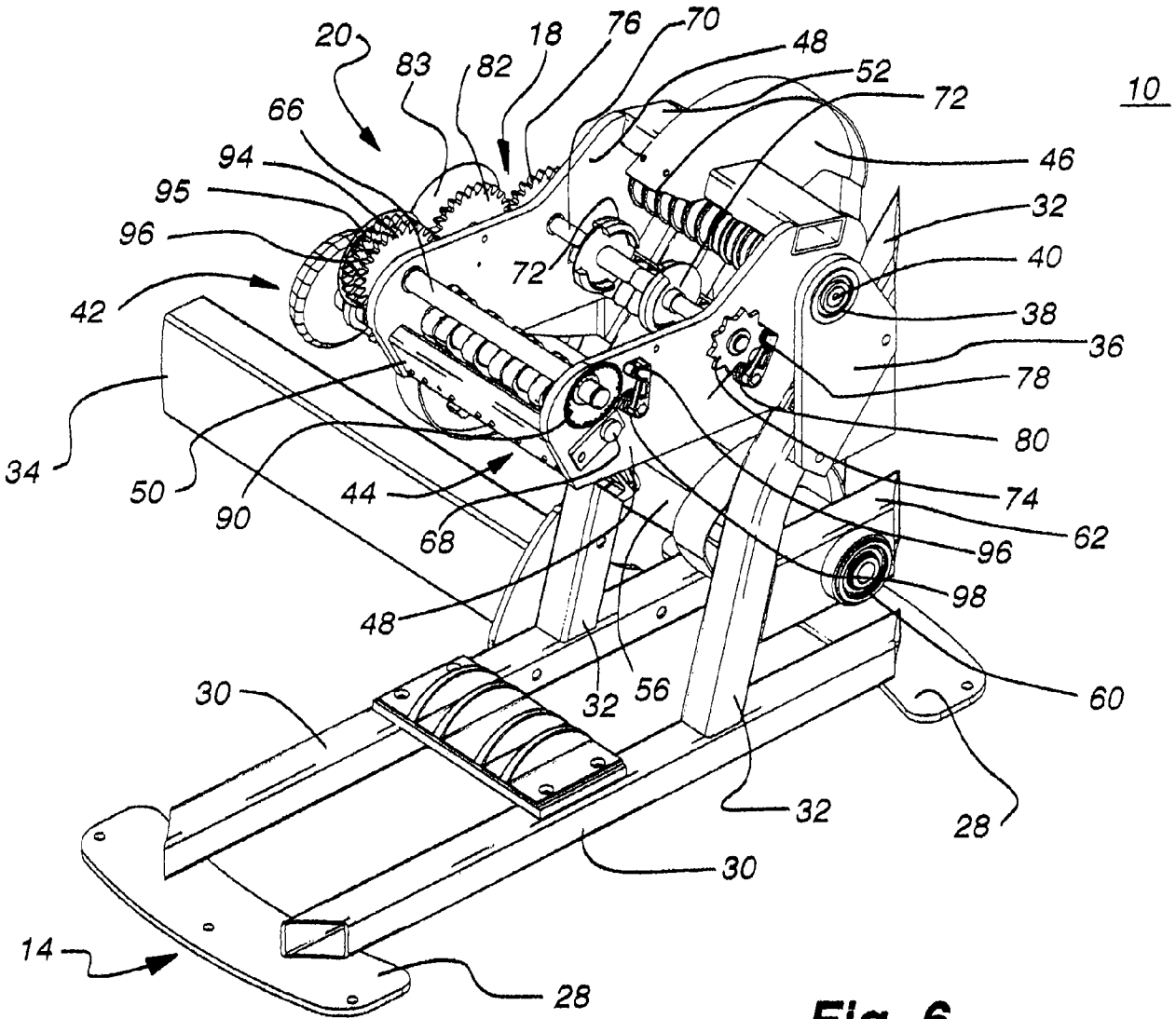
FIG. 6 is an isometric view of the weight exercise machine as viewed from the front/non-user side and, for clarity purposes, only depicting the weight arm assembly, portions of the base frame, and the force transfer mechanism.
Figure 7:
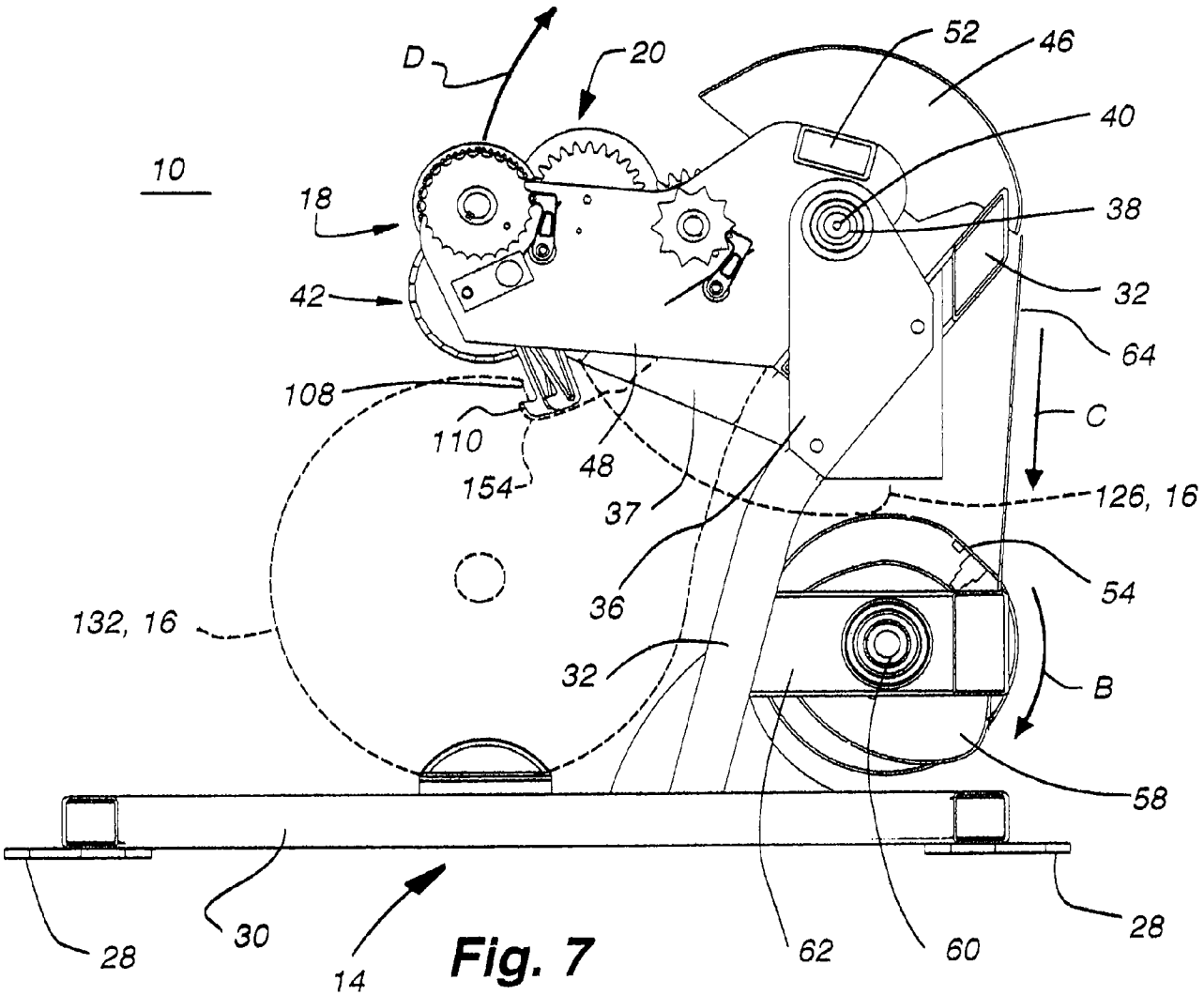
FIG. 7 is a non-user side elevation of the machine depicting the weights (shown in phantom lines) and the same machine elements shown in FIG. 6, wherein the weight arm assembly has not pivoted relative to the base frame.
Figure 8:
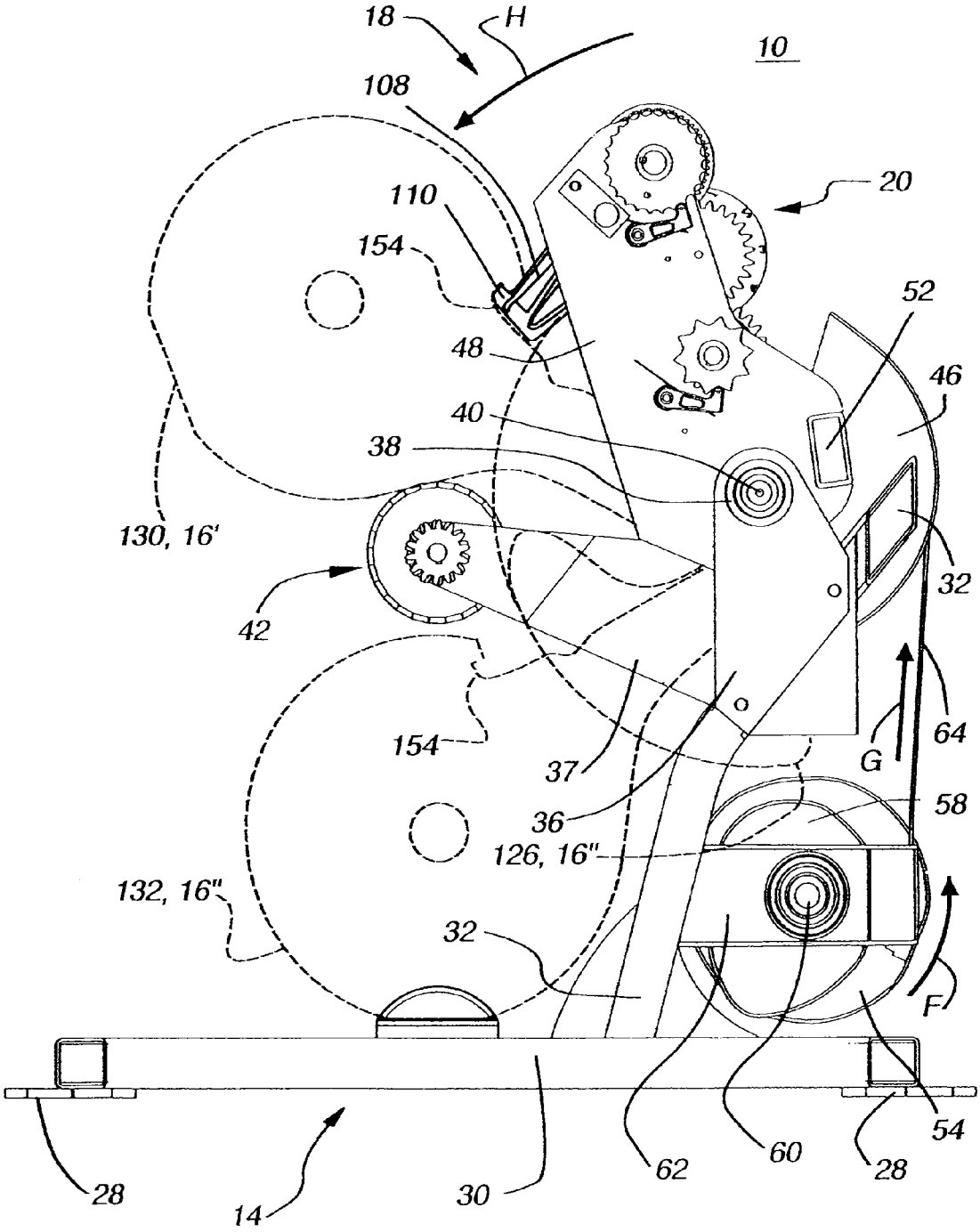
FIG. 8 is the same view illustrated in FIG. 7, except the weight arm assembly and the weights coupled thereto have pivoted relative to the base frame.

For a discussion of the components of the weight arm assembly 18 and its relationship to the base frame 14, reference is made to FIGS. 6-8. FIG. 6 is an isometric view of the weight exercise machine 10 as viewed from the front/non-user side and, for clarity purposes, only depicting the weight arm assembly 18, portions of the base frame 14, and the force transfer mechanism 22. FIG. 7 is a non-user side elevation of the machine 10 depicting the weights 16 (shown in phantom lines) and the same machine elements shown in FIG. 6, wherein the weight arm assembly 18 has not pivoted relative to the base frame 14. FIG. 8 is the same view illustrated in FIG. 7, except the weight arm assembly 18 and the weights 16 coupled thereto have pivoted relative to the base frame 14.

As shown in FIG. 6, the weight arm assembly 18 includes the weight index assembly 20, a frame 44, and a cam 46. The frame 44 includes side plates 48, a front member 50, and a rear member 52. The front and rear members 50, 52 extend side-to-side between the side plates 48. Elements of the weight index assembly 20 extend side-to-side between the side plates 48. The cam 46 is centered side-to-side on, and connected to, the rear member 52.

As indicated in FIGS. 1, 4 and 5, the force transfer mechanism 22 includes an exercise member pulley 54, a shaft 56, a cam 58, and a bearing/bushing 60 mounted in a frame member 62 that horizontally extends between the non-user side diagonal member 32 and the rear vertical post 26. As indicated in FIG. 1, the exercise member 24 is coupled to the exercise member pulley 54. The exercise member pulley 54, shaft 56 and cam 58 are rotatable relative to the base frame 14 via the bearing/bushing 60.

As illustrated in FIGS. 4-6, the rear portion of each side plate 48 of the weight arm assembly 18 is pivotally mounted on the axle 40 that extends between the pivot support plates 36 of the base frame 14. As depicted in FIGS. 7 and 8, the pivotal connection between the base frame 14 and the weight arm assembly 18 allows the weight arm assembly 18 to pivot between a downward position (see FIG. 7) and an upward position (see FIG. 8).

As shown in FIGS. 4, 5, 7 and 8, a chain, rope, cable or belt 64 extends between a point of connection with the cam 46 of the weight arm assembly 18 and a point of connection with the cam 58 of the force transfer mechanism 22. Thus, as can be understood from FIGS. 1, 4, 5, 7 and 8, when the user displaces the exercise member 24 away from the exercise member pulley 54 (as indicated by arrow A in FIG. 1), the force transfer mechanism 22 is caused to rotate such that the cam 58 of the force transfer mechanism 22 rotates clockwise as indicated by arrow B in FIG. 7. The clockwise rotation of the cam 58 of the transfer mechanism 22 causes the belt 64 to wrap about the cam 58, thereby causing the belt 64 to move downward as indicated by arrow C in FIG. 7. The downward motion of the belt 64 pulls on the cam 46 of the weight arm assembly 18, which causes the weight arm assembly 18 to pivot clockwise as indicated by arrow D in FIG. 7 as the weight arm assembly moves from the low position depicted in FIG. 7 to the high position depicted in FIG. 8.

As can be understood from FIGS. 1, 4, 5, 7 and 8, when the user allows the exercise member 24 to displace back towards the exercise member pulley 54 (as indicated by arrow E in FIG. 1), the force transfer mechanism 22 is caused to rotate such that the cam 58 of the force transfer mechanism 22 rotates counterclockwise as indicated by arrow F in FIG. 8. The counterclockwise rotation of the cam 58 of the transfer mechanism 22 causes the belt 64 to unwrap from about the cam 58, thereby causing the belt 64 to move upward as indicated by arrow G in FIG. 8. The upward motion of the belt 64 allows the weight arm assembly 18 to pivot counterclockwise as indicated by arrow H in FIG. 8 as the weight arm assembly moves from the high position depicted in FIG. 8 to the low position depicted in FIG. 7.

Figure 9:
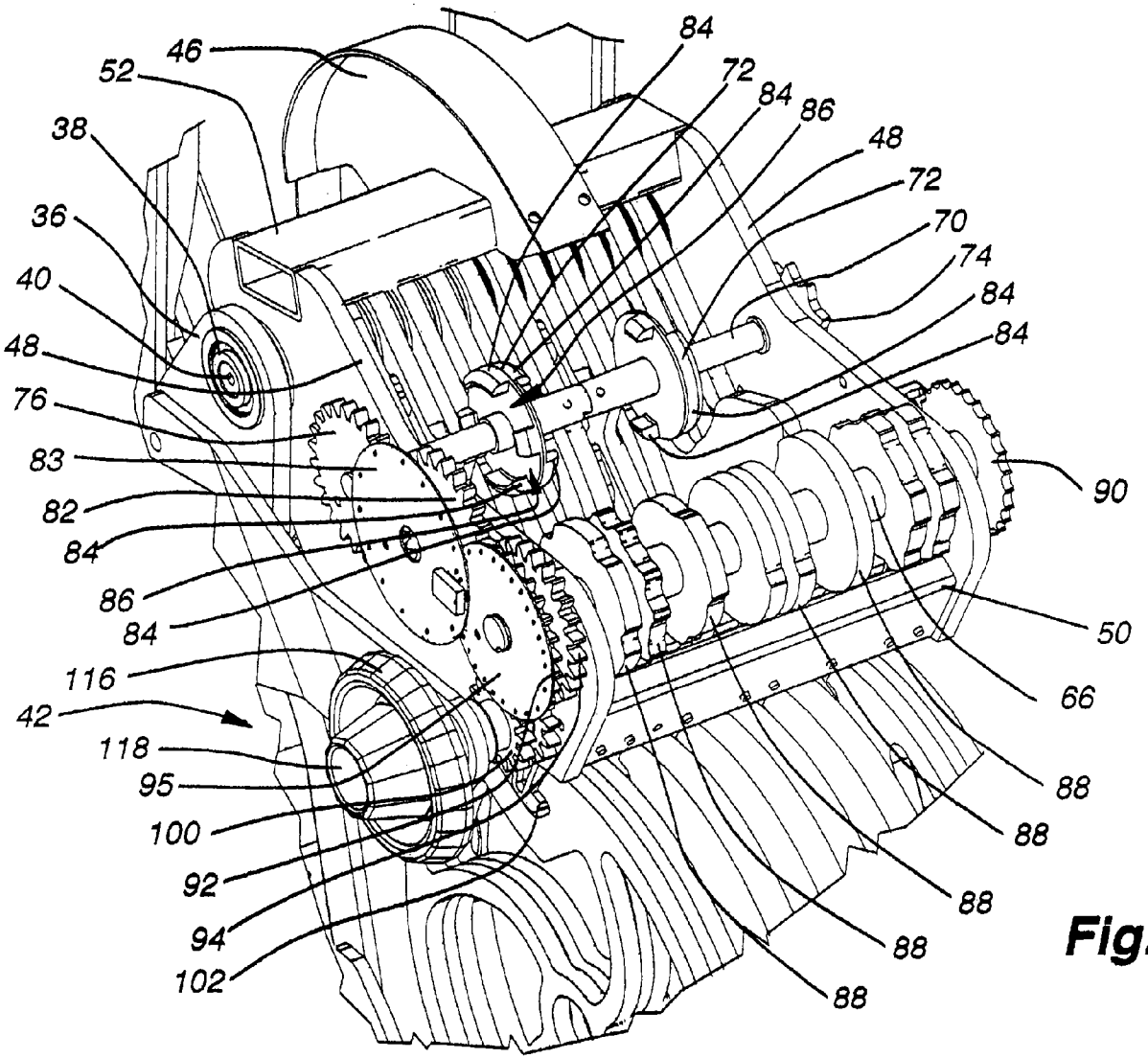
FIG. 9 is an enlarged isometric view of the weight arm assembly and weight-indexing mechanism as viewed from the front/user side of the weight exercise machine of the present invention.
Figure 10:
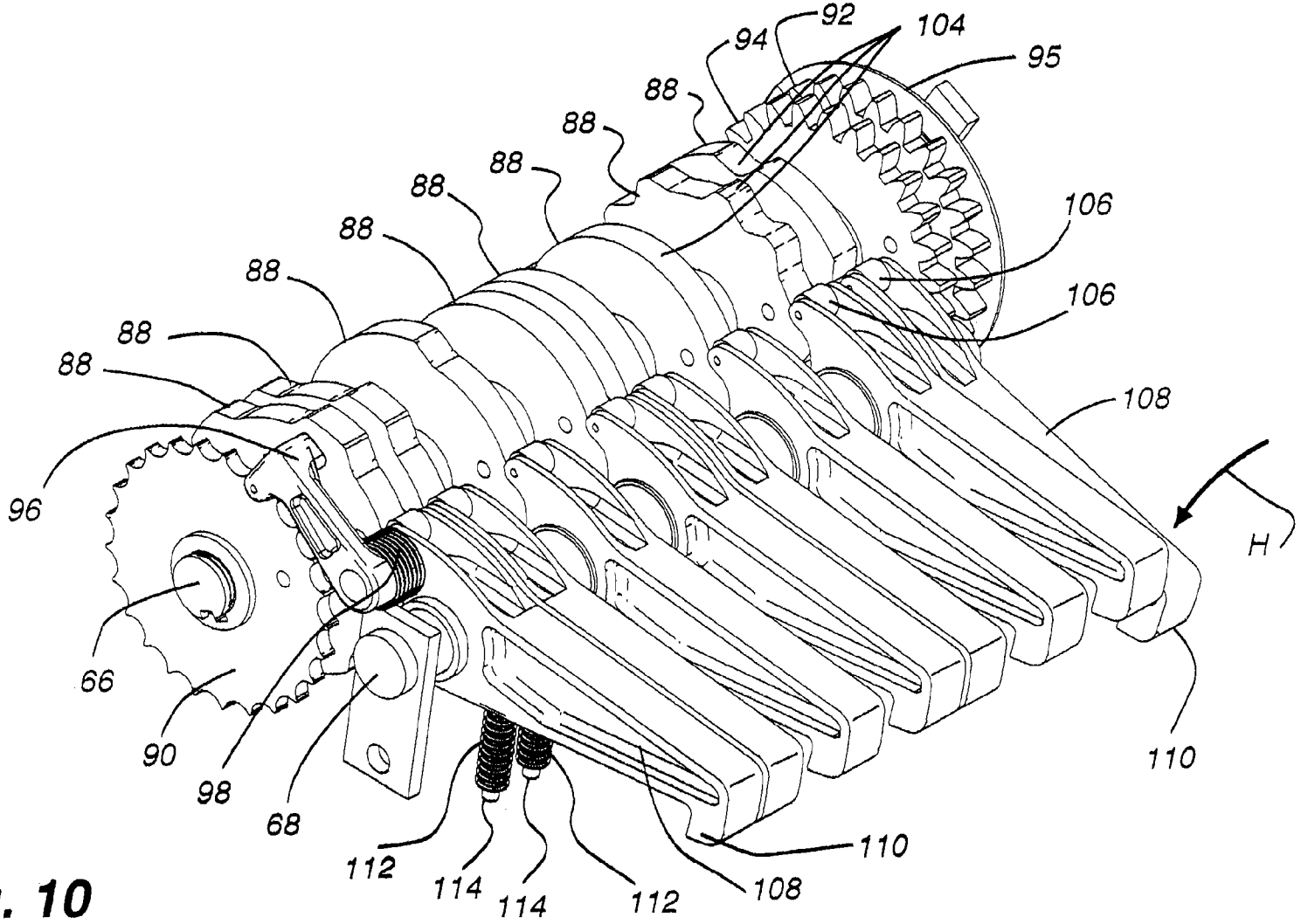
FIG. 10 is an enlarged isometric view of the primary weight engagement axle and the hook axle and their associated elements as viewed from a direction approximately degrees opposite of the viewing perspective in FIG. 9 (i.e., as viewed from the rear/non-user side of the machine).

As shown in FIG. 6, the weight indexing mechanism 20 includes a primary weight engagement axle 66 and its associated elements, a hook axle 68 and its associated elements, and an add-on weight engagement axle 70 and its associated elements. For a detailed discussion of the primary weight engagement axle 66, the hook axle 68, the add-on weight engagement axle 70 and their respective associated elements, reference is made to FIGS. 6, 9 and 10. FIG. 9 is an enlarged isometric view of the weight arm assembly 18 and weight indexing mechanism 22 as viewed from the front/user side of the weight exercise machine 10 of the present invention. FIG. 10 is an enlarged isometric view of the primary weight engagement axle 66 and the hook axle 68 and their associated elements as viewed from a direction approximately 180 degrees opposite of the viewing perspective in FIG. 9 (i.e., as viewed from the rear/non-user side of the machine 10).

As shown in FIGS. 6 and 9, the add-on weight engagement axle 70 extends between, and is rotatably supported by, the side plates 48 of the weight arm assembly 18. The add-on weight engagement axle 70 has mounted thereon a pair of weight engagement discs 72, an index sprocket 74, and a drive gear 76. The index sprocket 74 is located on the non-user side end of the add-on weight engagement axle 70 and interacts with a ratchet or follower arm 78 that is biased into engagement with the teeth of the index sprocket 74 via a spring 80. The ratchet arm 78 and index sprocket 74 interact to facilitate proper alignment of the weight engagement discs 72 with the weights 16 as discussed later in this Detailed Description. Also, the interaction between the ratchet arm 78 and index sprocket 74 provides a sensation to the user to indicate when the weight engagement discs 72 have been properly aligned. The drive gear 76 is located on the user side end of the add-on weight engagement axle 70 and is driven by an intermediate gear 82 rotatably supported off the user side plate 48 of the weight arm assembly 18. An indicator disk 83 shares the same axle as the intermediate gear 82 and is for indicating the amount of add-on weight engaged for lifting via the add-on weight engagement axle 70 and its associated elements.

The weight engagement disks 72 are located on the add-on weight engagement axle 70 between the side plates 48 of the weight arm assembly 18. The planar face of each weight engagement disc 72 is defined near the outer circumferential edge of each planar face by one or more arcuate cam surfaces or arcuate rim segments 84 that project outwardly from the respective planar face and are separated from each other by one or more gaps 86. As will be discussed later in this Detailed Description, the gaps 86 allow a cam follower or roller extending from an add-on weight to pass between the arcuate rim segments 84 to be engaged by an inner arcuate surface of an arcuate rim segment 84 when the weight arm assembly 18 is displaced upwardly (as previously discussed with respect to FIGS. 7 and 8) to cause the engaged add-on weight(s) to displace upwardly.

The ratchet arm 78 and index sprocket 74 interact to facilitate proper alignment of the weight engagement discs 72 with the roller(s) extending from the add-on weight(s) as the user indexes the weight indexing mechanism 20, as discussed later in this Detailed Description. Also, while the user is indexing the weight index mechanism 20, the interaction between the ratchet arm 78 and index sprocket 74 provides a sensation to the user to indicate when the weight engagement discs 72 have been properly aligned.

As shown in FIGS. 9 and 10, the primary weight engagement axle 66 extends between, and is rotatably supported by, the side plates 48 of the weight arm assembly 18. The primary weight engagement axle 66 has mounted thereon a plurality of cams 88, an index sprocket 90, a first drive gear 92, a second drive gear 94, and an indicator disk 95 for indicating the amount of primary weight engaged for lifting via the primary weight engagement axle 66 and its associated elements. The index sprocket 90 is located on the non-user side end of the primary weight engagement axle 66 and interacts with a ratchet or follower arm 96 that is biased into engagement with the teeth of the index sprocket 90 via a spring 98. The ratchet arm 96 and index sprocket 90 interact to facilitate proper alignment of the cam(s) 88 with the weight hook(s) supported off the hook axle 68 to cause the weight hook(s) to engage the primary weight(s), as discussed later in this Detailed Description. Also, the interaction between the ratchet arm 96 and index sprocket 90 provides a sensation to the user to indicate when the cam(s) 88 have been properly aligned.

The first drive gear 92, second drive gear 94 and indicator disk 95 are located on the user side end of the primary weight engagement axle 66, wherein the indicator disk 95 is at the extreme end of the primary weight engagement axle 66 followed by the first drive gear 92 and then the second drive gear 94. The first drive gear 92 is driven by a first drive gear 100 of the index wheel assembly 42 and rotates the primary weight engagement axle 66. The second drive gear 94 is driven by a second drive gear 102 of the index wheel assembly 42 and drives the intermediate gear 82 that drives the drive gear 76 of the add-on weight axle 70, thereby causing the add-on weight axle 70 to rotate.

As shown in FIG. 9, the cams 88 are evenly distributed along the primary weight engagement axle 66 between the side plates 48 of the weight arm assembly 18. As illustrated in FIG. 10, the cam surfaces 104 of the cams 88 vary and are positionally sequenced relative to each other such that, depending at what point along the indicator disk 95 the primary weight engagement axle 66 is rotated, one or more cams 88 will have cam surfaces 104 that abut against a roller or cam follower 106 on a hook 108 that is pivotally mounted on the hook axle 68. When a cam surface 104 abuts against a cam follower 106 of a hook 108, the hook 108 is caused to pivot about the hook axle 68 such that a tip 110 of the hook 108 engages a slot in the associated primary weight plate, as discussed later in this Detailed Description. Such a pivoting of a hook 108 by a cam surface 104 is indicated by arrow H in FIG. 10.

As indicated in FIG. 10, each hook 108 includes a helical spring 112 centered about a pin 114 that extends between the hook 108 and the front member 50 of the weight arm assembly 18. Each helical spring 112 acts between the front member 50 and the respective hook 108 to bias the tip 110 of the respective hook 108 out of engagement with the slot in the associated primary weight plate. When a cam surface 104 engages a cam follower 106 of a hook 108, the hook 108 is forced against the biasing force of the respective spring 112 to bring the hook tip 110 into engagement with the slot in the associated primary weight plate. As will be discussed later in this Detailed Description, the engagement of a hook tip 110 with the slot in the associated primary weight plate causes the primary weight plate to displace upwardly when the weight arm assembly 18 is displaced upwardly (as previously discussed with respect to FIGS. 7 and 8).

As shown in FIG. 9, the index wheel assembly 42 includes an outer wheel known as a primary weight or coarse adjustment wheel 116 and an inner wheel known as an add-on weight or fine adjustment wheel 118. The two wheels 116, 118 are coaxially mounted on coaxial axles that each connect to their respective drive gear 100, 102. Specifically, rotating the primary weight wheel 116 causes the first drive gear 100 of the index wheel assembly 42 to rotate and, as a result, the primary weight axle 66 to rotate. Rotating of the add-on weight wheel 118 causes the second drive gear 102 of the index wheel assembly 42 to rotate and, as a result, the add-on weight axle 70 to rotate. As can be understood from FIG. 8, although the gears 100, 102 of the index wheel assembly 42 engage and drive the first and second gears 92, 94 mounted on the primary weight engagement axle 66, when the weight arm assembly 18 is pivoted up the upward position, the index wheel assembly 42 and its gears 100, 102 do not follow, but instead remain fixed in position on the index wheel support arm 37, which is rigidly and non-moveably attached to the base frame 14.

Figure 11:
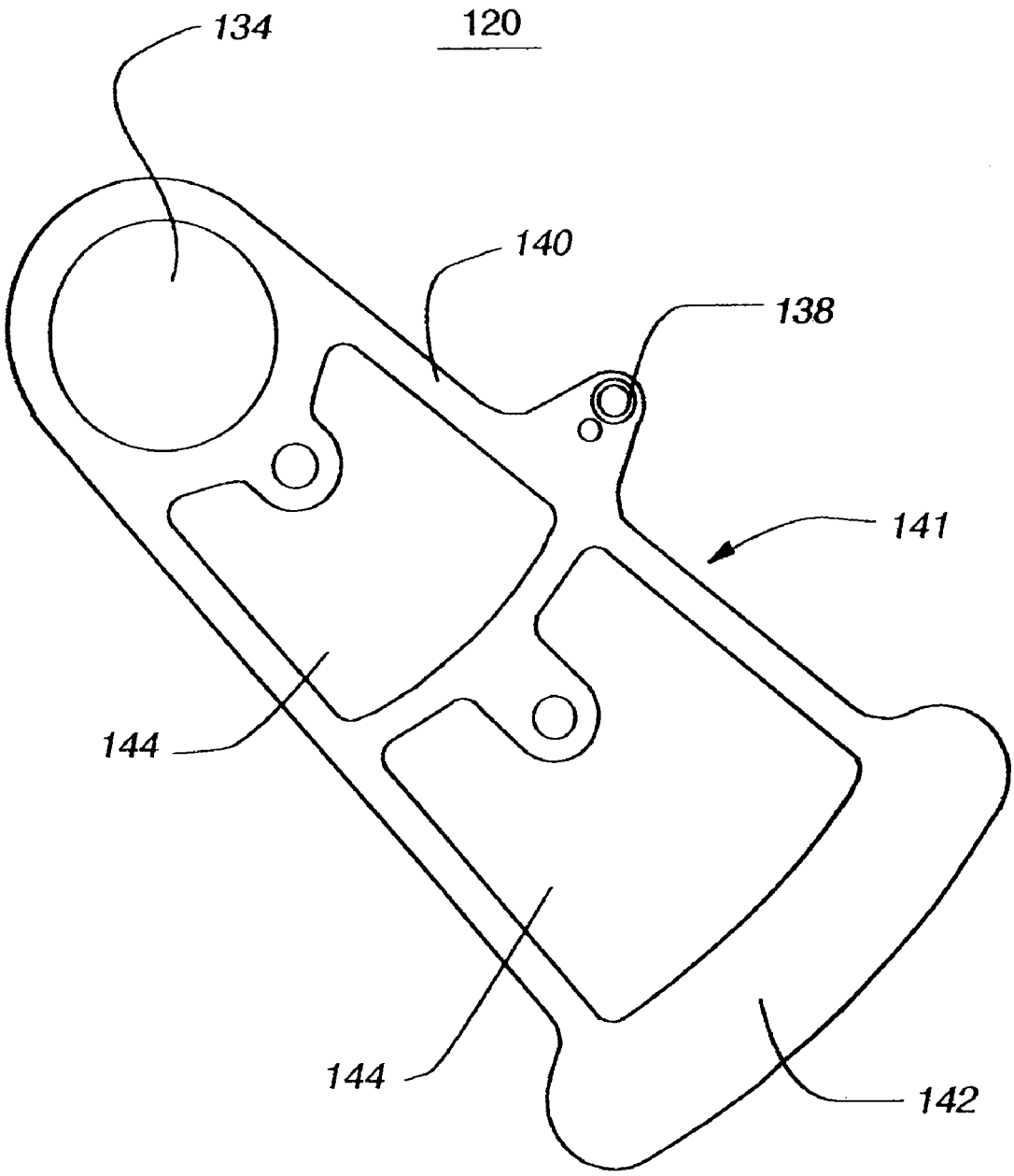
FIG. 11 is a side elevation of 1-pound add-on weight.
Figure 12:
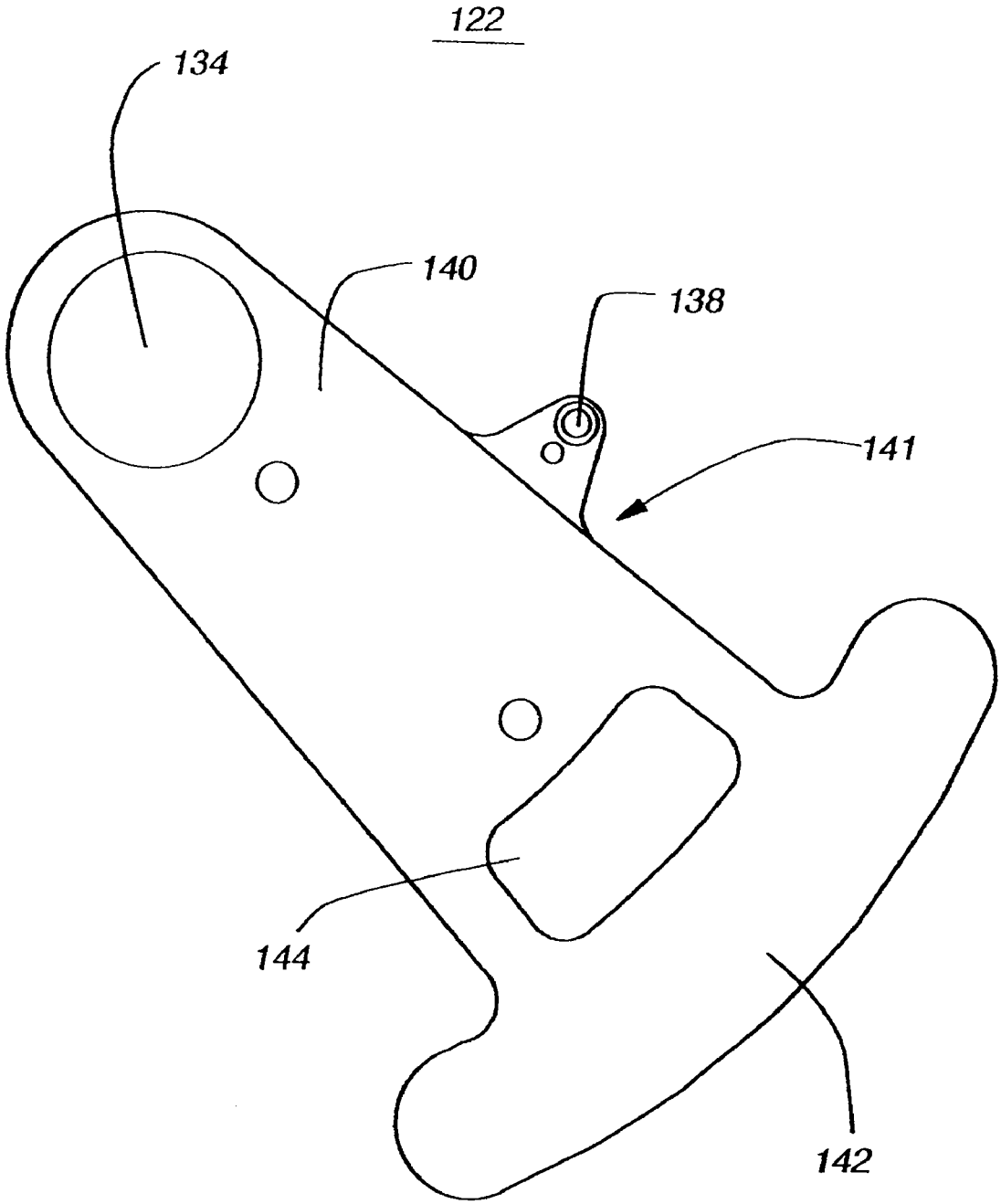
FIG. 12 is a side elevation of a 2-pound add-on weight.
Figure 13:
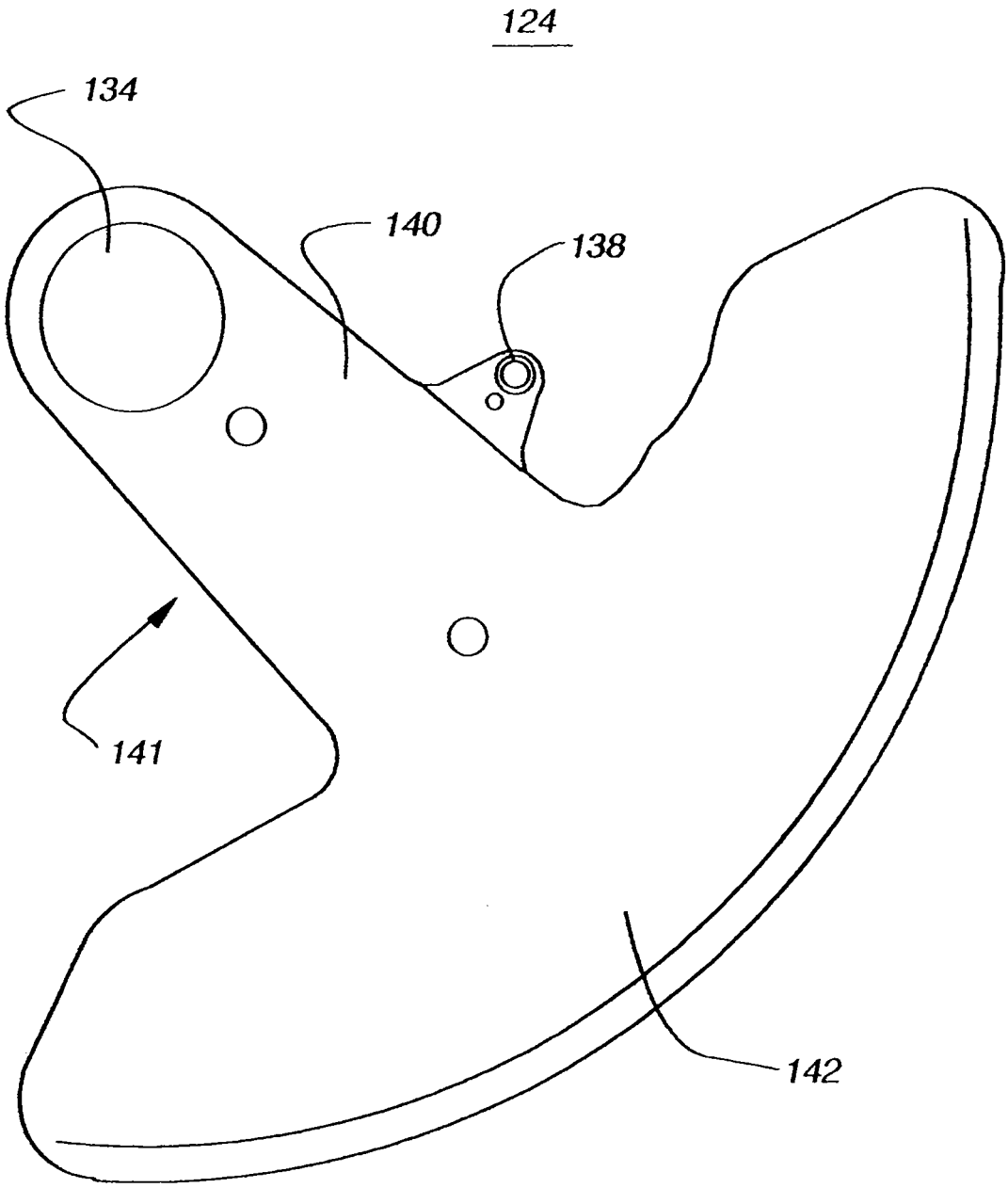
FIG. 13 is a side elevation of a 5-pound add-on weight.
Figure 14:
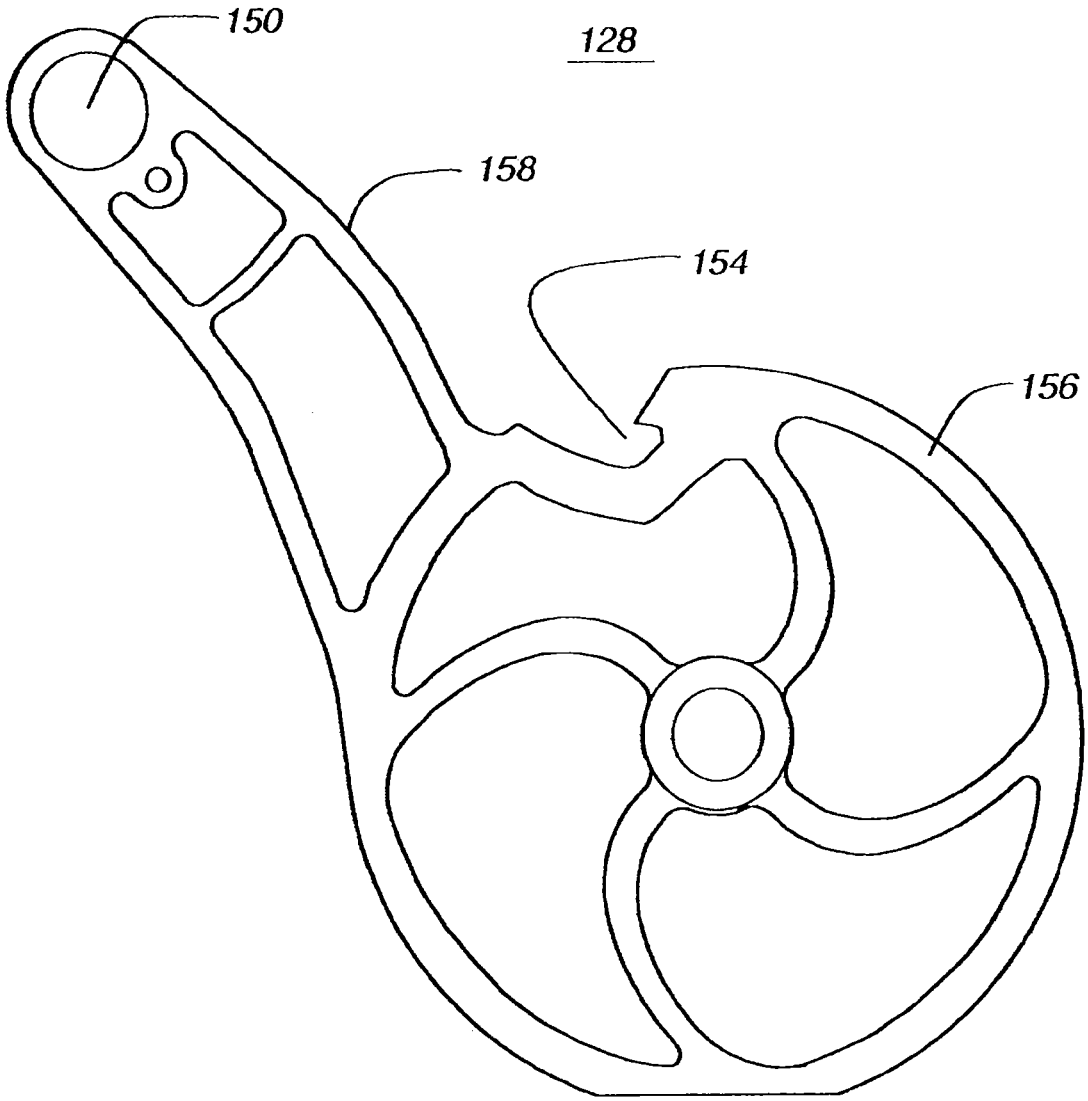
FIG. 14 is a side elevation of a 10-pound primary weight.
Figure 15:
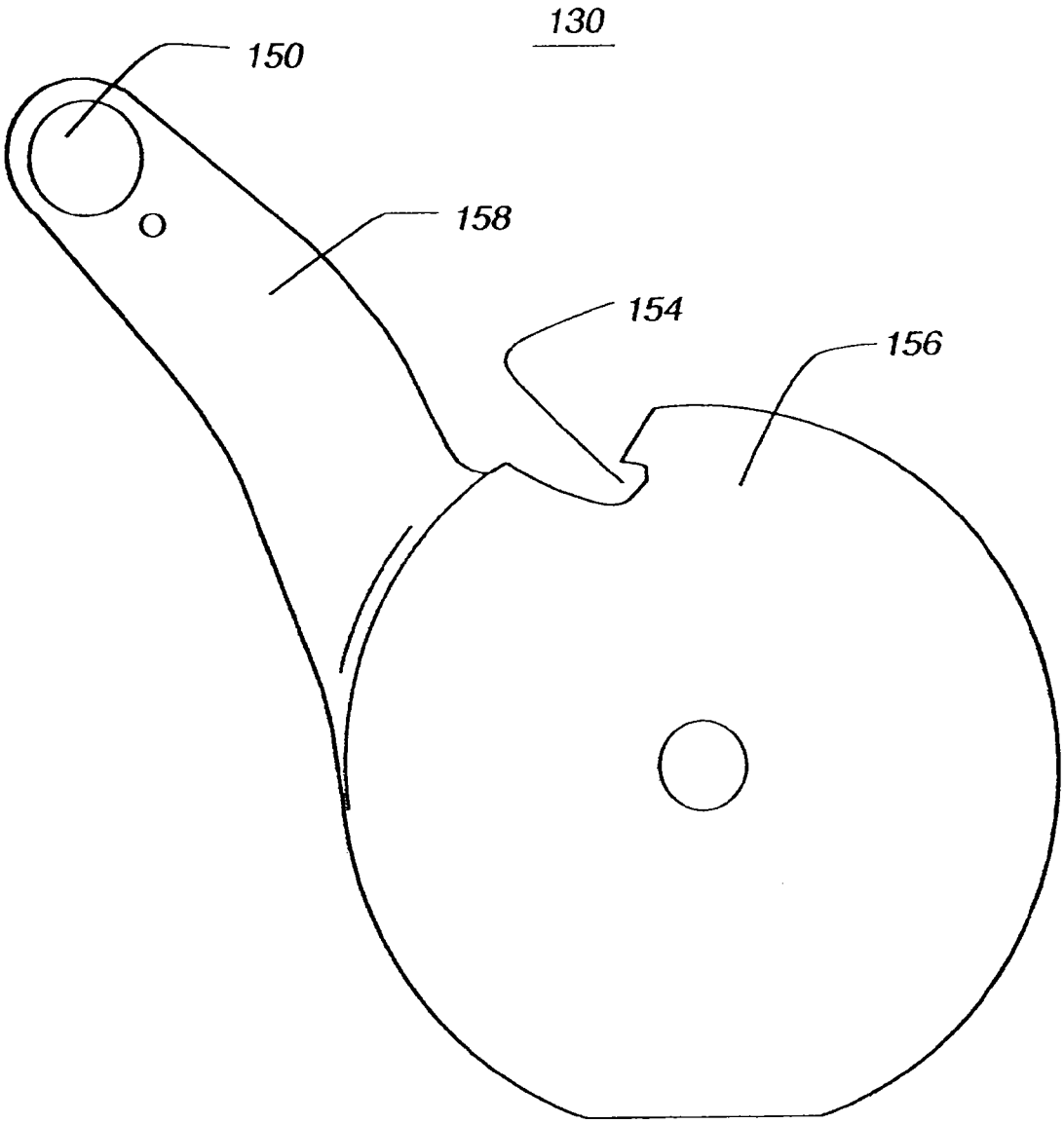
FIG. 15 is a side elevation of a 50-pound primary weight.
Figure 16:
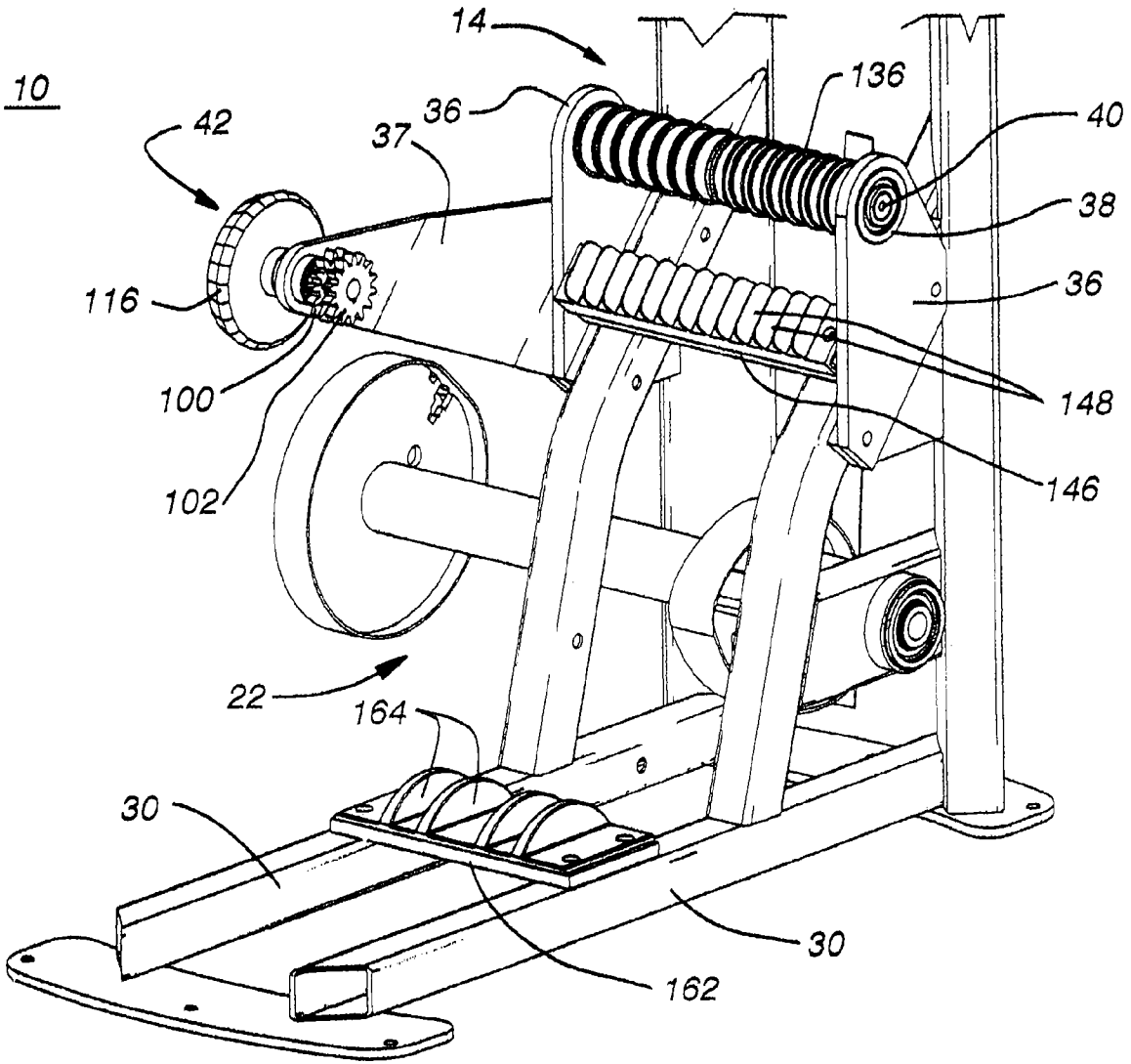
FIG. 16 is an isometric view of the weight exercise machine as viewed from the front/non-user side and wherein the weight arm assembly and weights have been removed for clarity purposes.
Figure 17:
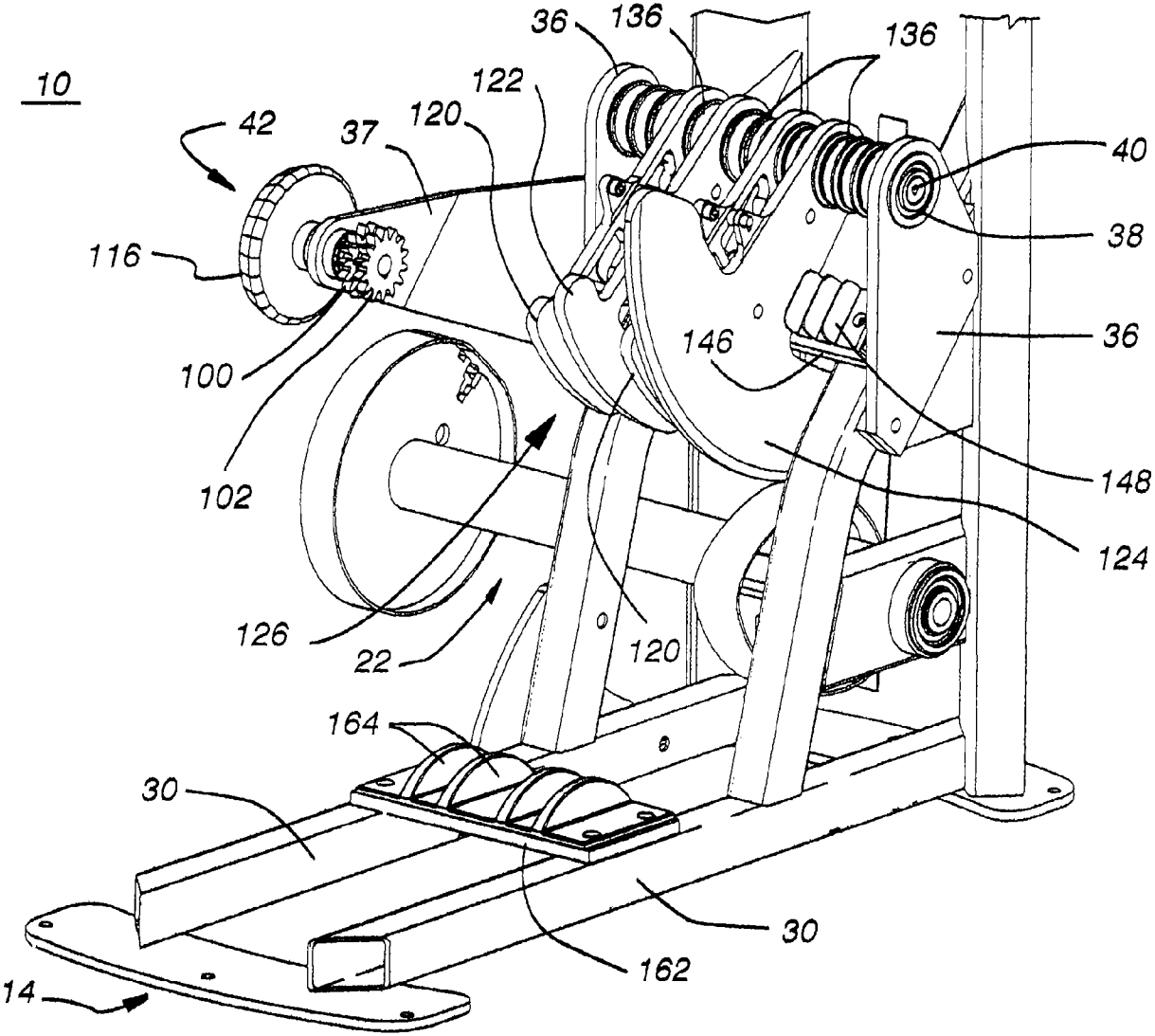
FIG. 17 is the same view depicted in FIG. 16, except the add-on weights are shown pivotally mounted to the base frame.
Figure 18:
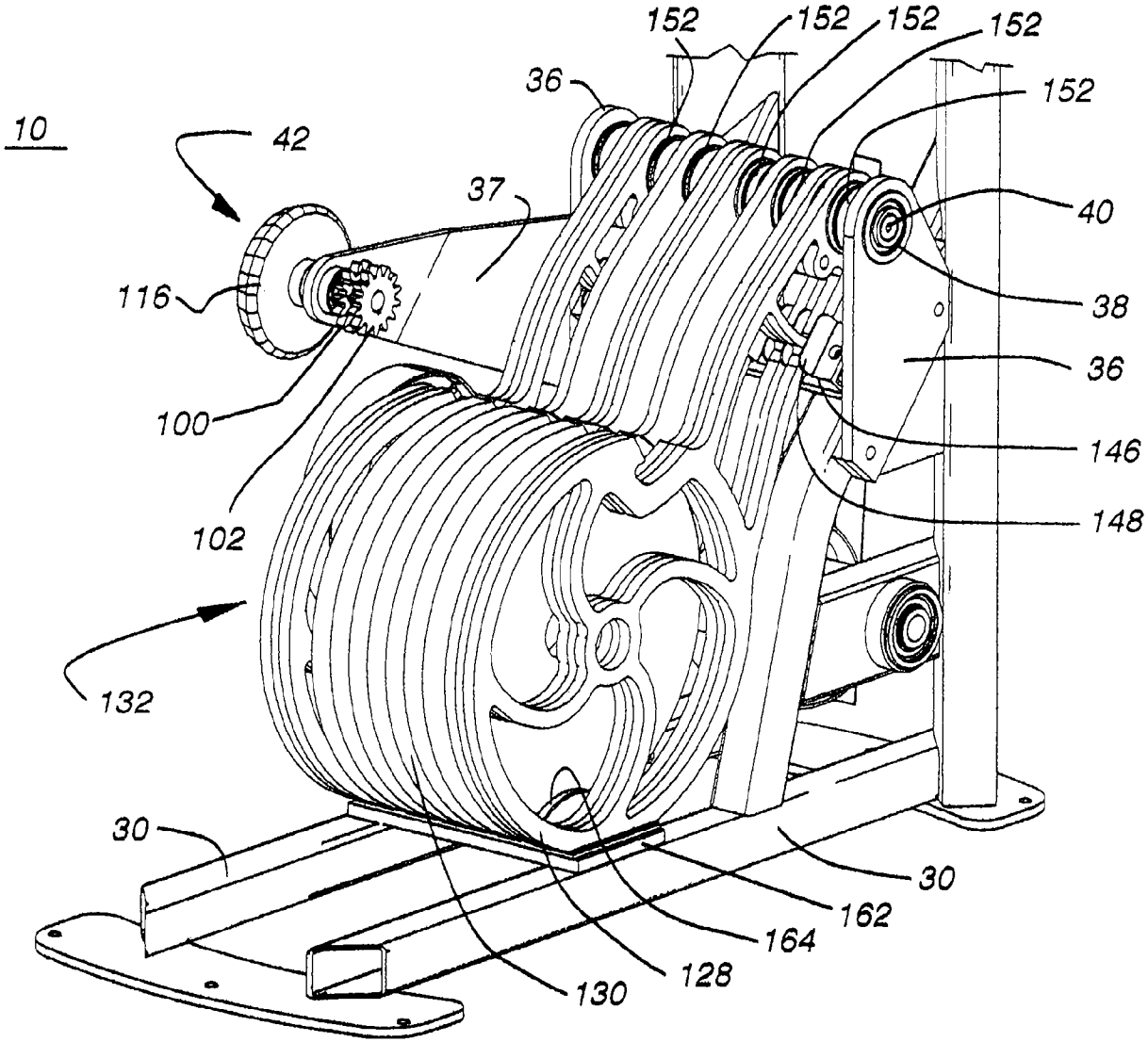
FIG. 18 is the same view depicted in FIG. 16, except the primary weights are shown pivotally mounted to the base frame.
Figure 19:
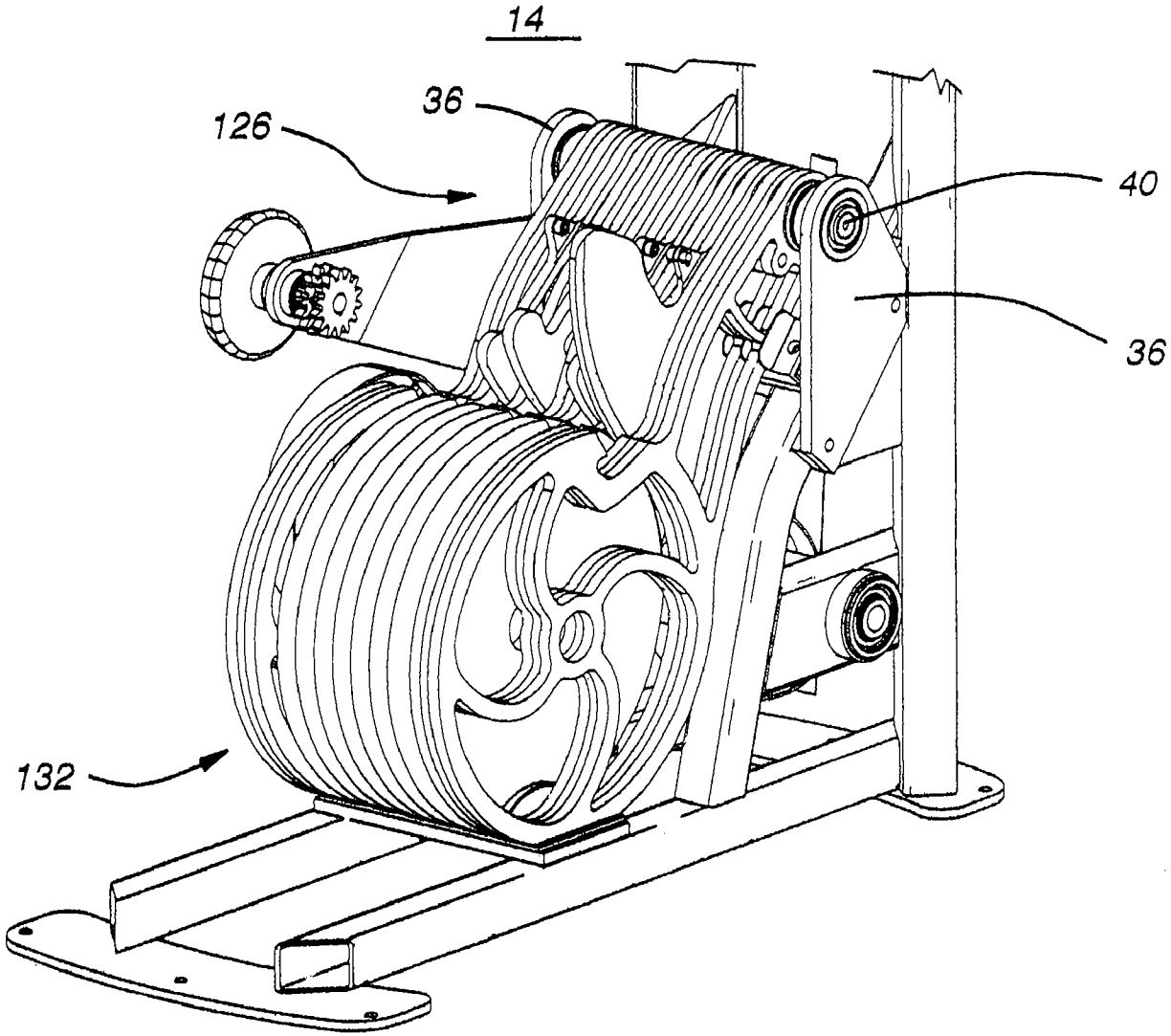
FIG. 19 is the same view depicted in FIG. 16, except both the add-on and primary weights are shown pivotally mounted to the base frame.
Figure 20:
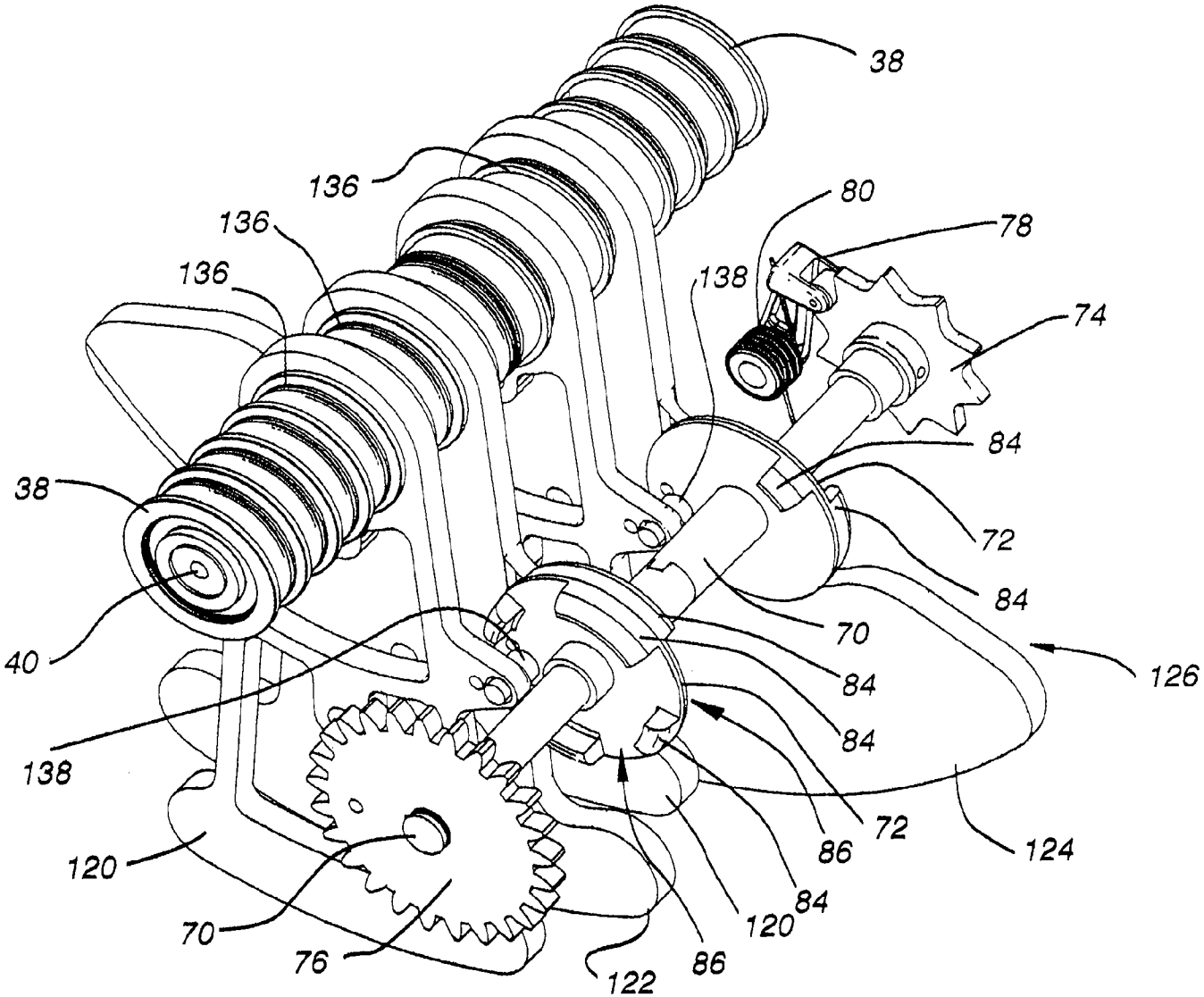
FIG. 20 is an isometric view of the add-on weights being engaged by the discs of the add-on weight engagement axle.
Figure 21:
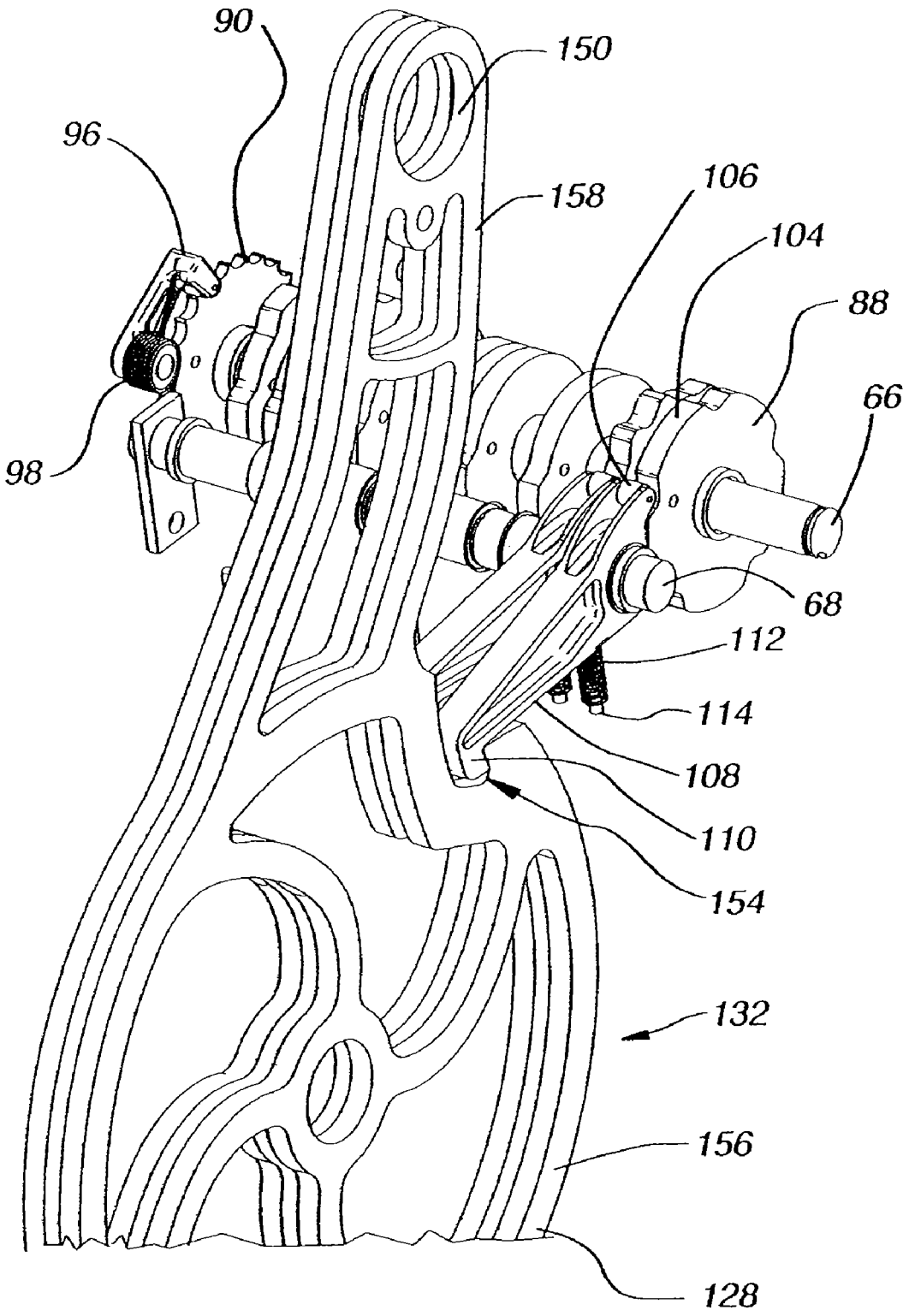
FIG. 21 is an isometric view the primary weights being engaged by the hooks of the hook axle when actuated by a surface of a cam of the primary weight engagement axle.

For an understanding of the configurations of the two types of weights 16, the way they are pivotally coupled to the base frame 14, and the way they are engaged to displace with the weight arm assembly 18, reference is made to FIGS. 11-21. FIGS. 11-13 are side elevations of one-pound 120, two-pound 122 and five-pound 124 add-on weights 126, respectively. FIGS. 14 and 15 are side elevations of ten-pound 128 and fifty-pound 130 primary weights 132, respectively. FIG. 16 is an isometric view of the weight exercise machine 10 as viewed from the front/non-user side and wherein the weight arm assembly 18 and weights 16 have been removed for clarity purposes. FIG. 17 is the same view depicted in FIG. 16, except the add-on weights 126 are shown pivotally mounted to the base frame 14. FIG. 18 is the same view depicted in FIG. 16, except the primary weights 132 are shown pivotally mounted to the base frame 14. FIG. 19 is the same view depicted in FIG. 16, except both the add-on and primary weights 126, 132 are shown pivotally mounted to the base frame 14. FIGS. 20 and 21 are, respectively, isometric views of the add-on weights 126 being engaged by the discs 72 of the add-on weight engagement axle 70 and the primary weights 130 being engaged by the hooks 108 of the hook axle 68 when actuate by the a surface 104 of a cam 88 of the primary weight engagement axle 66.

As shown in FIGS. 11-13, 16, 17 and 20, each add-on weight 120, 122, 124 includes a pivot hole 134 for receiving a bushing/bearing 136 and thereby being pivotally mounted on the axle 40 that extends between the pivot support plates 36 of the base frame 14. Each add-on weight 120, 122, 124 also includes a roller or cam follower 138 that protrudes from a side face 140 of each add-on weight 120, 122, 124 to be engaged by the arcuate rim segment 84 of a weight engagement disc 72, as discussed with respect to FIG. 9 and shown in FIG. 20. It is to be appreciated that the roller or cam follower 138 can have various different configurations, such as a bolt connected with or a boss formed integrally with the add-on weight. Each add-on weight 120, 122, 124 is a plate having generally the same pendulum type configuration with a neck portion 141 and a pendulum portion 142, except the pendulum portion 142 of each add-on weight 120, 122, 124 is smallest on the one-pound add-on weight 120 and largest on the five-pound add-on weight 124. The one-pound add-on weight 120 has two cutout areas 144, and the two-pound add-on weight 122 has a single small cutout area 144. While one, two and five-pound weights 120, 122, 124 are discussed, it should be understood that any size and combination of weights may be employed. For example, in one embodiment, the add-on weights 126 are half-pound, one-pound, two and one-half pound, and five-pound weights.

One of the advantages of the present invention is that a wide variety of plate sizes may be employed in one weight exercise machine 10. Also, the present invention allows plates sizes to be used with the weight exercise machine 10 that are substantially smaller than plate sizes used on weight exercise machines known in the art. As a result, the weight exercise machine 10 of the present invention allows incremental changes in resistive force that are substantially smaller and more greatly adaptable to a user's exercise training regime than the incremental changes in resistive force offered by weight exercise machines known in the art.

As shown in FIG. 16, the base frame 14 includes a cross-member 146 that extends side-to-side between the upper portions of the diagonal members 32. A series of parallel ridges form slots 148, which, as indicated in FIG. 17, receive the add-on weights 126 when not being raised by the weight arm 18.

As shown in FIGS. 14, 15, 18 and 21, each primary weight 128, 130 includes a pivot hole 150 for receiving a bushing/bearing 152 and thereby being pivotally mounted on the axle 40 that extends between the pivot support plates 36 of the base frame 14. Each primary weight 128, 130 also includes a slot 154 that is defined in the outer circumferential edge of a circular plate portion 156 of each primary weight 128, 130 to be engaged by the tip 110 of a hook 108, as discussed with respect to FIG. 10 and depicted in FIG. 21. Each primary weight 128, 130 is a plate having an arm portion 158 radiating away from the outer circumferential edge of the circular plate portion 156. The fifty-pound primary weight 130 is generally the same as the ten-pound primary weight 128, except the fifty-pound primary weight 130 is thicker than the ten-pound primary weight 128, as indicated in FIG. 18, and the ten-pound primary weight 128 has six cut-out areas 160 (two in the arm portion 158 and four in the circular plate portion 156). While one, ten and fifty-pound weights 128, 130 are discussed, it should be understood that any size and combination of weights may be employed. For example, in one embodiment, the primary weights 126 are ten-pound, twenty-five-pound, and fifty-pound weights.

As shown in FIG. 17, the base frame 14 includes a cross-member 162 that extends side-to-side between the middle portions of the horizontal members 30. A series of parallel ridges form slots 164, which, as indicated in FIG. 18, receive the primary weights 132 when not being raised by the weight arm 18. Also, as shown in FIG. 18, the slots 148 formed by the series of ridges on the cross-member 146 receive the primary weights 132 when not being raised by the weight arm 18. When both the add-on and primary weights 126, 132 are not being raised by the weight arm 18, they rest in the slots 148, 164 as indicated in FIG. 19.

For a discussion of the operation of the weight exercise machine 10 of the present invention, reference is made to FIGS. 1-21. A user desiring to exercise on the weight exercise machine 10 of the present invention positions his self in the workstation 12. The user determines that for his first exercise set at the machine 10 the level of resistance will be, for example, 67 pounds. The user dials the primary weight wheel 116 such that it indicates 60 pounds on the primary indicator disc 95. This action, via the gears 92, 100 causes the primary weight engagement axle 66 to rotate and bring the surfaces 104 of the appropriate cams 88 into displacing contact with the cam followers 106 of hooks 108 corresponding to an indexed/selected ten-pound primary weight 128 and an indexed/selected fifty-pound primary weight 130. The displacing contact between the cam surfaces 104 and the cam followers 106 cause the corresponding hooks 108 to pivot about the hook axle 68 such that the tips 110 of the corresponding hooks 108 engage with the slots 154 of the corresponding indexed/selected ten-pound and fifty pound primary weights 128, 130. As a result, the hooks 108 corresponding to the indexed/selected ten and fifty-pound primary weights 128, 130 are coupled to said primary weights 128, 130. Thus, when the weight arm assembly 18 pivots upwardly, as shown in FIGS. 7 and 8, the coupled (i.e., indexed/selected) primary weights 128, 130 pivot upwardly with the weight arm assembly 18 while the remaining non-coupled (i.e., non-indexed/non-selected) primary weights 132 do not pivot upwardly because their slots 154 were not engaged by their corresponding hooks 108.

As the user dials the primary weight wheel 116 to achieve the described engagement, the ratchet arm 96 acts against the index sprocket 90 to assist in proper alignment of the primary weight indexing mechanism and to provide the user with a sensation that indicates when the primary indexing mechanism transitions from one index setting to another.

Upon setting the primary weight indexing mechanism as described, the user dials the add-on weight wheel 118 such that it indicates seven pounds on the add-on weight indicator disc 83. This action, via the gears 102, 94, 82, 76, causes the add-on weight engagement axle 70 to rotate such that the appropriate arcuate rim segments 84 of the discs 72 rotate into position to prevent the cam followers 138 corresponding to an indexed/selected two-pound add-on weight 122 and an indexed/selected five-pound add-on weight 124 from exiting their corresponding discs 72 via a gap 86 defined between the arcuate rim segments 84 of the discs 72. As a result, the discs 72 corresponding to the indexed/selected two and five-pound add-on weights 122, 124 are coupled to said add-on weights 122, 124. Thus, when the weight arm assembly 18 pivots upwardly, as shown in FIGS. 7 and 8, the coupled (i.e., indexed/selected) add-on weights 122, 124 pivot upwardly with the weight arm assembly 18 while the remaining non-coupled (i.e., non-indexed/non-selected) add-on weights 126 do not pivot upwardly because their cam followers 138 pass through the gaps 86 in their corresponding discs 72.

As the user dials the add-on weight wheel 118 to achieve the described engagement, the ratchet arm 78 acts against the index sprocket 74 to assist in proper alignment of the add-on weight indexing mechanism and to provide the user with a sensation that indicates when the add-on indexing mechanism transitions from one index setting to another.

The above-provided example has the primary indexing mechanism being set first and the add-on indexing mechanism being set second. However, it should be understood that the order can be reversed such that the add-on indexing mechanism is set first and the primary indexing mechanism is set second. Also, the indexing mechanisms can be set at the same time if a user uses two hands to manipulate the two index wheels 116, 118.

As can be understood from FIGS. 1, 7 and 8, once the add-on and primary indexing mechanisms are appropriately indexed to provide a weight resistance of 67 pounds, the user performs the positive portion of the first repetition of his first set of the exercise movement by exerting an exercise force against the exercise member 24 to cause the exercise member to displace away from the exercise member pulley 54, which causes the force transfer mechanism 22 to rotate as previously described. The rotation of the force transfer mechanism 22 causes the weight arm assembly 18 to pivot upwardly relative to the base frame 14, as can be understood from FIGS. 7 and 8. As the weight arm assembly 18 pivots upwardly, the coupled (i.e., indexed/selected) weights 16' (shown in phantom lines in FIG. 8) pivot upwardly relative to the base frame 14 with the weight arm assembly 18. However, the non-coupled (i.e., non-indexed/non-selected) weights 16" (shown in phantom lines in FIG. 8) do not pivot upwardly with the weight arm assembly 18. On the negative portion of the first repetition, the user allows the exercise member 24 to displace back towards the exercise member pulley 54, which allows the force transfer mechanism to reverse rotation. The reverse rotation allows the weight arm assembly 18 to return to the downward position, as illustrated in FIG. 7, with the coupled (i.e., indexed/selected) weights 16 (shown in phantom lines in FIG. 7) returning to the downward position to rest with the non-coupled (i.e., non-indexed/non-selected) weights 16.

Once the user has finished the appropriate number of repetitions for the 67 pound set, the user can select/index another combination of weights 16 to provide for an increased or decreased weight resistance for another exercise set on the machine 10.

c. Second Embodiment of the Weight Exercise Machine

Figure 22:
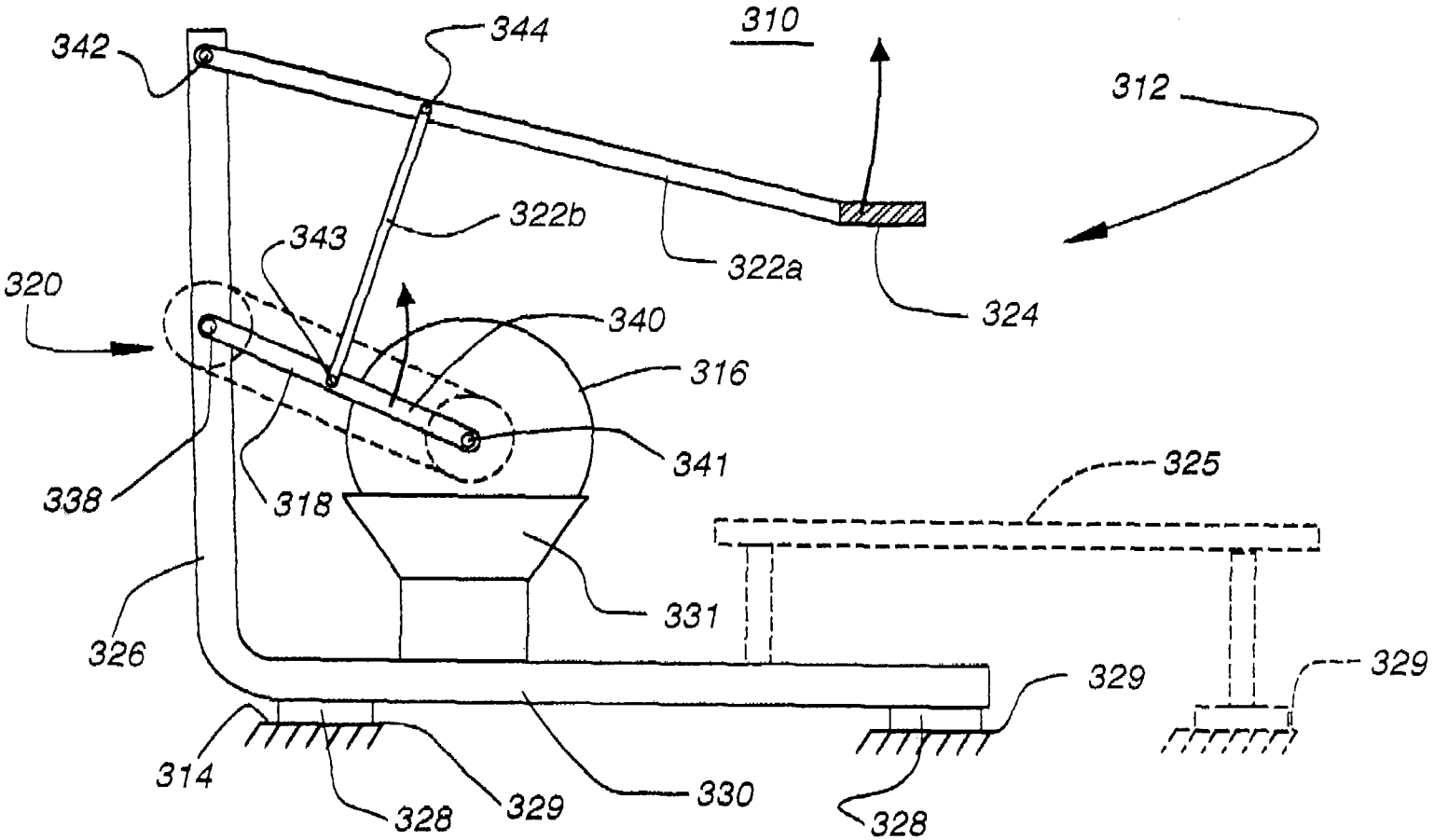
FIG. 22, which is a diagrammatical side elevation of the weight exercise machine.

For a discussion of the second embodiment of the weight exercise machine 310 of the present invention, reference is made to FIG. 22, which is a diagrammatical side elevation of the weight exercise machine 310. As shown in FIG. 22, the weight exercise machine 310 has a workstation 312, a base frame 314, weights 316, a weight arm assembly 318, a weight index mechanism 320, and a force transfer mechanism 322.

The workstation 312 includes an exercise member 324 and a user support platform 325 (e.g., a bench, seat, etc.) for supporting the user when utilizing the machine 310 to exercise. The user engages and displaces the exercise member 324 to exercise with the machine 310. For example, where the machine 310 is an embodiment intended to exercise portions of the upper body (e.g., shoulders, chest, back, arms, traps, etc.), the exercise member 324 will be configured for engagement by the user's hands and/or arms. Where the machine 310 is an embodiment intended to exercise portions of the mid and lower torso (e.g., abdominals, lower back, etc.) the exercise member 324 will be configured for engagement by the user's hands, arms, and/or upper torso. Where the machine 310 is an embodiment intended to exercise portions of the lower body (e.g., upper and lower legs, glutes, etc.), the exercise member 324 will be configured for engagement by the user's legs, feet or shoulders. Where the machine 310 is an embodiment intended to exercise the neck, the exercise member 324 will be configured for engagement with the user's head.

As indicated in FIG. 22, the base frame 314 includes a vertical post 326, front and rear footplates 328, a horizontal member 330, and a weight support tray 331. The bottom end of the vertical post 326 joins the back end of the horizontal member 330. The front and rear foot plates 328 support the horizontal member 330 off of the floor 329. The weight support tray 331 is supported by the horizontal member 330 and receives the weights 316 when not being elevated via the weight arm assembly 318, as discussed later in this Detailed Description.

As illustrated in FIG. 22, the weight arm assembly 318 is pivotally coupled to the vertical post 326 via a pivot point 338 (e.g., axle, shaft, pin, etc.) extending horizontally through the vertical post 326. The weight arm assembly 318 includes a pair of arms 340 and a weight engagement axle or bar 341, which extends between the free ends of the arms 340. The arms 340 extend between the pivot point 338 and the weight engagement bar 341.

In one embodiment, as shown in FIG. 22, the force transfer mechanism 322 includes a pair of lever arms 322*a* and a pair of lift links 322*b*. In one embodiment, the lift links 322*b* are rigid link members, cables, ropes, chain, or etc. The free end of each lever arm 322*a* forms the exercise member 324 and the other end of each lever arm 322*a* is pivotally coupled to the top portion of the vertical post 326 via a pivot point 342 (e.g., axle, shaft, pin, etc.). The lift links 322*b* extend between, and are pivotally coupled to, the mid-portions of the arms 340, 322*a* via pivot points 343, 344 (e.g., axle, shaft, pin, etc.). In other embodiments, the force transfer mechanism is similar to that of the first embodiment of the weight exercise machine 10 described with respect to FIGS. 1-8.

As can be understood from FIG. 22 and as will be discussed more fully later in this Detailed Description, a user may displace one or more of the weights 316 when exercising with the machine 310 by exerting an exercise force upward against the exercise member 324, thereby causing the lever arms 322*a* to displace upwards. Because the lever arms 322*a* are coupled to the weight arm assembly 318, the weight arm assembly 318 displaces upward with any weights 316 that are indexed/selected such that they are coupled to the weight engagement bar 341. The number and type of weights 316 coupled to the engagement bar 341 may be varied via a weight indexing mechanism 320 that is part of the machine 10. As a result, the magnitude of the resistance provided by the weights 316 to the exercise member 324 may be varied via the weight indexing mechanism 320 in a manner similar to that already described with respect to the first embodiment of the weight exercise machine 10 discussed in reference to FIGS. 1-21.

Generally speaking, the weight indexing mechanism 320 of the second embodiment of the weight machine 310 depicted in FIG. 22 and the following figures is similar to that disclosed in U.S. patent application Ser. No. 10/456,977, which was filed Jun. 5, 2003, published as U.S. Publication No. US 2004/0005968A1, and entitled "Adjustable Dumbbell System." Also, the weight indexing mechanism of the second embodiment of the weight machine 310 depicted in FIG. 22 and the following figures is similar to that disclosed in U.S. patent application Ser. No. 10/127,049, which was filed Apr. 18, 2002, published as U.S. Publication No. US 2003/0199368A1, and entitled "Weight Selection Methods and Apparatus." Both the Ser. Nos. 10/456,977 and 10/127,049 applications are hereby incorporated herein by reference in their entirety as though fully set forth herein.

Figure 23:
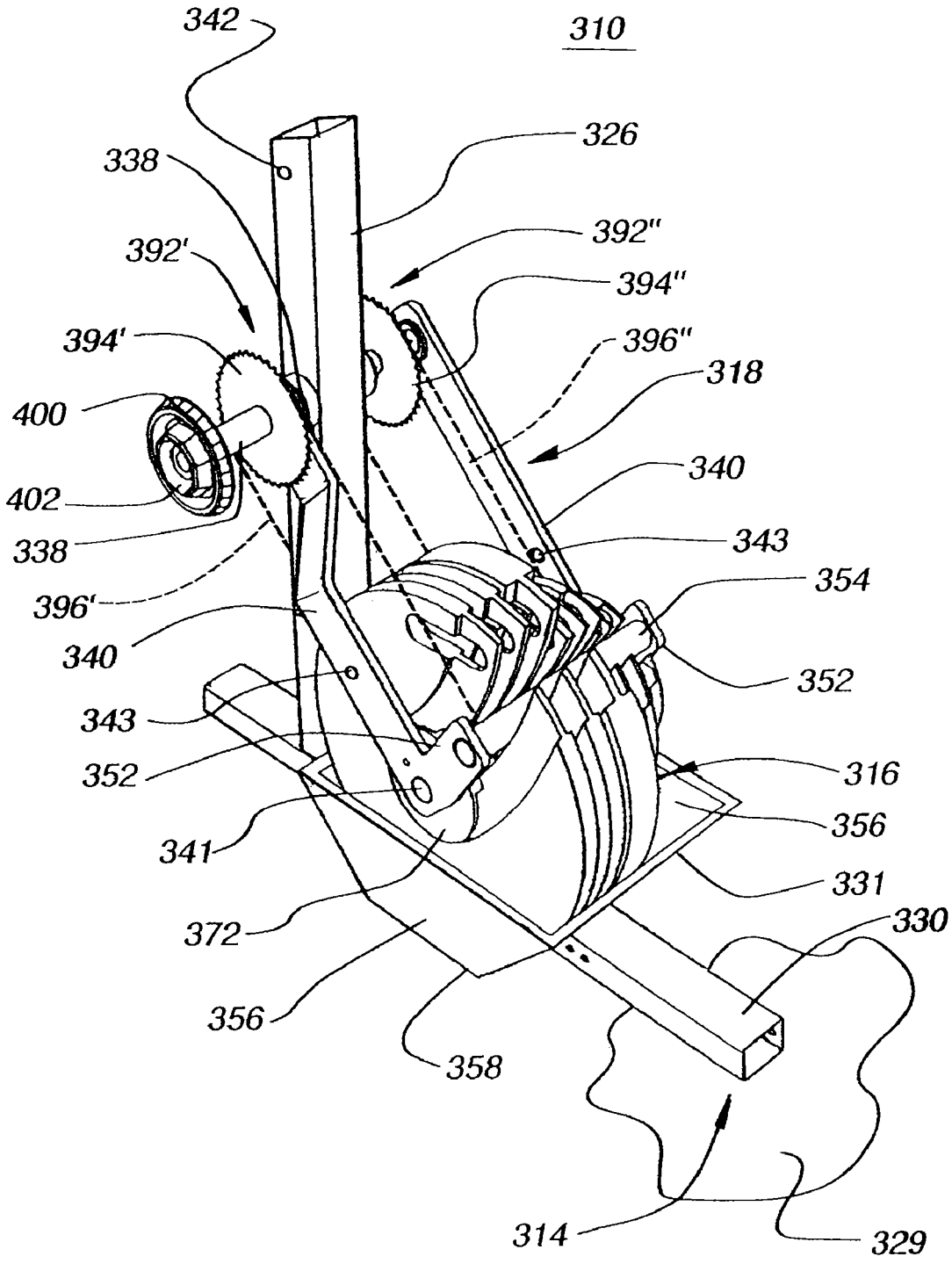
FIG. 23 is an isometric view of the machine illustrated in FIG. 22, except the force transfer mechanism is not shown for clarity purposes.
Figure 24:
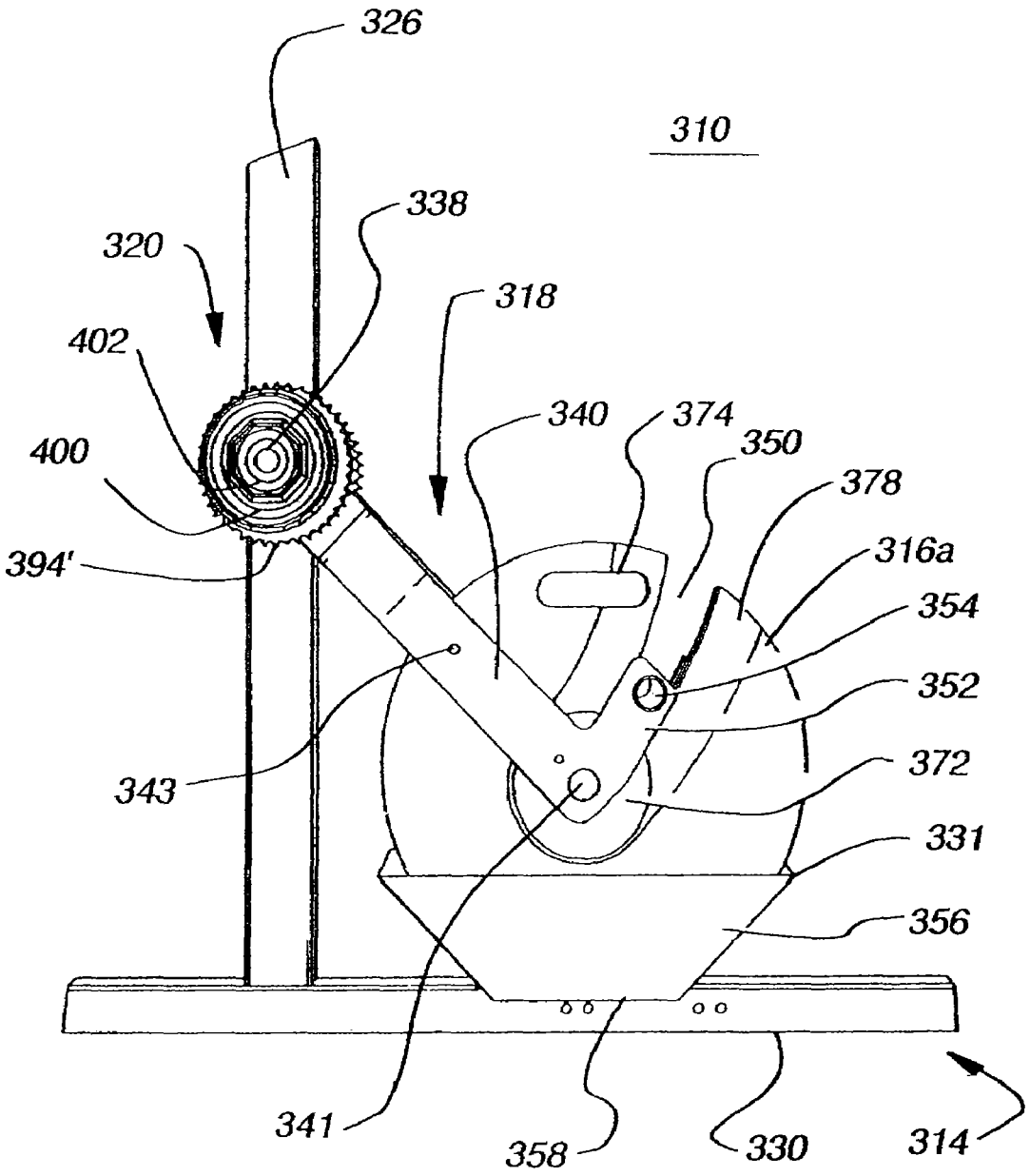
FIG. 24 is a side elevation of the machine as depicted in FIG. 23 and as viewed from the selection wheel side of the machine.
Figure 25:
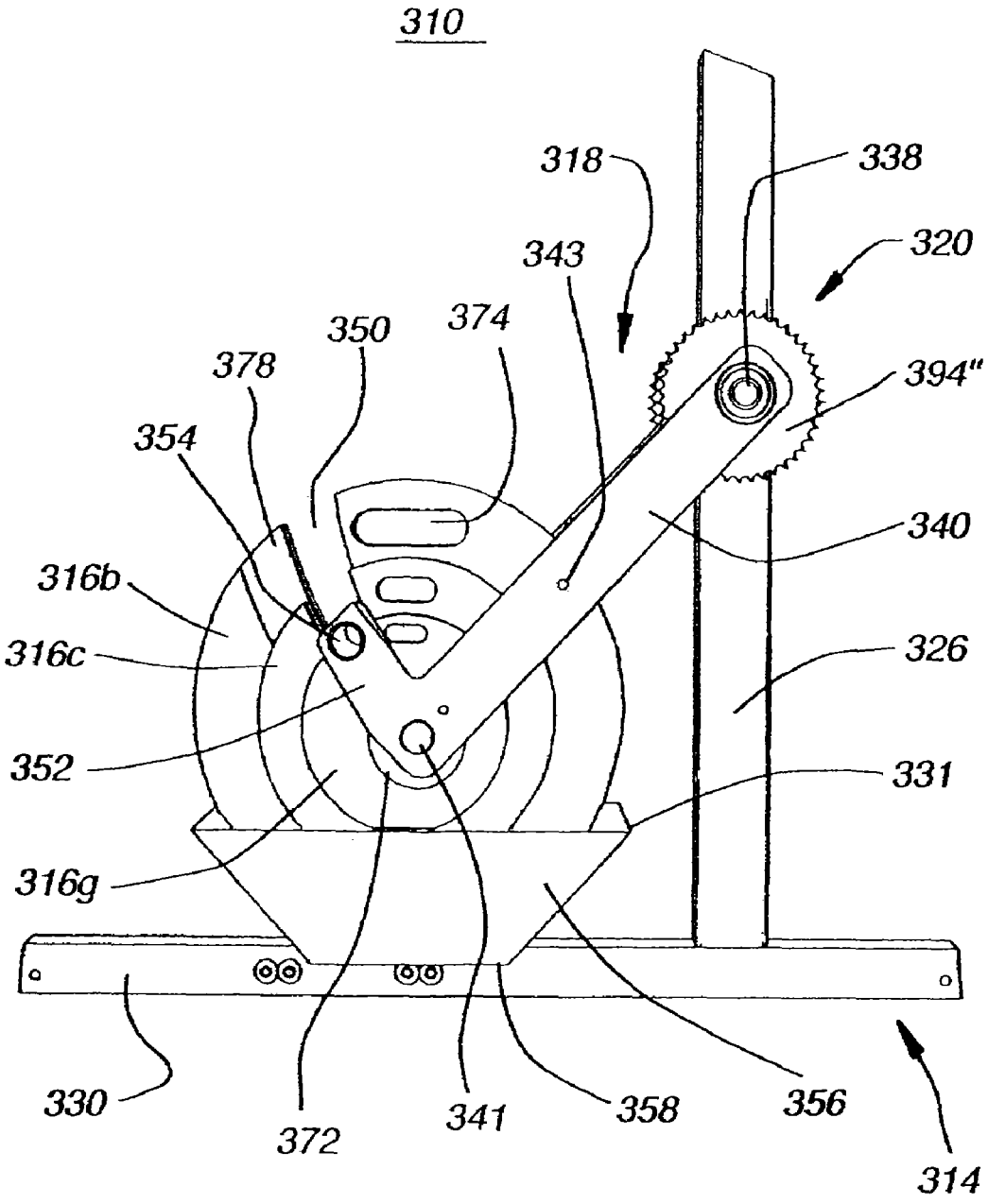
FIG. 25 is a side elevation of the machine as depicted in FIG. 23 and as viewed from the side opposite that of FIG. 24.
Figure 26:
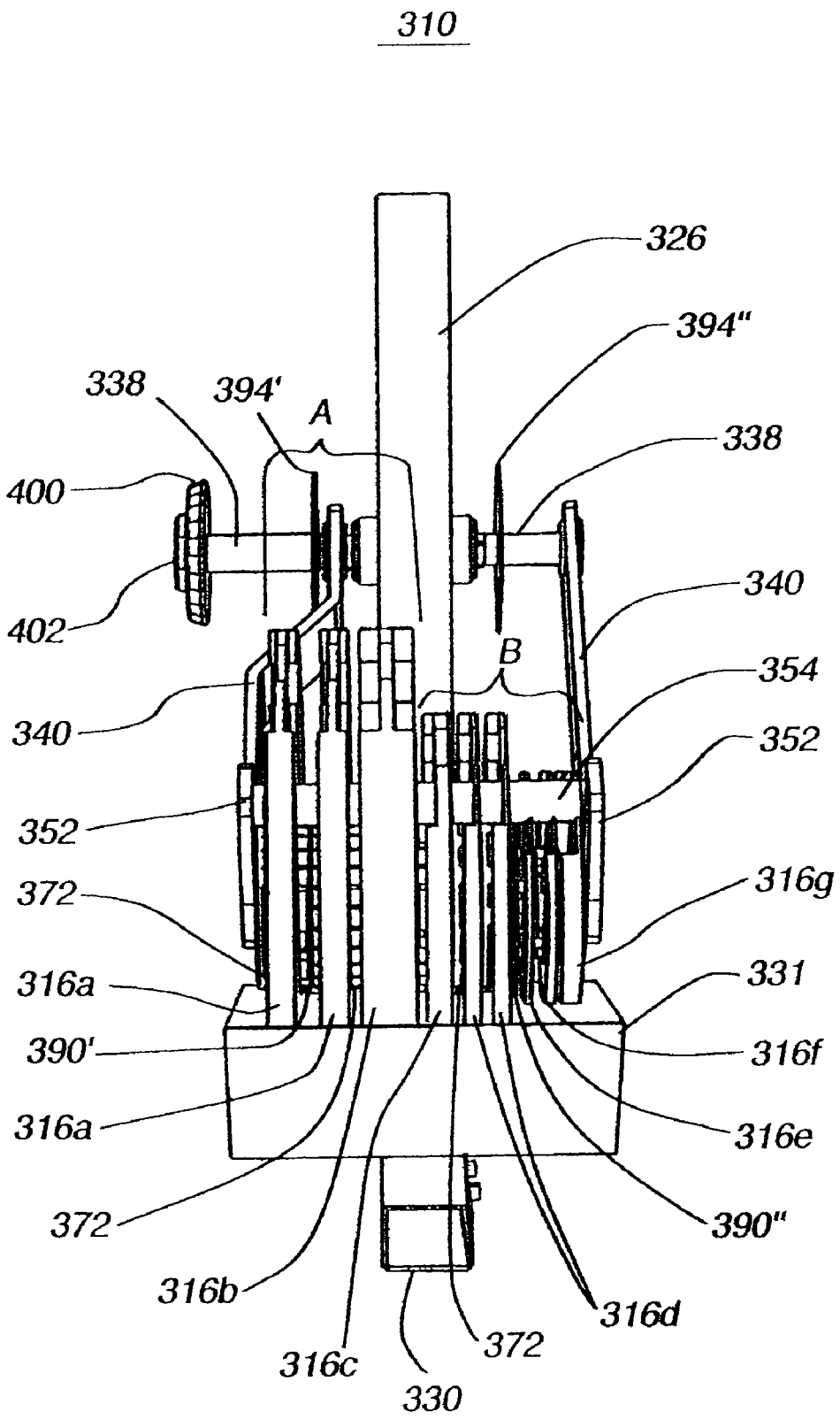
FIG. 26 is a front elevation of the machine as depicted in FIG. 23.
Figure 27:
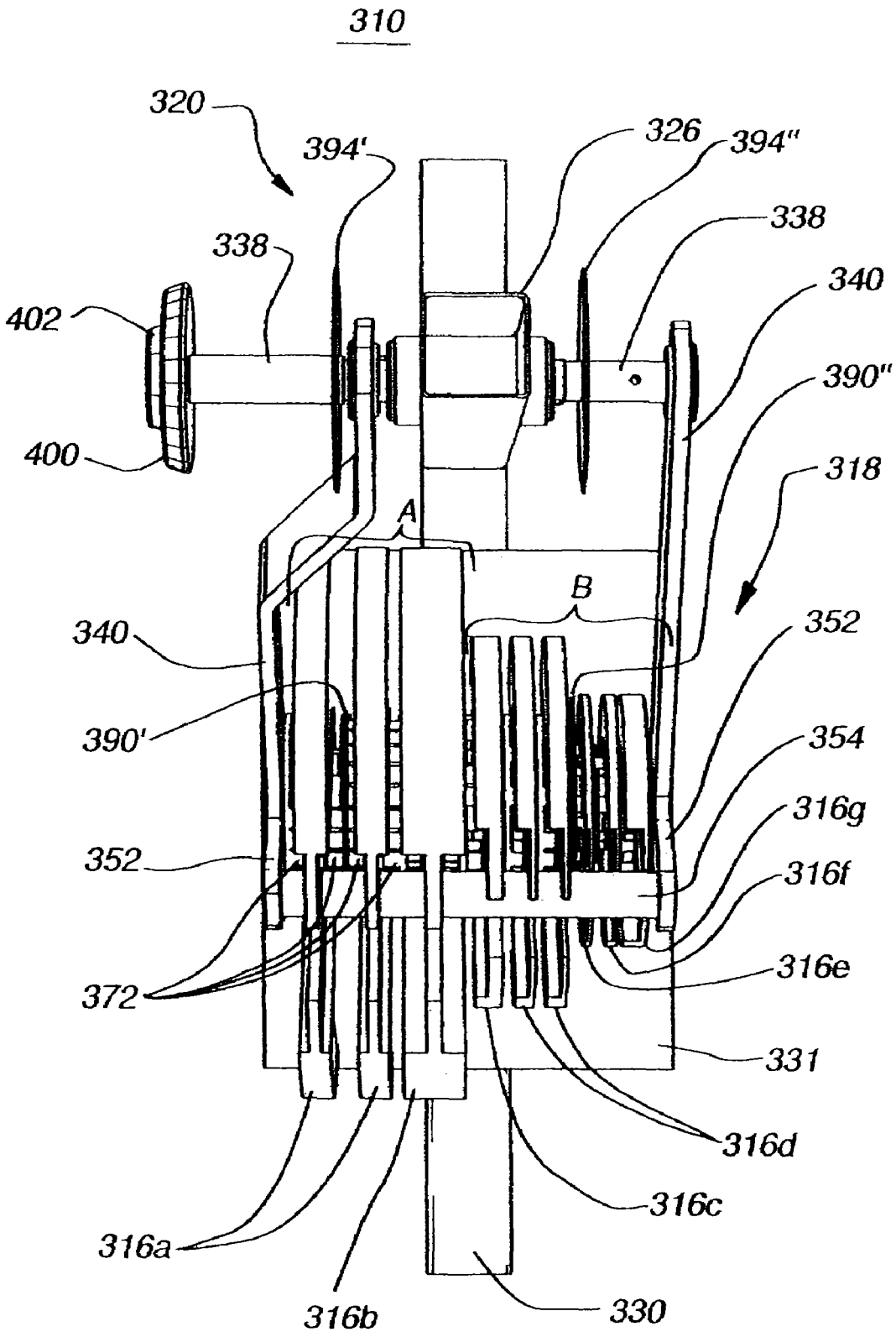
FIG. 27 is a top plan view of the machine as depicted in FIG. 23.
Figure 28:
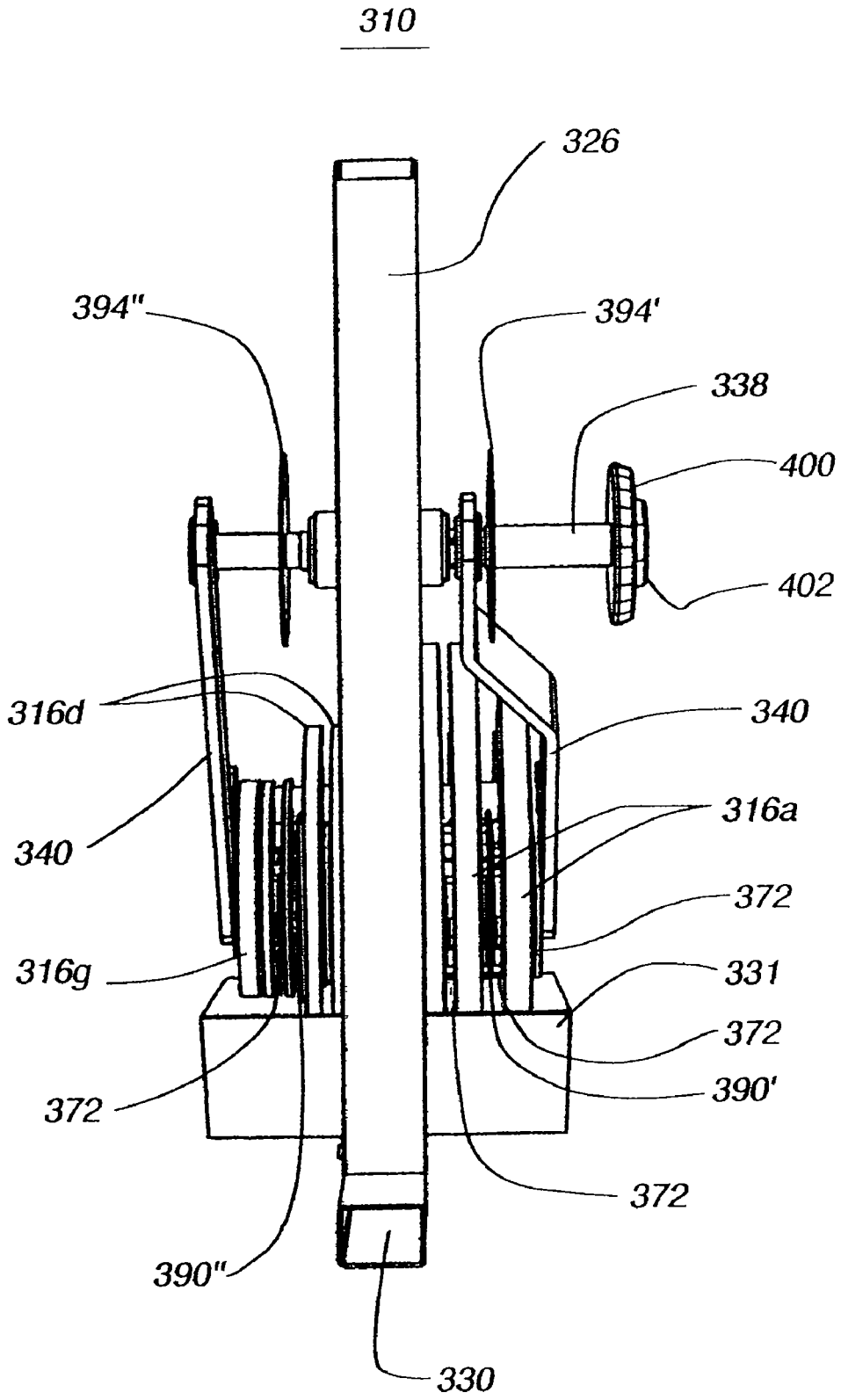
FIG. 28 is a rear elevation of the machine as depicted in FIG. 23.
Figure 29:
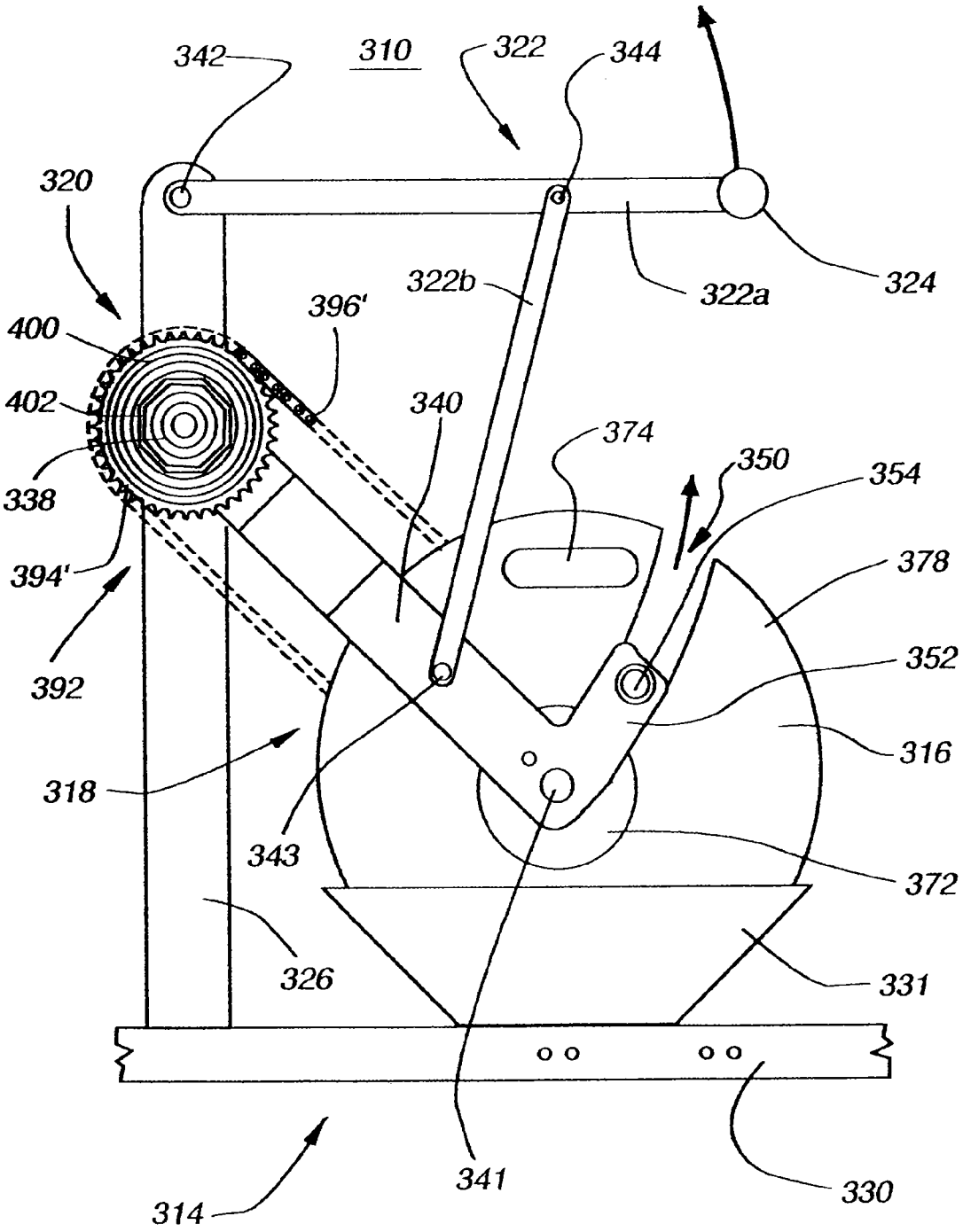
FIG. 29 is side elevation of the machine with the force transfer mechanism shown, wherein the weight arm assembly is in its fully downward position.
Figure 30:
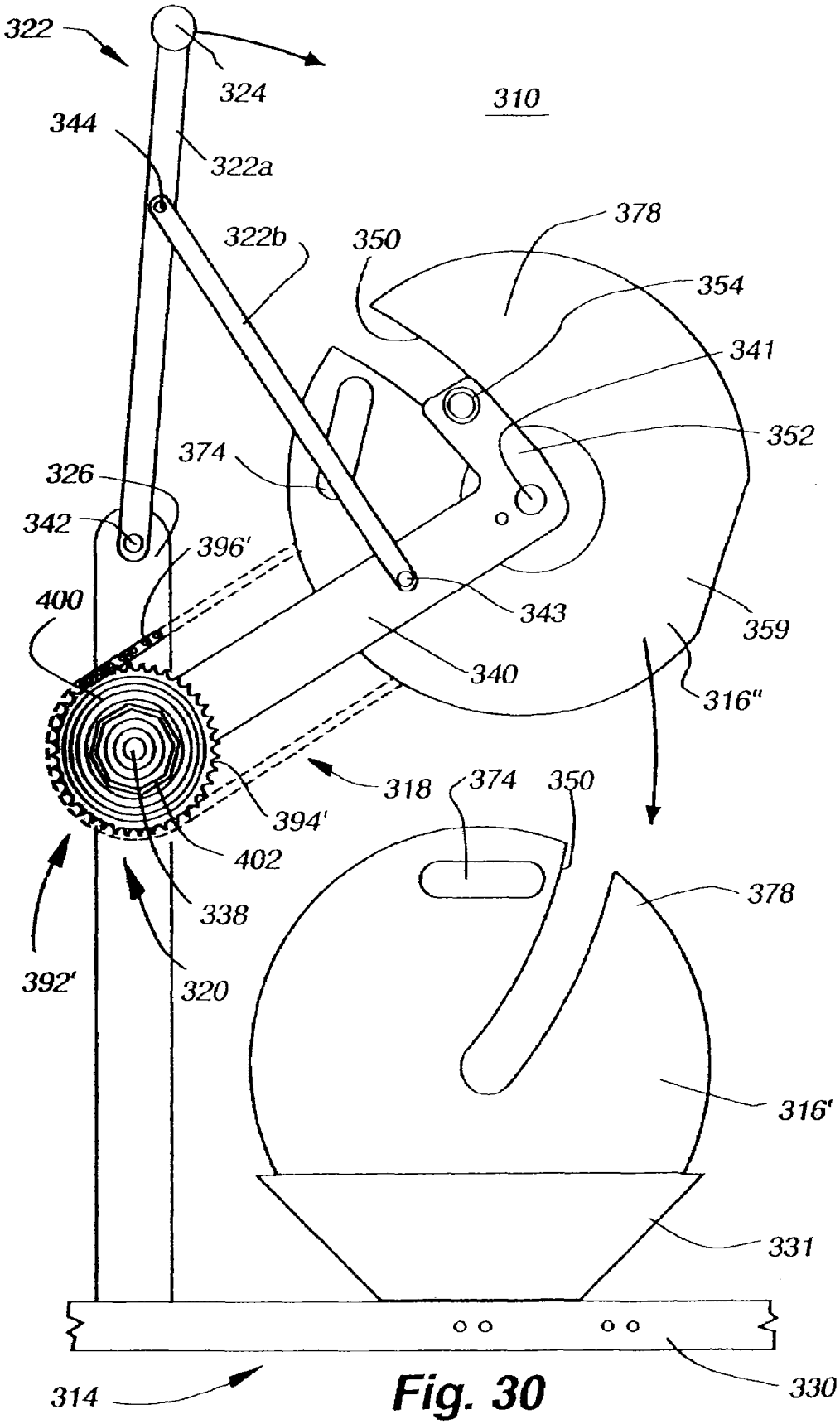
FIG. 30 is side elevation of the machine with the force transfer mechanism shown, wherein the weight arm assembly is in its fully upward position.

For a better understanding of the overall configuration and operation of the weight exercise machine 310, reference is made to FIGS. 23-30. FIG. 23 is an isometric view of the machine 310 illustrated in FIG. 22, except the force transfer mechanism 322 is not shown for clarity purposes. FIG. 24 is a side elevation of the machine 310 as depicted in FIG. 23 and as viewed from the selection wheel side of the machine 310. FIG. 25 is a side elevation of the machine 310 as depicted in FIG. 23 and as viewed from the side opposite that of FIG. 24. FIG. 26 is a front elevation of the machine 310 as depicted in FIG. 23. FIG. 27 is a top plan view of the machine 310 as depicted in FIG. 23. FIG. 28 is a rear elevation of the machine 310 as depicted in FIG. 23. FIG. 29 is side elevation of the machine 310 with the force transfer mechanism 322 shown, wherein the weight arm assembly 318 is in its fully downward position. FIG. 30 is side elevation of the machine 310 with the force transfer mechanism 322 shown, wherein the weight arm assembly 318 is in its fully upward position.

As shown in FIGS. 23-28, the weight exercise machine 310 includes a plurality of weight plates 316 that are selectively and removably mounted on the weight bar 341 extending between the free ends of the two arms 340 of the weight arm assembly 318. The weight selection mechanism 320 allows a variety of weight loads to be selectively attached to the weight bar 341 for lifting by the user. As can be understood from FIGS. 29-30, the weight selection mechanism 320 allows none, all, or some of the weight plates 316 to be attached to the weight bar 341, so that when the weight arms 340 are displaced in the course of a user performing an exercise movement, the weight bar 341 lifts only those selected/indexed weight plates 316 with the weight arms 340.

As indicated in FIG. 26, in one embodiment, the plurality of weight plates 316 will include two fifty-pound plates 316*a*, a single one hundred-pound plate 316*b*, a single twenty five-pound plate 316*c*, two ten-pound plates 316*d*, a single one-pound plate 316*e*, a singe two-pound plate 316*f*, and a single five-pound plate 316*g*. In other embodiments, there will be different plate combinations, plate sizes and numbers of plates.

Figure 31:
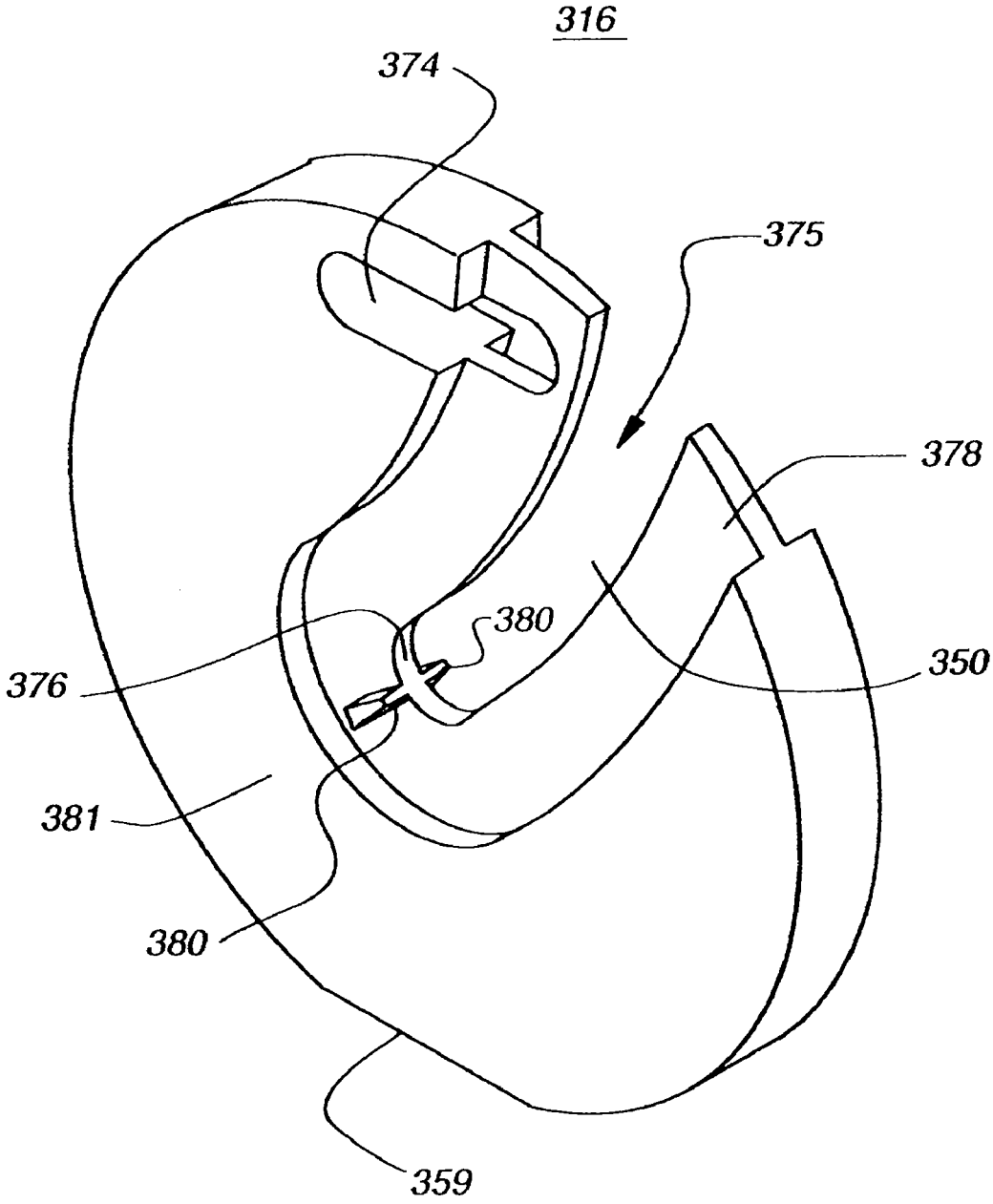
FIG. 31 is an isometric view of a weight plate used with the machine of the present invention.
Figure 32:
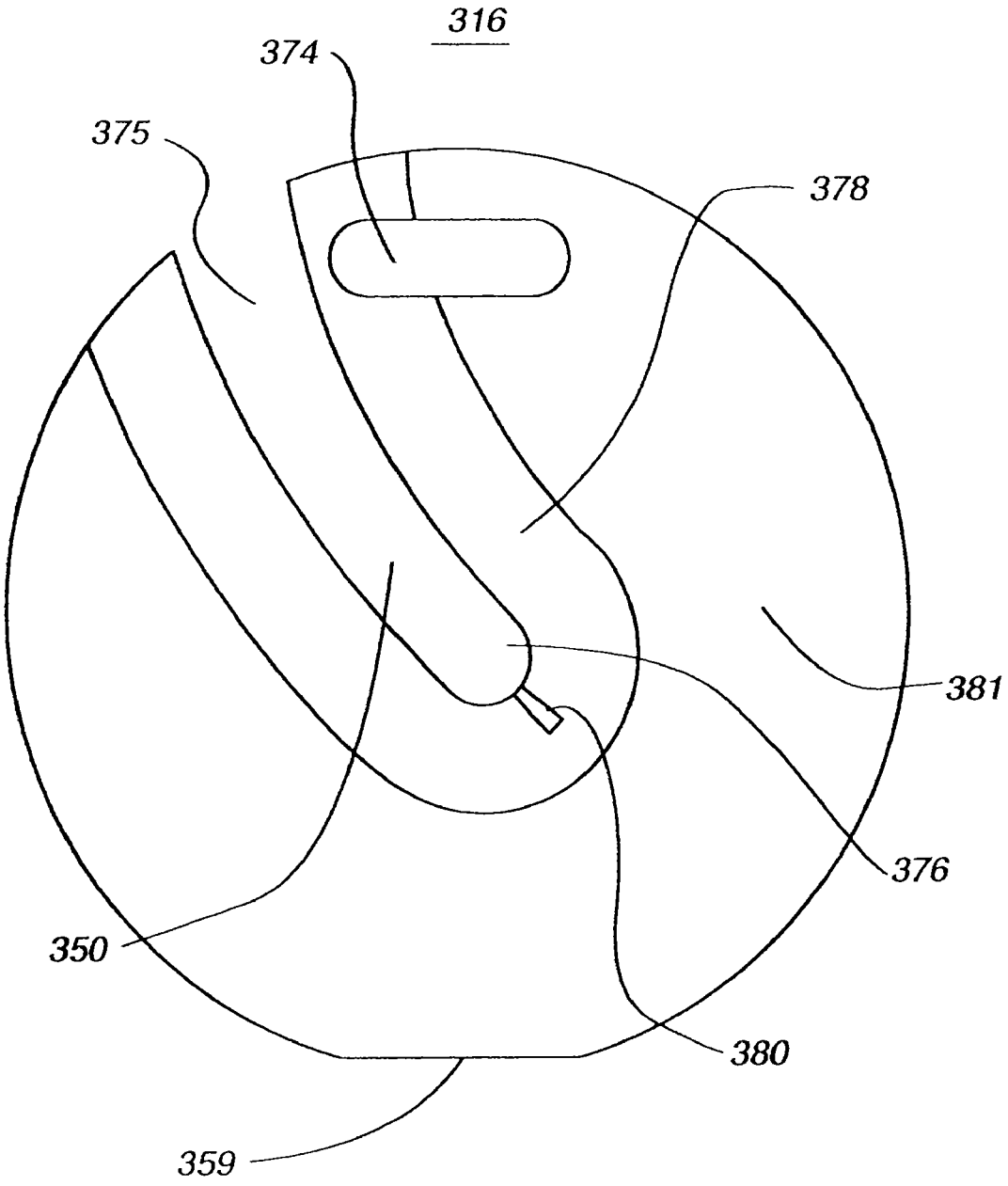
FIG. 32 is a side elevation of a weight plate used with the machine of the present invention.

As illustrated in FIGS. 31 and 32, which are, respectively, an isometric view and a side elevation of a weight plate 316 used with the machine 310 of the present invention, each weight plate 316 has an arcuate slot 350 formed in it from a central location (such as its center) to its peripheral edge. As can be understood from FIGS. 29-30, the arcuate slot 350 allows the weight bar 341 to freely move through its range of motion without engaging a weight plate 316 to which it is not operably attached.

In the embodiment illustrated in FIGS. 23-30, the ends 352 of the weight arms 340 are both curved upwardly with a stabilizing rod 354 positioned therebetween. While not required, the stabilizing rod 354 provides some structural rigidity to the weight arms 340. The slot 350 formed in each weight plate 316 accommodates the free movement of the stabilizing rod 354 within the slot 350 where the weight bar 341 is not attached to the particular weight plate 316.

As indicated in FIGS. 29-30, the tray 331 supports the unselected weight plates 316' in the proper orientation (on edge, without rotating) as the weight arms 340 move up and down with the selected weight plates 316" during use of the machine 310. As shown in FIGS. 23-28, the tray 331 is configured to stably support the weight plates 316 on edge when not being displaced by the weight arm assembly 318. In one embodiment, the tray 331 has a pair of parallel vertical sidewalls 356 and a bottom 358 that has a shape to retain the weight plates 316 in a stable, non-rotating manner. In one embodiment, the bottom 358 is curved or has opposing ramp surfaces (as shown) to engage the periphery of each weight 316. Also, in one embodiment, to maintain each weight 316 in a vertically parallel relationship to its neighbor weights 316 and to the tray sidewalls 356, the tray 331 will include discrete support rods. These rods are spaced apart from each other, run front-to-back within the tray 331, and are parallel to the other supports rods and to the tray sides. The support rods are spaced apart from each other such that a weight 316 can be received in the space defined between each pair of support rods.

In one embodiment, the bottom 358 of the tray 331 is flat. Accordingly, to facilitate the weight plates 316 being stabile when resting within the tray 331, the bottom peripheral edge 359 of each weight plate 316 (i.e., the peripheral edge of each weight plate 316 intended to contact the bottom 358 of the tray 331) is flat for a segment of the periphery of the weight plate 316, as shown in FIGS. 30-32. Thus, each outer peripheral edge is defined by an arcuate segment and a linear or straight segment 359, wherein the arcuate segment comprises the majority of the peripheral length of the weight plate 316 and the linear or straight segment 359 is sufficiently long to provide a straight/linear/flat base for the weight plate 316.

Figure 33:
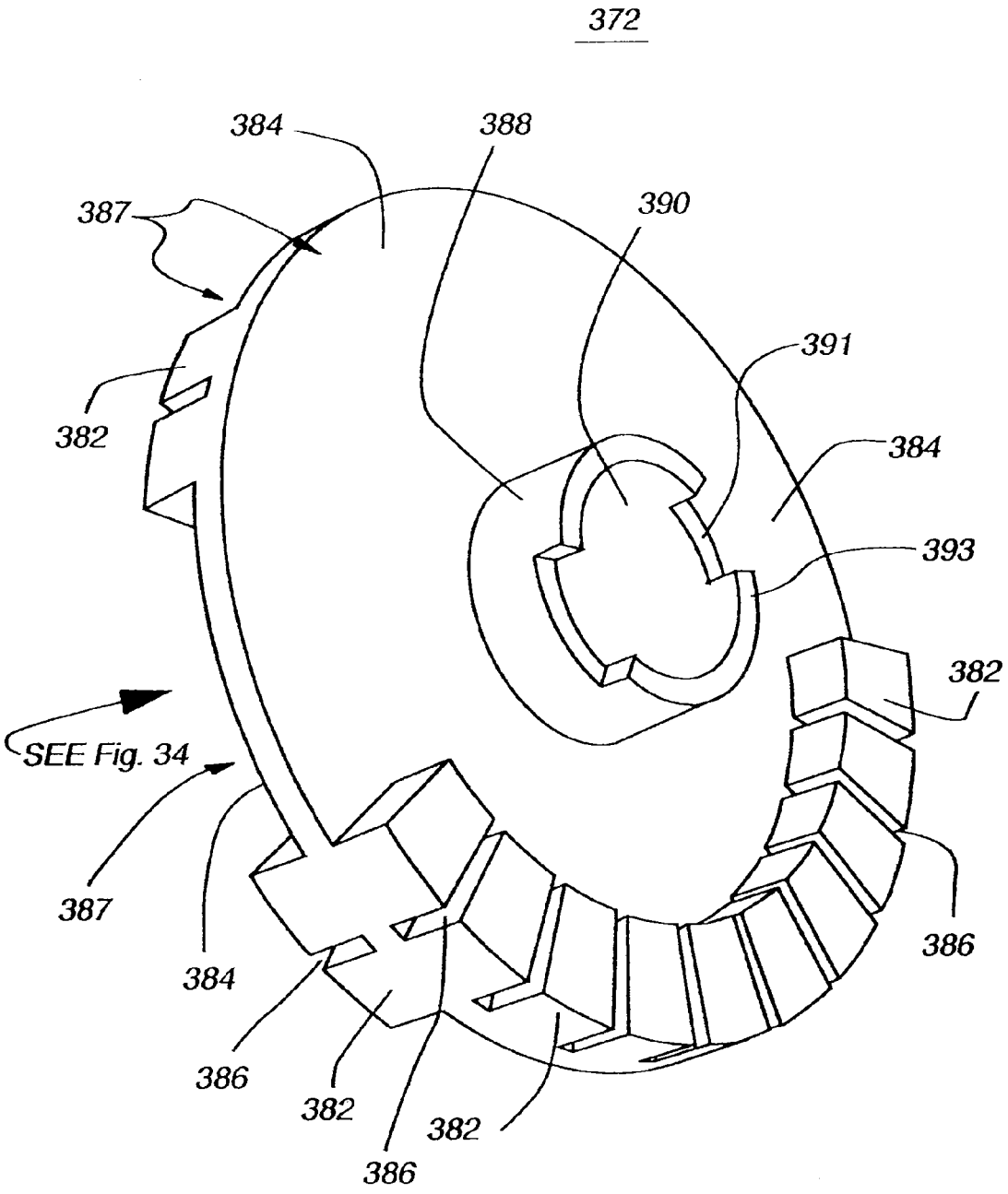
FIG. 33 is an isometric view of a first side of a first weight engagement disk or selection collar.
Figure 34:
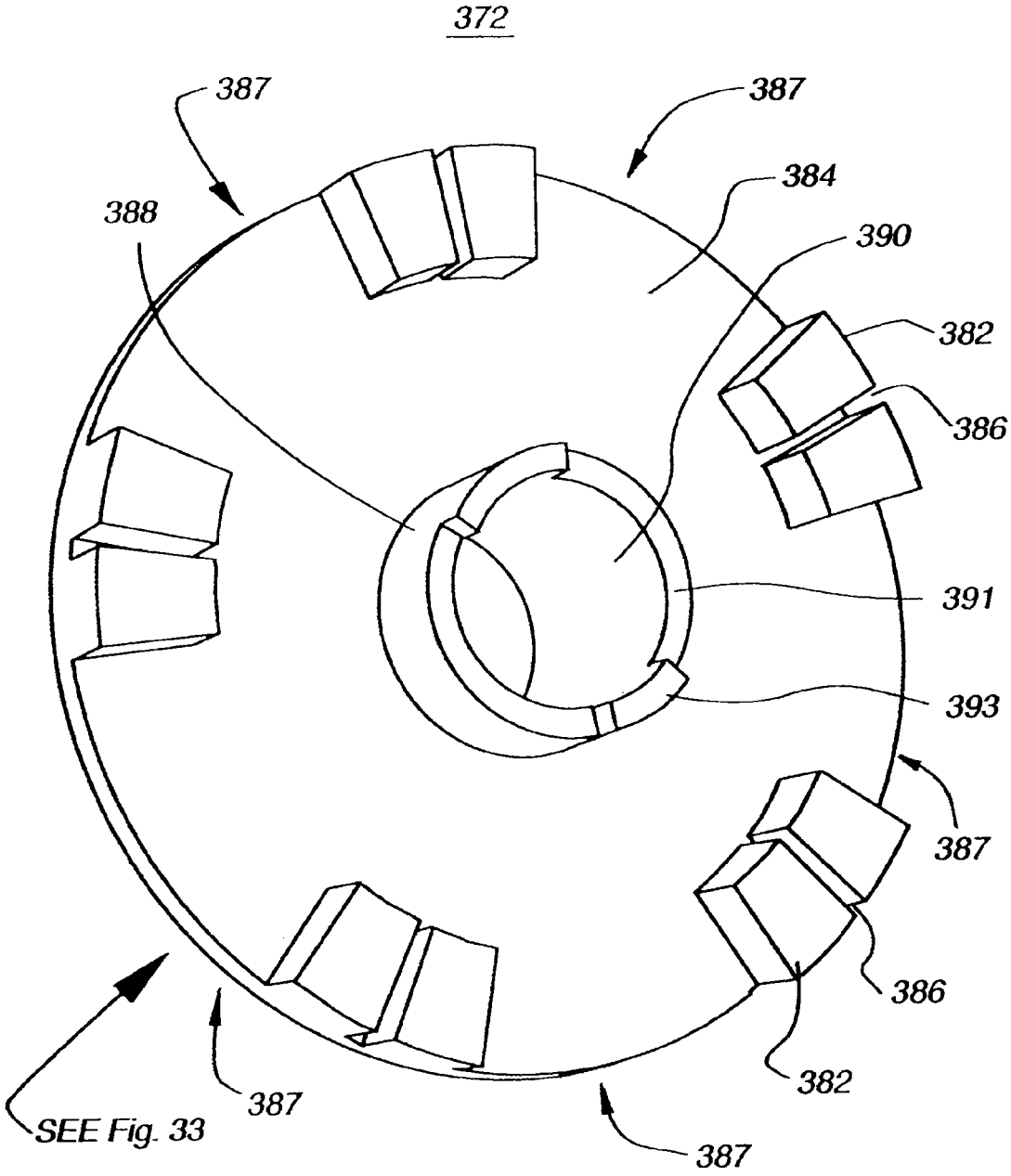
FIG. 34 is an isometric view of a second side of the first weight engagement disk or selection collar.
Figure 35:
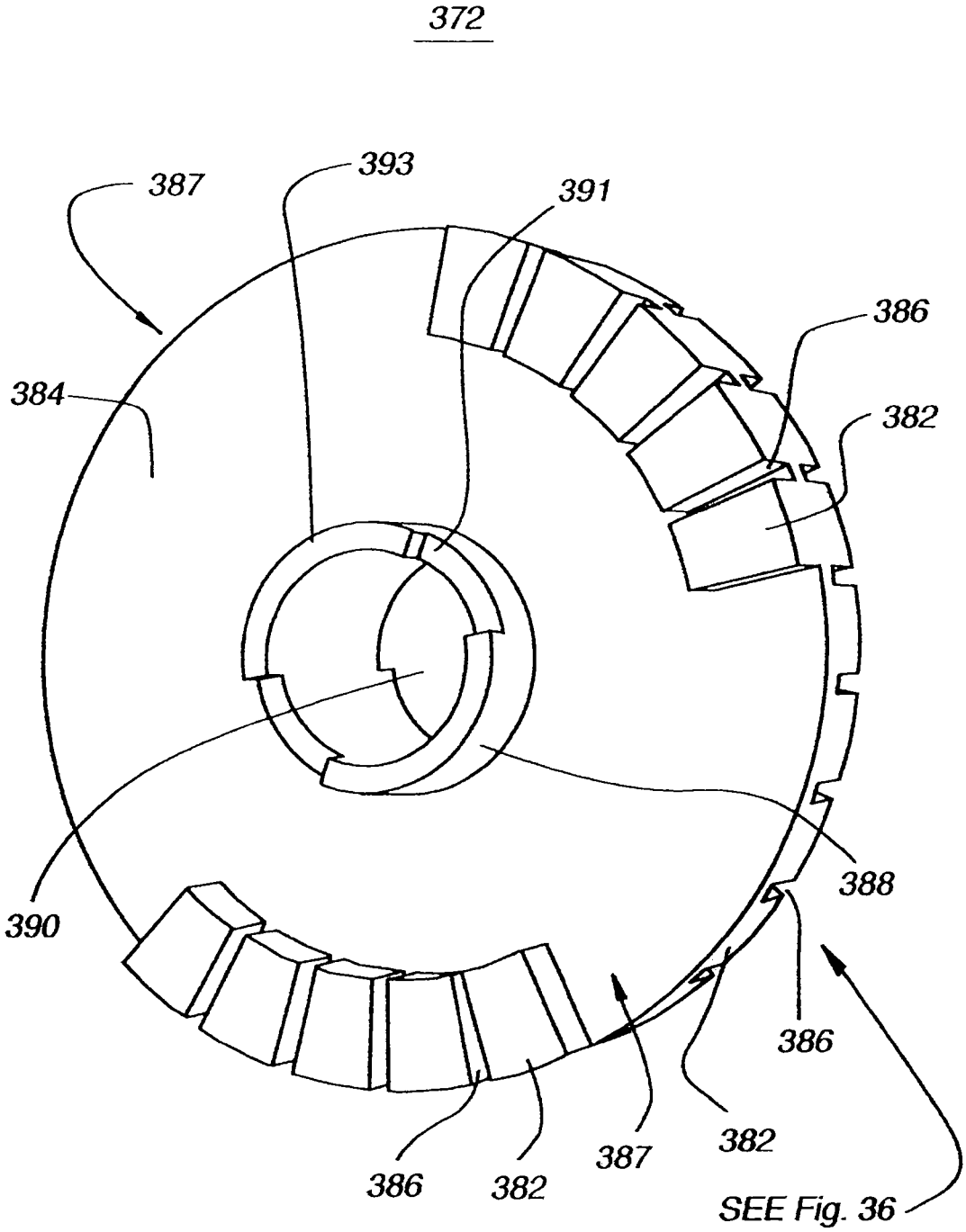
FIG. 35 is an isometric view of a first side of a second weight engagement disc or selection collar.
Figure 36:
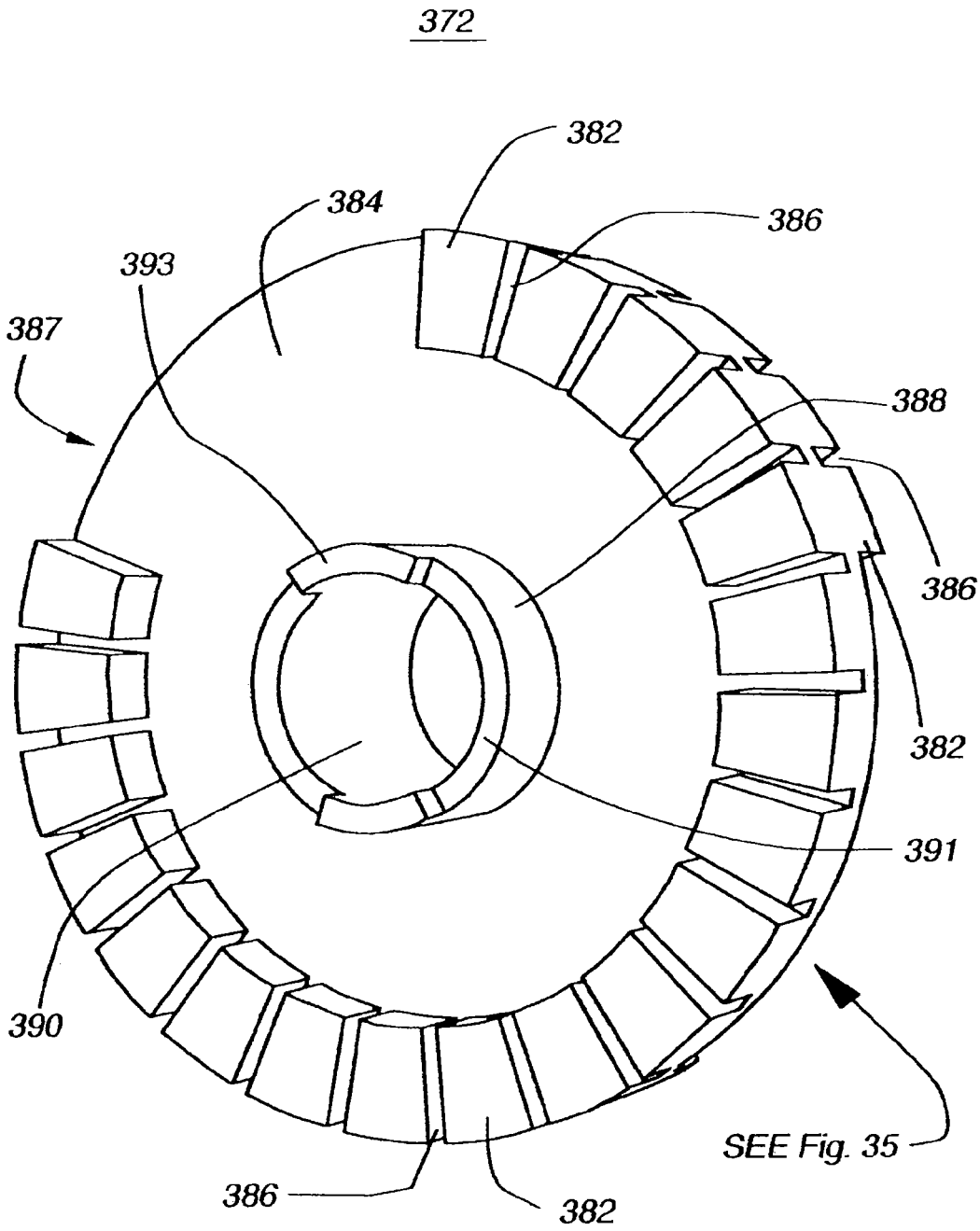
FIG. 36 is an isometric view of the second side of the second weight engagement disc or selection collar.
Figure 37:
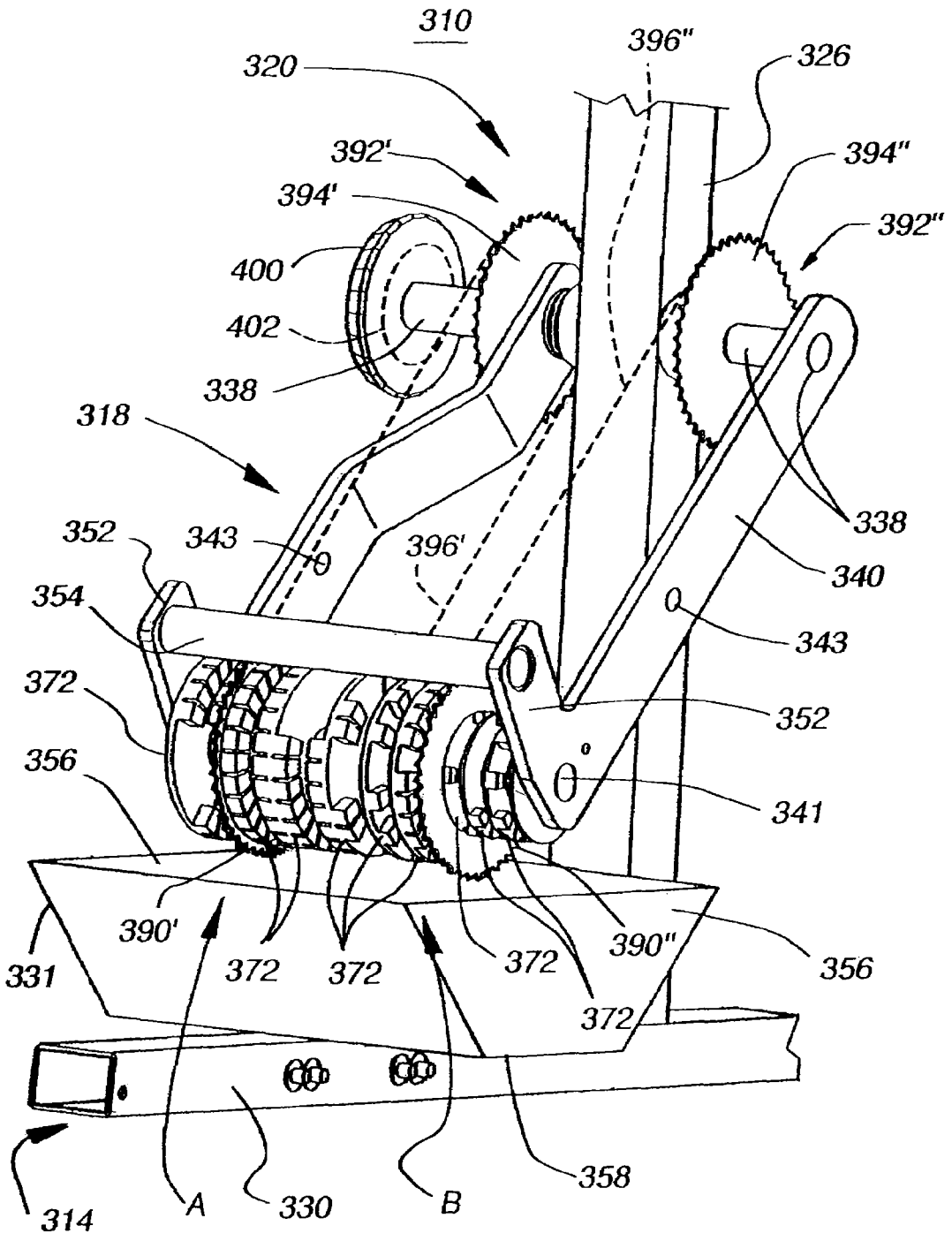
FIG. 37 is an isometric view of the machine, wherein the weight plates and force transfer mechanism are not shown for clarity purposes.

In one embodiment, as previously mentioned in this Detailed Description, the weight plate selection/indexing mechanism 320, which allows a user to select/index a weight plate 316 combination for operable engagement with the weight bar 341, has substantially the same structure and operates in substantially the same way as described in the Ser. Nos. 10/456,977 and 10/127,049 applications incorporated by reference herein. For a discussion regarding an embodiment of the weight index mechanism 320, reference is made to FIGS. 29-37. FIGS. 33 and 34 are isometric views of the two sides of a weight engagement disk or selection collar 372. FIGS. 35 and 36 are isometric views of the two sides of another weight engagement disc or selection collar 372. FIG. 37 is an isometric view of the machine 310, wherein the weight plates 316 and force transfer mechanism 322 are not shown for clarity purposes.

FIGS. 29-30 respectively show the weights plates 316 in the rest position and the lifted position. As illustrated in FIG. 30, the weight bar 341 and stabilizing rod 354 have exited the curved slot 350 in the non-selected weight plates 316'. As shown in FIGS. 23-25 and 29-30, the oval holes 374 at the top of the weight plates 316 are for lifting each weight plate 316 by hand if needed to set in the tray 331.

As indicated in FIGS. 31-32, the curved slot 350 is shown extending from the center axis of the weight plate 316 to an outer periphery end 375 of the slot 350 at the outer periphery of the plate 316. The non-periphery or terminal end 376 of the slot 350 need not be in the center of the weight plate 316. A channel 378 is formed around the slot 350 on either side of the plate 316. The channel 378 defines a thin cross-section of the weight plate 316 adjacent the edges of the slot 350. At the base or terminal end 376 of the slot 350, a tab 380 perpendicularly extends from each planar surface of the channel 378 such that the distance between the tips of the tabs 380 is generally equivalent to the overall thickness of each plate 316 (i.e., the distance between the planar faces 381 of each plate 316). In one embodiment, the tabs 380 are in symmetrical locations on either side of the plate 316 at the base 376 of each slot 350. In one embodiment, a plate 316 will have a single tab 380 that extends from a single groove side of the plate 316. In one embodiment, as shown in FIG. 31, a plate 316 will have a tab or nub 380 that extends from each groove side of the plate 316.

As can be understood from FIGS. 23-37, each selection collar 372 is rotatably mounted on the weight bar 341 and spaced apart from its fellow adjacent collars 372. This collar arrangement allows a weight plate 316 to be received between each pair of collars 372. As the weight arm assembly displaces between the downward position (FIG. 29) and the upward position (FIG. 30), each selection collar 372 passes along the slots 350 of the adjacent weight plate(s). In other words, each slot 350 has a selection collar 372 that passes along the slot's length as the weight arm assembly 318 displaces between the downward and upward positions.

As shown in FIGS. 33-37, one or more protrusions or bosses 382 perpendicularly extend from the planar side surfaces 384 of each disc or collar 372 near the outer circumferential edge of each disc or collar 372. In one embodiment, each boss 382 includes a slot 386 radially extending through the boss 382. Each collar 372 includes annular extensions 388 that perpendicularly extend from the planar side surfaces 384 about a weight bar receiving hole 390 that passes though the center of the collar 372. Each collar 372 is rotationally mounted on the weight bar 341 via the collar's weight bar receiving hole 390. Each annular extension 388 includes a key cutout 391 (see FIGS. 33 and 35) and a key tab 393 (see FIGS. 34 and 36). The key tab 393 of a collar 372 engages with the key cutout 391 of the immediately adjacent collar 372, thereby coupling the plurality of collars 372 in a non-rotational relationship relative to each other. As a result, the plurality of collars 372 are rotatable about the weight bar 341 as an integral unit. As illustrated in FIGS. 26-28, the collars 372 are rotatably mounted on the weight bar 341 and spaced apart to be received between adjacent weight plates 316 supported by the weight tray 331.

As can be understood from FIGS. 23-37, the collars 372 via their respective bosses 382 engage with the tabs 380 of the selected/indexed weight plates 316 in a manner similar to the engagement between the arcuate rim surfaces 84 of the discs 82 and the cam followers 138 of the selected/indexed add-on weights 126 of the first embodiment of the present invention as discussed with respect to FIGS. 9 and 20. When the weight arm assembly 318 is in the downward position (see FIG. 29), the weight index mechanism 320 is actuated to rotate the collars 372 about the weight bar 341 to select/index the combination of weight plates 316 that results in the desired magnitude of weight resistance desired for the weight exercise movement to be performed with the machine 310. Selected/indexed weight plates 316" are coupled to the weight bar 341 when the bosses 382 of the corresponding collars 372 are rotated such that the bosses 382 abut against the tabs 380 of the selected/indexed weight plates 316" when the weight arm assembly 318 is displaced upward from the downward position. In other words, the bosses 382 prevent the tab 380 of a selected/indexed weight plate 316" from passing outside the outer circumference of the collar 372 when the collar 372 is displaced upward when the weight arm assembly 318 is displace upward. As a result, the tabs 380 and their weight plates 316 are moved upward by the upward moving collars 372 when the weight arm assembly 316 is displaced upwards by a user performing an exercise movement with the machine 310. In one embodiment, the tabs 380 of a selected/index weight plate 316" mate with the slots 386 of the corresponding collars 372 to provide a more positive engagement between the tabs 380 and collars 372.

As can be understood from FIGS. 23-37, the tabs 380 of the non-selected/non-indexed weight plates 316' do not engage with the bosses 382 of the corresponding collars 372 because the tabs 380 align with a portion of the collar 372 that does not have bosses 382 along the outer circumferential edge of the collar 372. As a result, when the collars 372 displace upwards via the upward displacing weight bar 341, the tabs 380 of the non-selected/non-indexed collar 372 pass outside the outer circumference of the collars 372. Specifically, gaps or spaces 387 defined by the lack of bosses 382 along segments of the outer circumference of the collars 372 provide paths for the tabs 380 of the non-selected/non-indexed weight plates 316'. As a result, the non-selected/non-index weight plates 316 remain in the tray 331 as the weight arm assembly 318 is displaced upwardly by a user performing an exercise movement with the machine 310.

As previously mentioned, each weight channel 378 receives a selection collar 372 mounted around the weight bar 341. As indicated in FIGS. 29 and 30, when a weight plate 316 is not selected, the weight channel 378 allows space for the collar 372 to pass freely out of and into the channel 378 as the collar 372 passes between adjacent weight plates 316 while the weight bar 341 and stabilizing rod 354 pass out of and into the slots 350 of the weight plate 316. In one embodiment, each slot 350 of a weight plate 316 will generally widen as the slot 350 extends from its base 376 to its outer periphery end 375, thereby facilitating the free passage of the weight bar 341 and/or stabilizing rod 350. Similarly, in one embodiment, the channel 378 will have a widening dimension from its inner or base end to its outer end at the periphery of the weight plate 316, thereby facilitating the free passage of the selector collar 372 out of and into the channel 378 of the weight plate 316.

As previously mentioned, FIGS. 33-36 show both sides of two individual collars 372 having different arrangements of bosses 382 around the periphery of the collar or disk 372. The bosses 382 are positioned peripherally in selected positions so that when the collar 372 is rotated to a position intended to select/index the tab 380 of the corresponding selected/indexed weight plate 316, at least one boss 382 engages the tab 380 on the weight plate 316 to operably engage the weight plate 316 with the weight bar 341. The boss 382 engages the tab 380 and lifts the weight plate 316 with the weight bar 341 when a boss 382 is positioned under a tab 380 by the user. For non-selected/non-indexed weight plates 316, no bosses 382 engage the tab 380 of the non-selected/non-indexed weight plates 316 because the corresponding collars 372 are rotated to an unengaged position where no boss 382 is brought into engaging alignment with the tab 380 of the non-selected/non-indexed weight plates 316. As a result, the non-selected/non-engaged weights 316 do not move with the weight bar 341.

Where a weight plates 316 is equipped with tabs 380 extending from both planar sides of the weight plate 316, collars 372 on either side of the weight plate 316 may engage said weight plate 316 via its tabs 380. Where a collar 372 has bosses 382 on either side of the collar periphery, said collar 372 may engage weight plates 316 on both sides or either side of the collar 372. The bosses 382 are positioned around the periphery in a "clocked" manner to selectively engage or not engage the tabs 380 of the corresponding weight plates 316 as needed to provide the weight resistance selected by the user via the weight index mechanism 320 for the exercise to be performed on the machine 310. One embodiment of the boss/collar configuration is described in more detail in the applications incorporated by reference herein, as noted above.

As can be understood from FIG. 37, the weight plates 316 are typically positioned between each collar 372. The collars 372 rotate with respect to the weight rod 341. In one embodiment, where two groups or collections of weights 316 are provided on the weight bar 341, a pair of selection/index gears 390 is rotatably mounted on the weight bar 341. In another embodiment, where only one group or collection of weights 316 is provided on the weight bar 341, only one selection/index gear 390 is rotatably mounted on the weight rod 341.

Where two weight groups and two selection/index gears 390 are provided, the left side collars A are interlocked to rotate as one unit (using the structure noted above) with the left selection/index gear 390', and the right side collars B are interlocked to rotate as one unit (using the structure noted above) with the right selection/index gear 390". Rotation of the left selection/index gear 390' causes the left side collar group A to rotate about the weight bar 341. Similarly, rotation of the right selection/index gear 390" causes the right side collar group B to rotate about the weight bar 341.

As previously mentioned, the weight plates 316 are positioned between the weight collars 372 with the weight collars 372 positioned in the channels 378 between adjacent weight plates 316. As illustrated in FIGS. 23-30, in one embodiment, the collars 372 form the extreme end of each weight/collar group such that the end collars 372 do not have a weight plate 316 adjacent to the collar's outside planar surface.

Where the machine 310 has two collar groups A, B, a first set of weights 316 corresponding to a first collar group A can be selected independently of a second set of weights 316 corresponding to a second collar group B. Such a dual collar group configuration is convenient, for example, where the first collar group A (i.e. the left side in FIG. 37) is configured to allow adjustment from 50 to 200 pounds by 50 pound increments, and the second collar group B (i.e. the right side in FIG. 37) is configured to allow adjustment from one pound to 53 pounds in two pound increments, not taking into account the weight of the weight bar.

In other embodiments, depending on the length of the weight bar 341 and the incremental weight adjustment capability desired, the machine 310 will have more than two collar/weight groups. For example, where there are three collar/weight groups, three weight selection increments can be provided. Where there are four collar/weight groups, four weight selection increments can be provided.

As indicated in FIG. 37, in embodiments having two collar/weight groups, the machine 310 will include a left side gear drive 392' and a right side gear drive 392". The left side gear drive 392', which includes a left upper drive gear 394', is coupled to the left selection/index gear 390' via a left belt or chain 396' or other force transfer mechanism element(s) (e.g., a gear train or worm gear structure). The right side gear drive 392", which includes an right upper drive gear 394", is coupled to the right selection/index gear 390" via a right belt or chain 396" or other force transfer mechanism element(s) (e.g., a gear train or worm gear structure). Coaxial shafts 338 form the pivot 338 about which the weight arm assembly 320 pivots relative to the vertical post 326 of the base frame 314. The outer coaxial shaft 338 rotatably couples an primary or coarse index/selection wheel 400 to the left upper drive gear 394', and the inner coaxial shafts 338 rotatably couples an add-on or fine index/selection wheel 402 to the right upper drive gear 394".

Bearings allow the coaxial shafts/axles 338 to rotate with respect to the vertical post 326 to which the coaxial shafts 338 are attached. While the weight arms 340 are shown as pivoting around the same axis as the inner and outer axles 338 for the selection wheels 400, 402, it is contemplated that with the appropriate configuration for the selection wheel and drive gear assemblies, the pivot axis of the weight arms 340 do not have correspond to the coaxial shafts 338 of the selection wheel and upper drive gear assemblies.

Rotationally displacing an index/selection wheel 400, 402 causes the associated upper drive gear 394', 394" to rotationally displace. The rotational displacement of the upper drive gear 394', 394" is transferred to the corresponding index/selection gear 390', 390" via the belt or chain 396' 396". Displacement of the corresponding index/selection gear 390', 390" causes the corresponding collar group A, B to rotate about the weight bar 341. As a result, the bosses 382 move into and out of engagement with the tabs 380 on the weight plates 316, thereby indexing/selecting a weight combination from the corresponding weight group.

The outer index/selection wheel 400 and inner index/selection wheel 402 are marked with indices to tell the user what weight resistance combination is selected. Detents are placed in the selection structure to help the user "feel" when a weight resistance combination is selected. The collars groups A, B are not rotatably connected together on the weight bar 341. As a result, each collar group A, B can be set separately via its respective selection wheels 400, 402 for a different weight resistance to add up to the total weight resistance lifted by the weight bar 341 when displaced by a user performing an exercise movement on the machine 310.

As previously mentioned, the tab 380 on a weight 316 may be engaged directly by a boss 380 or may pass through a gap or space 387 formed between adjacent bosses 382. If the tab 380 is received in a slot 386 of a boss 382, this may allow for a more secure engagement of the weight plate 316 through the arc of displacement of the free end of the weight arm assembly 318.

The curvature and width of the slot 350 formed in each weight plate 316 is designed and dimensioned by the radius of curvature defined by distance along the weight arms 340 between the pivot point 338 and the weight bar 341, as can be understood from FIGS. 23 and 24. The position of the stabilizing rod 354 is arranged to fall within the arc defined by the motion of the weight bar 341 as the bar 341 is pivoted through space about the pivot point 338.

As with the first embodiment of the weight machine 10 illustrated in FIGS. 1-21, the second embodiment of the weight machine illustrated in FIGS. 22-37 can be utilized with a variety of different weight exercise stations/machines including without limitation: seated and standing calf machines; high, medium and low back row machines; lat pull-down machines; trap shrug machines; shoulder press and side lateral shoulder machines; incline and flat bench machines; vertical chest and fly machines; preacher curl and other bicep machines; triceps extension machines; dip machines; cable cross-over machines; rear delt machines; leg press, leg curl, and leg extension machines; smith machines; etc.

It is contemplated that there may be more than one weight load per machine, such as a multi-station machine allowing for a plurality of different exercises. It is also contemplated that the weight index mechanism 320 may be operably incorporated into the exercise member 324 or weight arms 340 differently than disclosed above. For example, the selection wheels 400, 402 can be operably attached to the end of the exercise member 324.

For a discussion of the operation of the weight exercise machine 310 of the present invention, reference is made to FIGS. 22-37. A user desiring to exercise on the weight exercise machine 310 of the present invention positions his self in the workstation 312. The user determines that for his first exercise set at the machine 310 the level of resistance will be, for example, 157 pounds, not including the weight of the weight bar. The user dials the primary weight wheel 400 such that it indicates 150 pounds on a first indicator disc. This action, via the gears 390', 394' and the chain 396' causes the first collar group A to rotate about the weight axle 341 such that the bosses 382 of the collars 372 associated with a fifty-pound weight plate 316*a* and a one hundred-pound weight plate 316*b* engage the tabs 380 of said plates. A combination of weight plates 316 providing a weight resistance of 150 pounds is now coupled to the weight bar 341 via the first collar group A. It is to be appreciated that the weight bar can add weight to the selected resistance. For example, in one embodiment of the weight exercise machine, the weight bar weighs 10 pounds. As such, selected weight indications on the primary weight wheel and the add-on weight wheel can be configured to account for the weight of the weight bar 341 when selecting a desired resistance.

The user dials the add-on weight wheel 402 such that it indicates seven pounds on a second indicator disc. This action, via the gears 390", 394" and the chain 396" causes the second collar group B to rotate about the weight axle 341 such that the bosses 382 of the collars 372 associated with a five-pound weight plate 316*g* and a two-pound weight plate 316*f* engage the tabs 380 of said plates. A combination of weight plates 316 providing a weight resistance of seven pounds is now coupled to the weight bar 341 via the second collar group B. A total of 157 pounds of weight plates 316 are now coupled to the weight bar 341. Thus, when the weight arm assembly 318 pivots upwardly, as shown in FIGS. 29 and 30, the coupled (i.e., indexed/selected) weights 316" associated with collar groups A, B pivot upwardly with the weight arm assembly 318. However, the remaining non-coupled (i.e., non-indexed/non-selected) weights 316' continue to rest in the tray 331 and do not pivot upwardly because their tabs 380 were not engaged by the bosses 382 of their corresponding collars 372. More specifically, because the tabs 380 of the non-coupled weights 316' are not aligned with bosses 382, the tabs 380 can pass through the gaps or spaces 387 between the bosses 382. Thus, the tabs 380 pass outside the outer periphery of the collars 372 as the collars 372 leave the tabs 380 with the upward displacing weight bar 341.

It should be understood that the selection wheels 400, 402 can be set in any order. The selection wheels 400, 402 can even be set at the same time if a user uses two hands to manipulate the two wheels 400, 402.

As can be understood from FIGS. 29 and 30, once the weight selection wheels 400, 402 are appropriately set to provide a weight resistance of 157 pounds, the user performs the positive portion of the first repetition of his first set of the exercise movement by exerting an exercise force against the exercise member 324 to cause the exercise member to displace upward, which causes the force transfer mechanism 22 to displace the weight bar assembly 318 upward relative to the base frame 314, as can be understood from FIGS. 29 and 30. As the weight arm assembly 318 pivots upwardly, the coupled (i.e., indexed/selected) weights 316" (see FIG. 30) pivot upwardly relative to the base frame 314 with the weight arm assembly 318. However, the non-coupled (i.e., non-indexed/non-selected) weights 316' (see FIG. 30) do not pivot upwardly with the weight arm assembly 318, but instead remain in the tray 331. On the negative portion of the first repetition, the user allows the exercise member 324 to displace downward, which allows the force transfer mechanism lower the weight arm assembly 318 to return to the downward position, as illustrated in FIG. 29. As a result, the coupled (i.e., indexed/selected) weights 316" (see FIG. 30) return to the downward position to rest with the non-coupled (i.e., non-indexed/non-selected) weights 316', as depicted in FIG. 29.

Once the user has finished the appropriate number of repetitions for the 157 pound set, the user can select/index another combination of weights 316 to provide for an increased or decreased weight resistance for another exercise set on the machine 310.

As previously mentioned, the weight exercise machine can be configured with different plate combinations, plate sizes and numbers of plates. For example, the plurality of weight plates 316 in one form of the weight exercise machine includes two fifty-pound plates 316*a*, a single one hundred-pound plate 316*b*, a single twenty-pound plate 316*c*, two ten-pound plates 316*d*, a single 1.25 pound plate 316*e*, a singe 2.5 pound plate 316*f*, and a single five-pound plate 316*g*. In addition, the machine can include 310 two independently selectable collar groups A, B, configured differently than the collar groups described above. For example, the first collar group A can include the two fifty-pound plates 316*a*, the single one hundred-pound plate 316*b*, the single twenty-pound plate 316*c*, and the two ten-pound plates 316*d*, while the second collar group B can include the single 1.25 pound plate 316*e*, the singe 2.5 pound plate 316*f*, and the single five-pound plate 316*g*. As previously mentioned, the weight of the weigh bar can also be taken into account with regard to the selectability of resistance. For example, with a machine having a weight bar that weighs 10 pounds, the first collar group A can be configured to allow adjustment from 10 to 250 pounds by 10 pound increments, and the second collar group B can be configured to allow adjustment from 1.25 pounds to 8.75 pounds in 1.25 pound increments.

d. Third Embodiment of the Weight Exercise Machine

Figure 40:
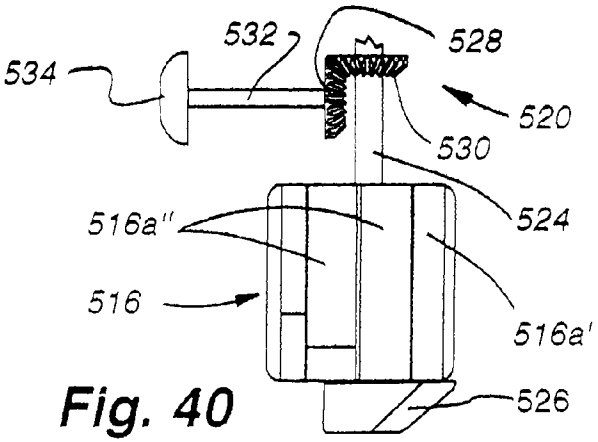
FIG. 40 is a front elevation of the weights and weight indexing mechanism wherein the indexing mechanism is aligned with the selected/indexed weight prior to displacement relative to the non-indexed/non-selected weights.
Figure 41:
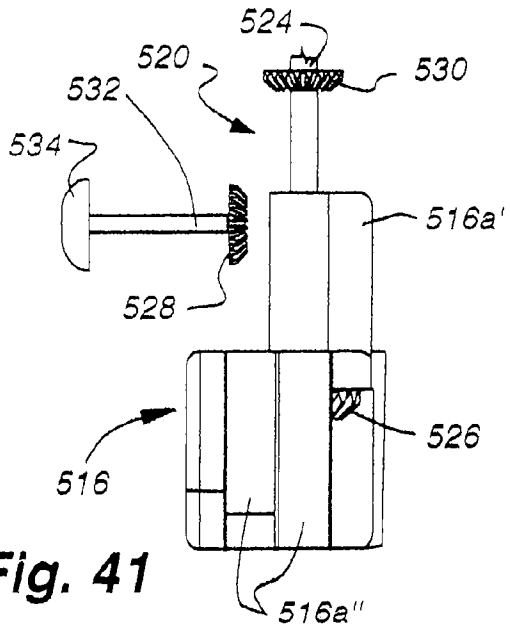
FIG. 41 is the same view depicted in FIG. 40, except the index/selected weight has been displaced relative from the non-indexed/non-selected weights by a user displacing an exercise member.
Figure 39:
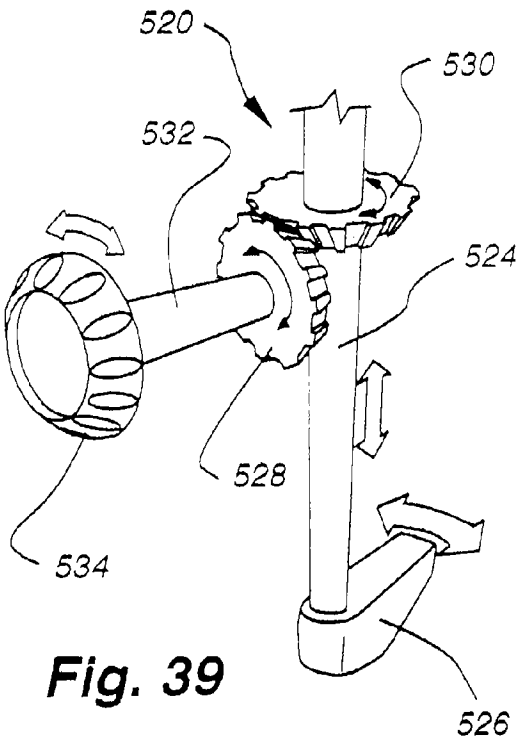
FIG. 39 is an isometric view of the index mechanism wherein the weights are not shown for clarity purposes.
Figure 38:
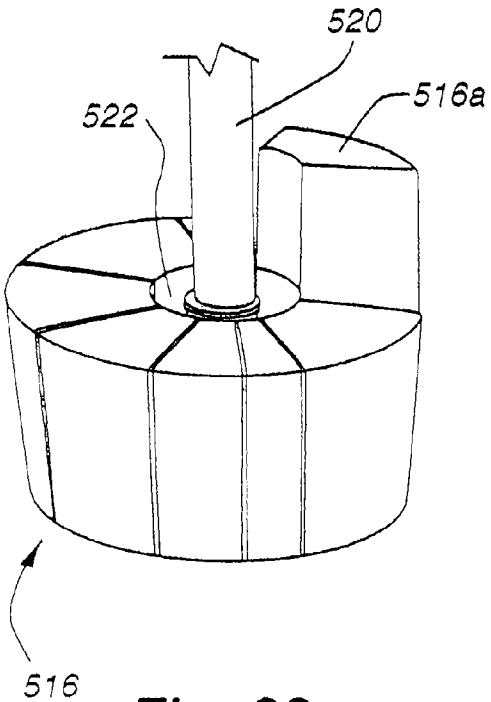
FIG. 38 is an isometric view of weights and weight index mechanism of the weight exercise machine.

For a discussion of the third embodiment of the weight exercise machine of the present invention, reference is made to FIGS. 38-41. FIG. 38 is an isometric view of weights 516 and weight index mechanism 520 of the weight exercise machine. FIG. 39 is an isometric view of the index mechanism 520 wherein the weights 516 are not shown for clarity purposes. FIG. 40 is a front elevation of the weights 516 and weight indexing mechanism 520 wherein the indexing mechanism 520 is aligned with the selected/indexed weight 516*a*' prior to displacement relative to the non-indexed/non-selected weights 516*a*". FIG. 41 is the same view depicted in FIG. 40, except the index/selected weight 516*a*' has been displaced relative from the non-indexed/non-selected weights 516*a*" by a user displacing an exercise member.

As shown in FIG. 38, each weight 516*a* is a pie-slice segment 516*a* of a cylindrical mass having a center hole 522. As indicated in FIG. 39, the weight index mechanism 520 includes a lift shaft 524, a lift member 526, first and second gears 528, 530, an index shaft 532, and an index wheel 534. The lift member 526 is coupled to the bottom end of the lift shaft 524, and the second gear 30 is coaxially mounted on an upper portion of the lift shaft 524. The index wheel 534 is mounted on one end of the index shaft 532, and the first gear 528 is mounted on the other end of the index shaft 532. The first and second gears 528, 530 engage each other.

As indicated by the arrows in FIG. 39, the lift shaft 524 is vertically displaceable and rotatable about its longitudinal axis. As can be understood from FIG. 40, a user selects a weight resistance by rotating the index wheel 534, which causes the lift shaft 524 to rotate and bring the lift member 526 into engaging alignment with the bottom surface of the appropriate indexed/selected weight 516*a*'. As with the first two embodiments of the present invention (as depicted in FIGS. 1-37), the lift shaft 524 is coupled to a force transfer mechanism that transfers the lifting force exerted by a user on an exercise member to the lift shaft 524. Therefore, as can be understood from FIG. 41, when the user applies an exercise force to the exercise member when performing an exercise movement on the machine, the lift shaft 524 displaces vertically, taking the indexed/selected weight 516*a*' upward.

e. Fourth Embodiment of the Weight Exercise Machine

Figure 43:
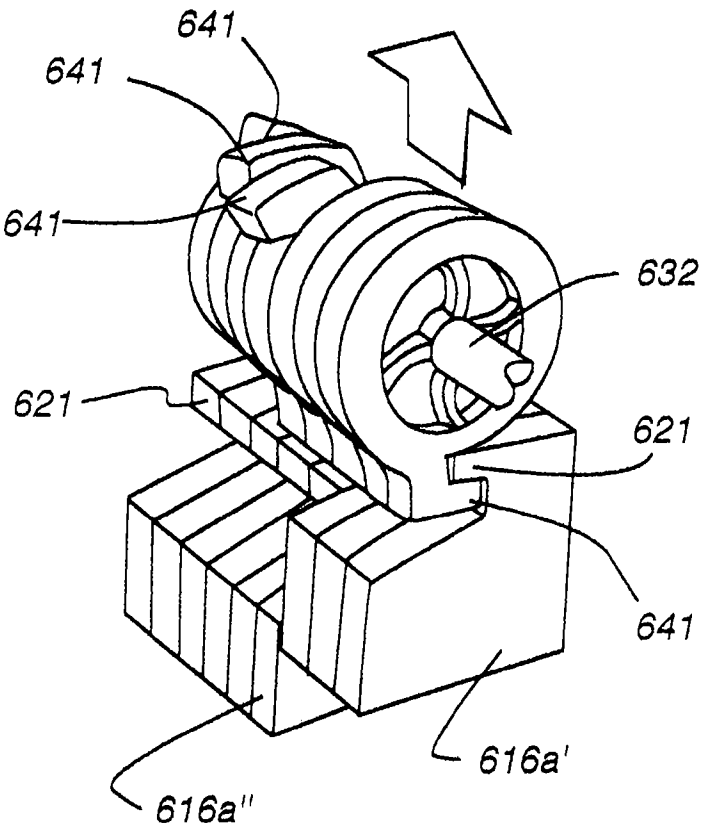
FIG. 43 is an isometric view of the indexed/selected weights being displaced relative from the non-indexed/non-selected weights by a user displacing an exercise member.
Figure 42:
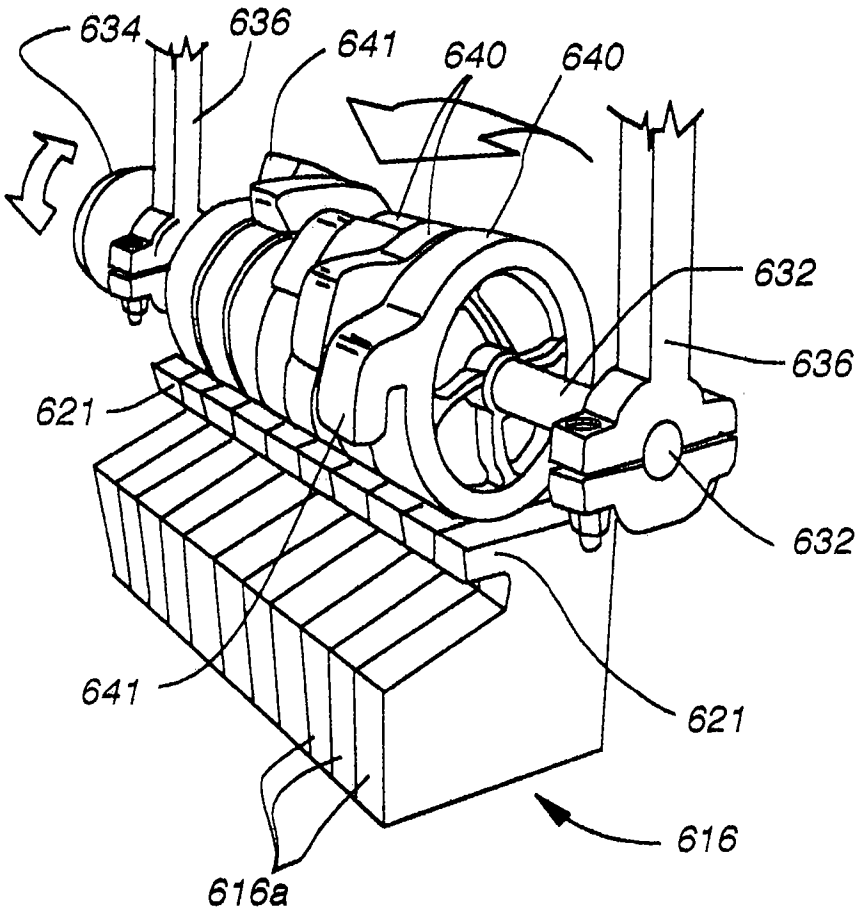
FIG. 42 is an isometric view of weights and weight index mechanism of the weight exercise machine.

For a discussion of the fourth embodiment of the weight exercise machine of the present invention, reference is made to FIGS. 42 and 43. FIG. 42 is an isometric view of weights 616 and weight index mechanism 620 of the weight exercise machine. FIG. 43 is an isometric view of the indexed/selected weights 616*a*' being displaced relative from the non-indexed/non-selected weights 616*a*" by a user displacing an exercise member.

As indicated in FIG. 42, the weight machine includes a plurality of weights 616 and an index mechanism 620. The weights 616 are arranged side-by-side and each includes a hook, groove, slot, or other engagement feature 621. The index mechanism 620 includes an index shaft 632, an index wheel 634, shaft arms 636, and engagement wheels 640. The shaft arms 636 support the index shaft 632 at opposite ends of the index shaft 632. The index wheel 634 is mounted on one end of the index shaft 632 to rotatably displace a shaft within the index shaft 632. Each engagement wheel 640 includes a hook or other engagement feature 641 configured to engage the engagement feature 621 on the corresponding weight 616*a*.

To select a weight resistance for an exercise to be performed on the machine, the user rotates the index wheel 634 to the appropriate weight setting. Rotation of the index wheel 634 causes the shaft within the index shaft 632 to rotate. In a manner similar to those previously described in this Detailed Description and in the incorporated applications, the coaxial shafts (i.e., the index shaft 632 and the shaft within the index shaft 632) are configured to allow the selective engagement of the engagement wheels 640 that correspond to the selected weight resistance. Accordingly, as depicted in FIGS. 42 and 43 by the arrows, the selectively engaged engagement wheels 640 are caused to rotate down such that their respective engagement features 641 engage with the engagement features 621 of the corresponding weights 616*a*.

As with the first two embodiments of the present invention (as depicted in FIGS. 1-37), the shaft arms 636 are coupled to a force transfer mechanism that transfers the lifting force exerted by a user on an exercise member to the index shaft 632. Therefore, as can be understood from FIG. 43, when the user applies an exercise force to the exercise member when performing an exercise movement on the machine, the index shaft 632 displaces vertically, taking the indexed/selected weight 616*a*' upward.

f. Fifth Embodiment of the Weight Exercise Machine

Figure 45:
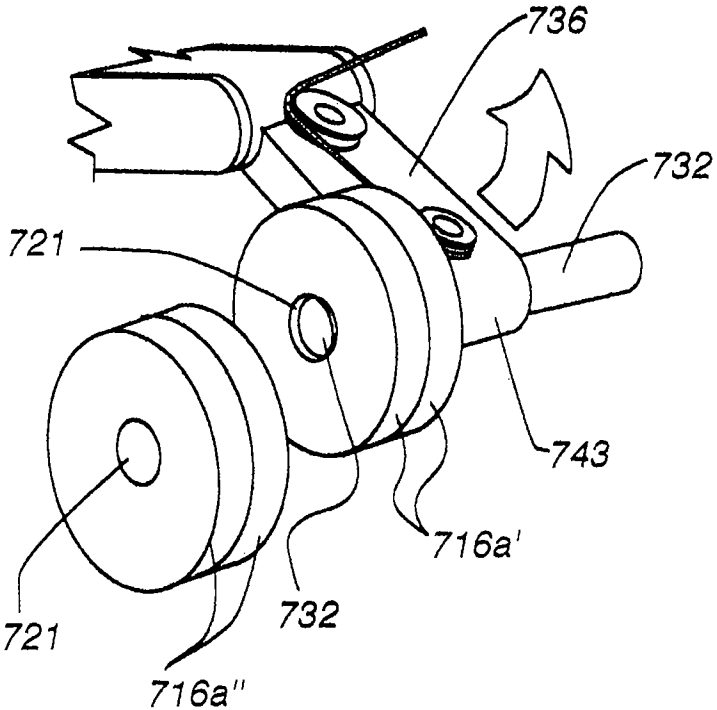
FIG. 45 is an isometric view of the indexed/selected weights being displaced relative from the non-indexed/non-selected weights by a user displacing an exercise member.
Figure 44:
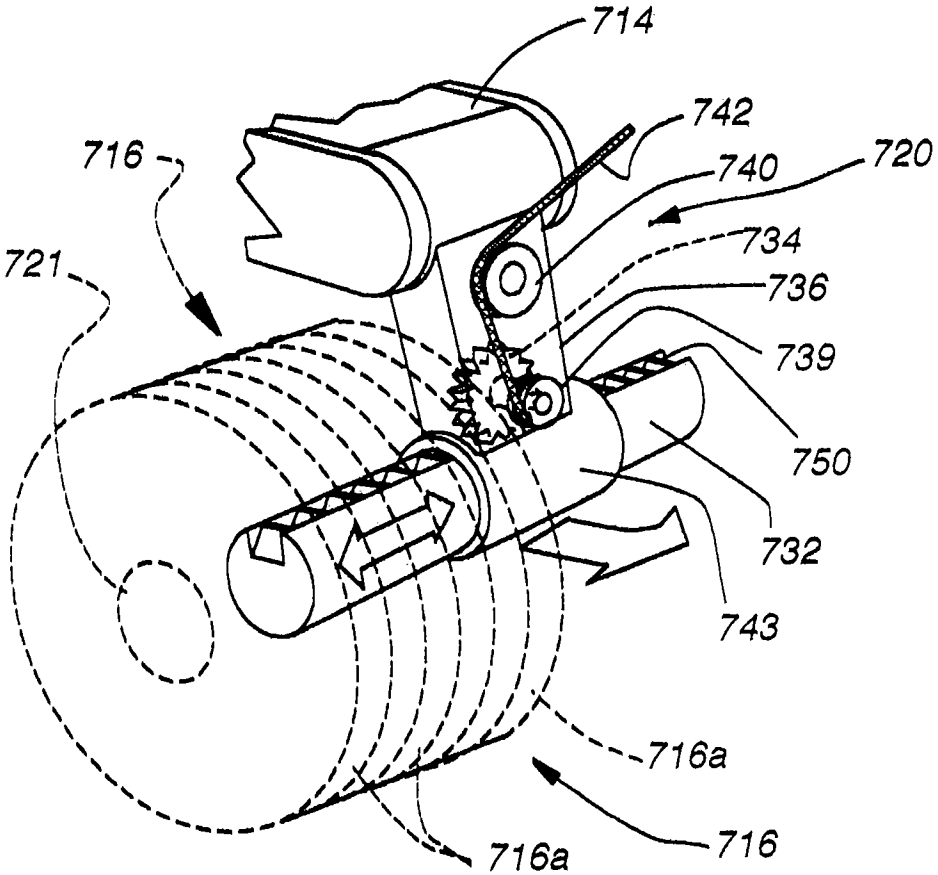
FIG. 44 is an isometric view of weights and weight index mechanism of the weight exercise machine.

For a discussion of the fifth embodiment of the weight exercise machine of the present invention, reference is made to FIGS. 44 and 45. FIG. 44 is an isometric view of weights 716 and weight index mechanism 720 of the weight exercise machine. FIG. 45 is an isometric view of the indexed/selected weights 716*a*' being displaced relative from the non-indexed/non-selected weights 716*a*" by a user displacing an exercise member.

As indicated in FIG. 44, the weight machine includes a plurality of weights 716 and an index mechanism 720. The weights 716 are arranged side-by-side and each includes a center hole 721. The index mechanism 720 includes an index shaft 732, an index gear 734, a shaft arm 736, first and second pulleys 739, 740, and a cable 742. The index shaft 732 is laterally telescopically displaceable within a sleeve 743 in one end of the shaft arm 736. The other end of the shaft arm is pivotally coupled to a base frame 714 of the machine. A first end of the cable 742 is coupled to an index wheel or other selection mechanism that allows a user to select the weight resistance to be used for the exercise movement to be performed on the machine. The cable 742 extends over the first pulley 739 to engage the second pulley 740, which is coupled to the index gear 734. The index gear 734 meshes with a gear rack 750 extending along the length of the index shaft 732 to telescopically drive the index shaft 732 into and out of the sleeve 743.

As shown in FIG. 44, the index bar 732 is extendable into the aligned holes 721 of the weights 716 to a greater or lesser extent, depending on the magnitude of weight resistance desired by the user. As with the first two embodiments of the present invention (as depicted in FIGS. 1-37), the shaft arm 736 is coupled to a force transfer mechanism that transfers the lifting force exerted by a user on an exercise member to the index shaft 732. Therefore, as can be understood from FIG. 45, when the user applies an exercise force to the exercise member when performing an exercise movement on the machine, the index shaft 732 displaces vertically, taking the indexed/selected weight 716*a*' upward.

g. Sixth Embodiment of the Weight Exercise Machine

Figure 47:
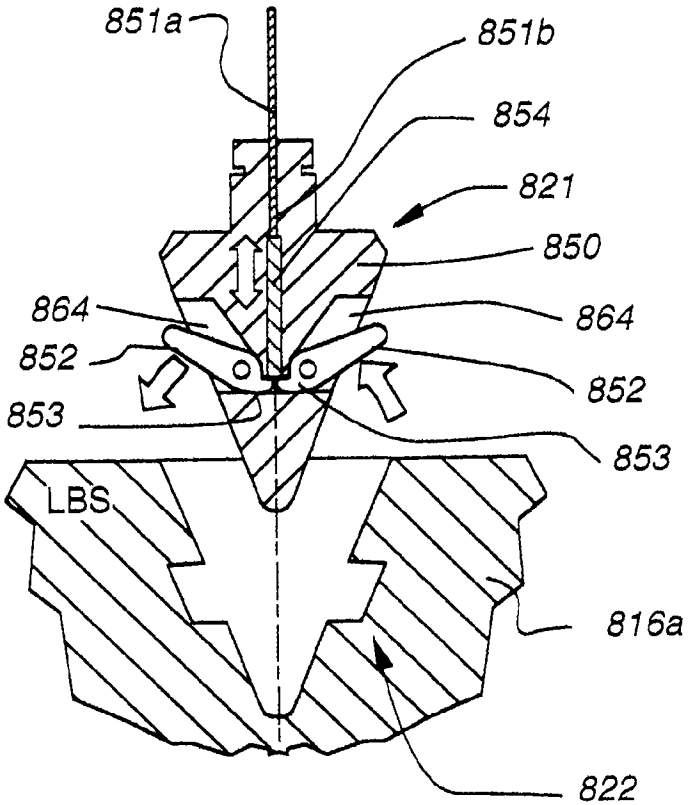
FIG. 47 is a cross-sectional elevation of an engagement mechanism of the index mechanism and an engagement feature of a weight.
Figure 46:
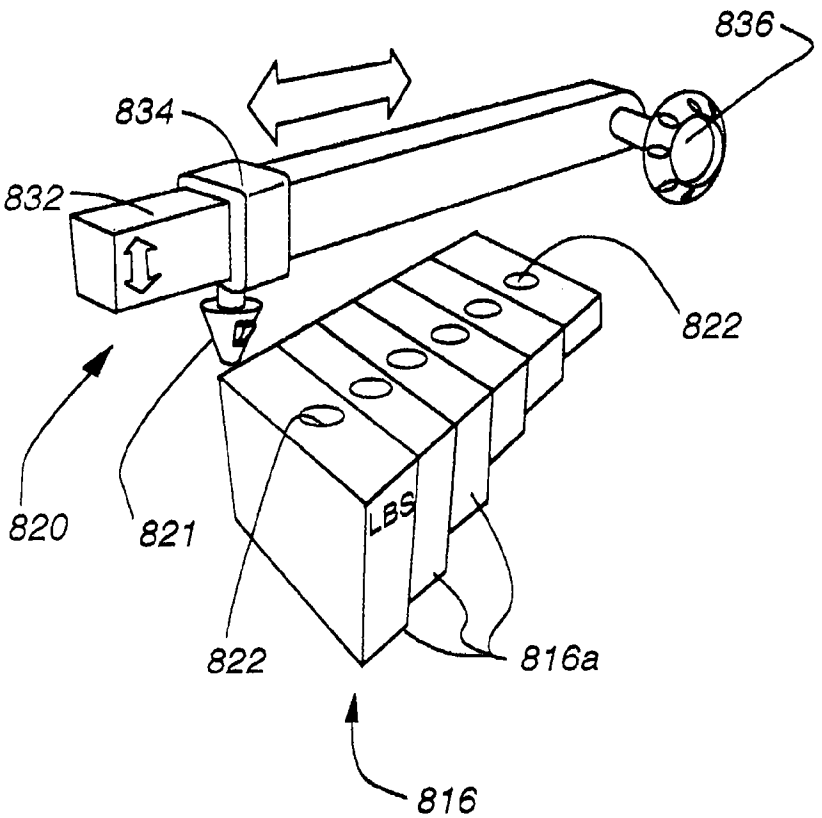
FIG. 46 is an isometric view of weights and weight index mechanism of the weight exercise machine.

For a discussion of the sixth embodiment of the weight exercise machine of the present invention, reference is made to FIGS. 46 and 47. FIG. 46 is an isometric view of weights 816 and weight index mechanism 820 of the weight exercise machine. FIG. 47 is a cross-sectional elevation of an engagement mechanism 821 of the index mechanism 820 and an engagement feature 822 of a weight 816*a*.

As indicated in FIG. 46, the weight machine includes a plurality of weights 816 and an index mechanism 820. The weights 816 are arranged side-by-side and each includes an engagement feature 822. The index mechanism 820 includes an index arm 832, an index sleeve 834, and an index wheel 836. The index sleeve 834 suspends the engagement mechanism 821 and is displaceable along the index sleeve 834. A user rotates the index wheel 836 to displace the index sleeve 834 along the weights 816 to align the engagement mechanism 821 with the engagement feature 822 of the weight 816*a* offering the desired weight resistance for the exercise movement to be performed on the machine. Once brought into alignment with the appropriate engagement feature 822, the engagement mechanism 821 is lowered to engage the engagement feature 822. Specifically, as shown in FIG. 47, the engagement mechanism 821 enters the engagement feature or hole 822 and engages the engagement feature 822.

As shown in FIG. 47, the engagement mechanism 821, in one embodiment, has a conical shaped body 850 that points tip downward. Two members (e.g., cables or rods) 851*a*, 851*b* extend between the top portion of the body 850 and the sleeve 834. One member 851*a* is used to support the body 850 and the other member 851*b* is used to actuate latches 852 that are pivotally coupled to the body 850. In one embodiment, the members 851*a*, 851*b* are coaxial. In another embodiment, the members 851*a*, 851*b* are run side-by-side between the body 850 and the sleeve 834.

As illustrated in FIG. 47, the latches 852 include tabs 853 that are engaged by a bar or pin 854 slidably displaceable within the body 850. The pin 854 is coupled to the member 851*b*, which pulls the pin 854 upward within the body 850 to allow clearance for the latches 852 to pivot relative to the body 850. As a result, the engagement mechanism 821 can fit into the engagement feature or hole 822. Once within the engagement feature 822, the latches 852 engage the recesses 860 within the engagement feature 822, which prevents the engagement mechanism 821 from withdrawing from the engagement feature 822.

As with the first two embodiments of the present invention (as depicted in FIGS. 1-37), the index arm 832 is coupled to a force transfer mechanism that transfers the lifting force exerted by a user on an exercise member to the index arm 832. Therefore, as can be understood from FIG. 46, when the user applies an exercise force to the exercise member when performing an exercise movement on the machine, the index arm 832 displaces vertically, taking the indexed/selected weight 816*a* upward.

As can be understood from FIG. 47, to allow the engagement mechanism 821 to disengage from the engagement feature 822, the selected weight 816*a* is returned to its place among the other weights 816*a* and the engagement mechanism 821 is driven into the engagement feature 822 to remove any tension from the latches 852. The pin 854 is then driven down to abut against the tabs 853 and to cause the latches 852 to pivot upward into recesses 864 in the body 850. By pivoting in the recesses 864, the latches 852 become generally flush with the body's conical sides. The engagement mechanism 821 can now be withdrawn from the engagement feature 822 of the weight 816*a*.

h. Seventh Embodiment of the Weight Exercise Machine

Figure 48:
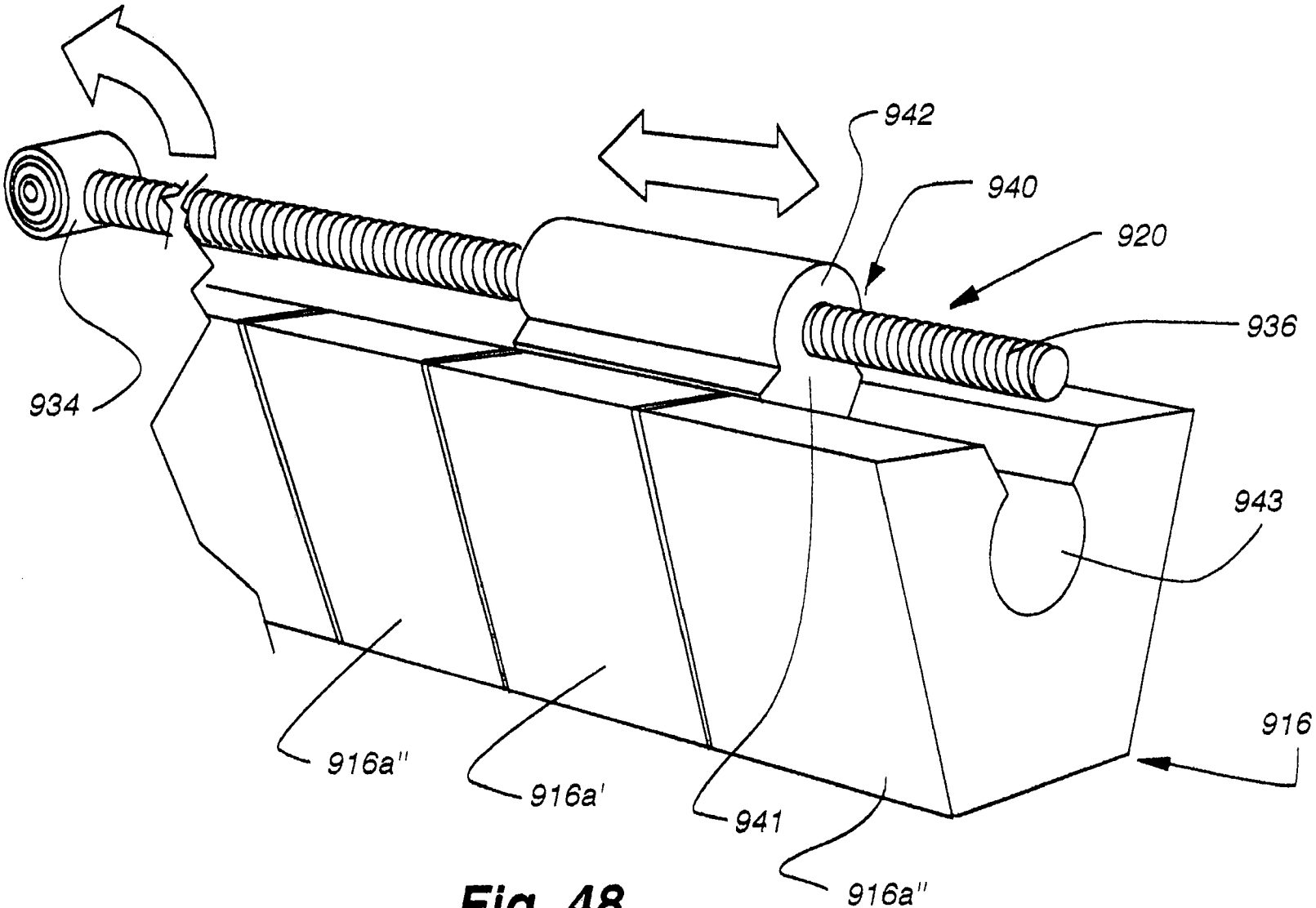
FIG. 48 is an isometric view of weights and weight index mechanism of the weight exercise machine.

For a discussion of the seventh embodiment of the weight exercise machine of the present invention, reference is made to FIG. 48, which is an isometric view of weights 916 and weight index mechanism 920 of the weight exercise machine. As shown in FIG. 48, the weight index mechanism 920 includes an index wheel 934, a threaded rod 936, and a carrier 940. The carrier 940 includes an engagement feature 941 and a threaded sleeve 942 that receives the threaded rod 936.

The weights 916 are positioned side-by-side. Each weight 916*a* includes an engagement feature (e.g., slot) 943 that aligns with the slots 943 of the immediately adjacent weights 916*a*. The engagement feature 941 of the carrier 940 passes through the aligned slots 943 of the weights 916*a* as the carrier 940 displaces along the threaded rod 936. A user rotates the index wheel 934 to cause the threaded rod 936 to rotate, thereby causing the carrier 940 to displace along the rod 936 to the weight 916*a* that corresponds to the weight resistance desired by the user for the exercise movement being performed on the machine.

As with the first two embodiments of the present invention (as depicted in FIGS. 1-37), the threaded rod 936 is coupled to a force transfer mechanism that transfers the lifting force exerted by a user on an exercise member to the rod 936. Therefore, as can be understood from FIG. 48, when the user applies an exercise force to the exercise member when performing an exercise movement on the machine, the rod 936 displaces vertically, taking the indexed/selected weight 916*a*' upward relative to the non-indexed/non-selected weights 916*a*".

i. Eighth Embodiment of the Weight Exercise Machine

Figure 49:
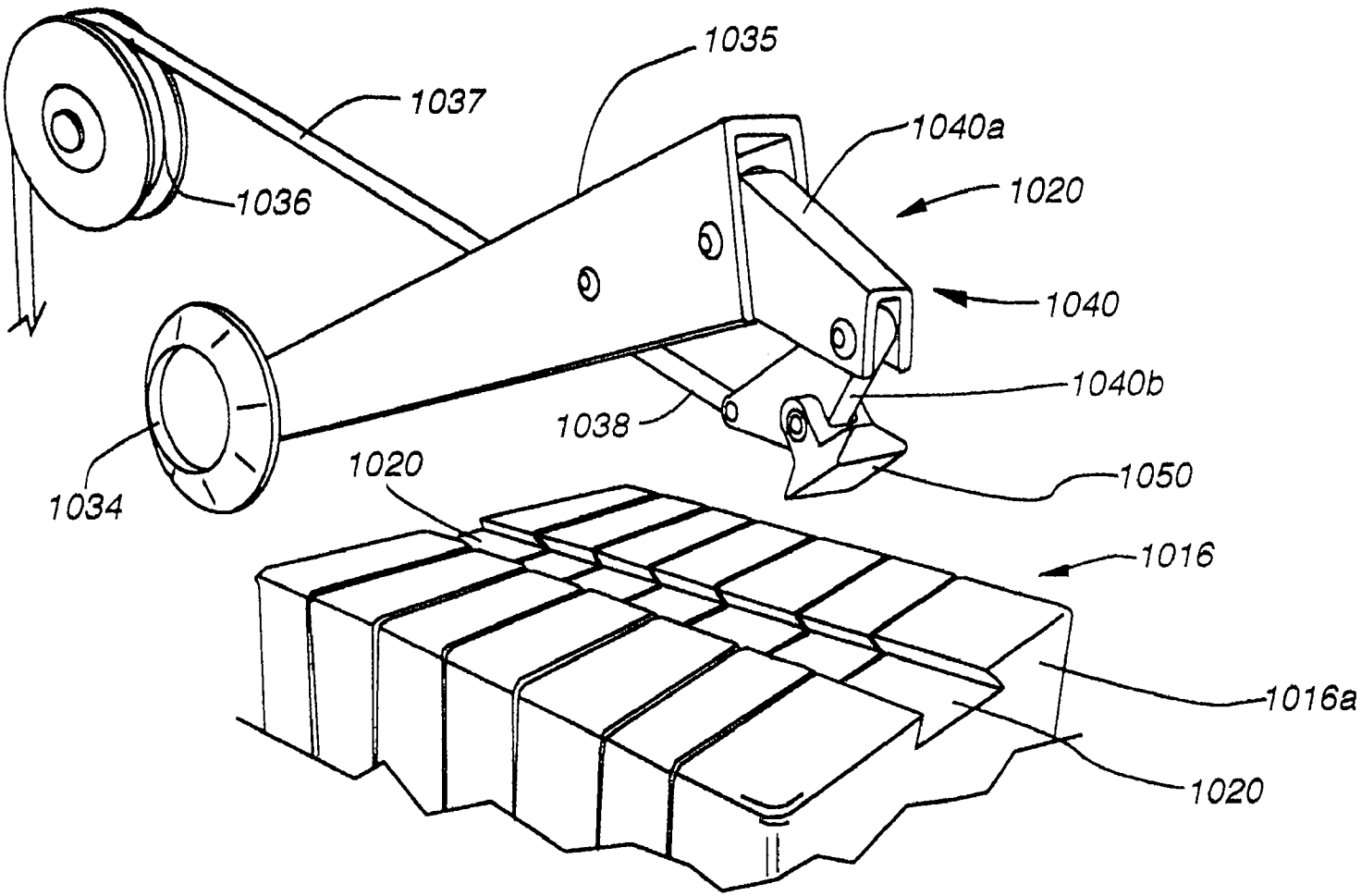
FIG. 49 is an isometric view of weights and weight index mechanism of the weight exercise machine.

For a discussion of the eighth embodiment of the weight exercise machine of the present invention, reference is made to FIG. 49, which is an isometric view of weights 1016 and weight index mechanism 1020 of the weight exercise machine. As shown in FIG. 49, the weight index mechanism 1020 includes an index wheel 1034, an index arm 1035, a pulley 1036, a first cable 1037, and a second cable 1038.

The weights 1016 are positioned side-by-side. Each weight 1016*a* includes an engagement feature (e.g., groove, slot, etc.) 1020 that aligns with the slots 1020 of the immediately adjacent weights 1016*a*. The index arm 1035 includes a neck 1040, which, in one embodiment, is articulated and includes an upper neck 1040*a* and a lower neck 1040*b*. The lower neck 1040*b* includes an engagement member 1050 pivotally coupled to the lower neck 1040*b*. The lower neck 1040*b* is coupled to the second cable 1038, which extends to the index wheel 1034. The first cable 1037 couples at a first end to the index arm 1035 and extends about the pulley 1036.

The upper neck 1040*a* is moveably coupled to the arm 1035. In one embodiment, the upper neck 1040*a* is pivotally coupled to the arm 1035 and the length of the neck 1040 and its pivotal construction allows the engagement member 1050 to be positioned within the slot 1020 of any of the weights 1016*a*. In one embodiment, the upper neck 1040*a* is slidably displaceable along the arm 1035, thereby providing the adjustability needed to bring the engagement member 1050 into proper engagement with any of the slots 1020 of any of the weights 1016*a*. In either case, when a user desires to select a weight resistance for an exercise movement to be performed on the machine, the user rotates the index wheel 1034. Rotation of the index wheel 1034 causes the engagement member 1050 to displace along the aligned slots 1020 until residing within the slot 1020 of the weight 1016*a* offering the appropriate weight resistance.

As with the first two embodiments of the present invention (as depicted in FIGS. 1-37), the index arm 1035 is coupled to a force transfer mechanism that transfers the lifting force exerted by a user on an exercise member to the index arm 1035. For example, in one embodiment, the first cable 1037 extends between the index arm 1035 and the force transfer mechanism. Therefore, as can be understood from FIG. 49, when the user applies an exercise force to the exercise member when performing an exercise movement on the machine, the index arm 1035 displaces vertically, taking the indexed/selected weight 1016*a* upward relative to the non-indexed/non-selected weights 1016*a*.

j. Ninth Embodiment of the Weight Exercise Machine

Figure 51:
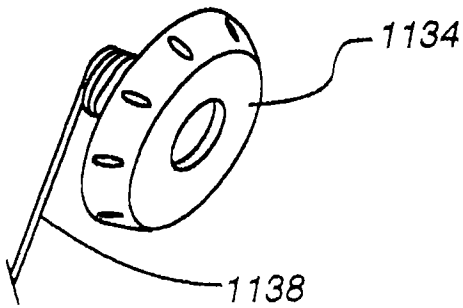
FIG. 51 is an isometric view of a weight index wheel.
Figure 52:
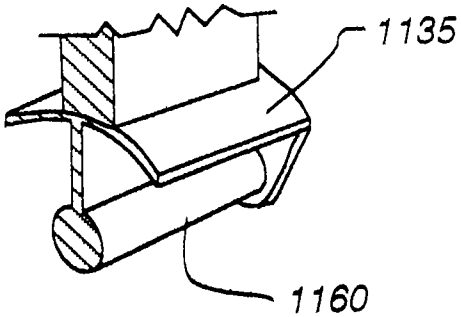
FIG. 52 is an isometric view of an engagement member.
Figure 50:
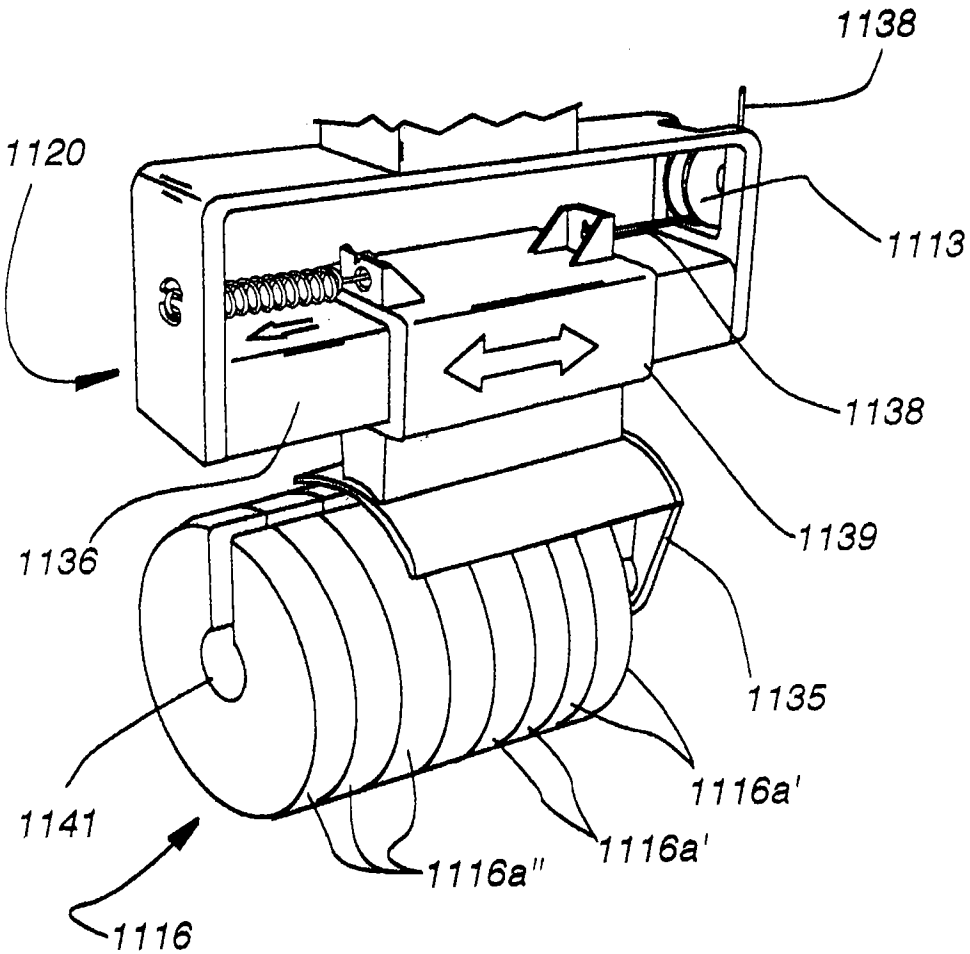
FIG. 50 is an isometric view of weights and weight index mechanism of the weight exercise machine.

For a discussion of the ninth embodiment of the weight exercise machine of the present invention, reference is made to FIGS. 50-52. FIG. 50 is an isometric view of weights 1116 and weight index mechanism 1120 of the weight exercise machine. FIG. 51 is an isometric view of a weight index wheel 1134. FIG. 52 is an isometric view of an engagement member 1135. As shown in FIG. 50, the weight index mechanism 1120 includes an index arm 1136, a pulley 1113, a cable 1138, and a sleeve 1139 from which the engagement member 1135 extends.

The weights 1116 are positioned side-by-side. Each weight 1116*a* includes an engagement feature (e.g., groove, slot, etc.) 1141 that aligns with the slots 1141 of the immediately adjacent weights 1116*a*. The sleeve 1139 is slidably displaceable along the index arm 1136. As indicated in FIG. 52, the engagement member includes a portion 1160 adapted to mate with the slots 1141 of the weights 1116*a*.

As indicated in FIG. 50, as the sleeve 1139 is displaced along the index arm 1136, the portion 1160 of the engagement member 1135 passes along the slots 1141. When a user desires to select a weight resistance for an exercise movement to be performed on the machine, the user rotates the index wheel 1134, which is coupled to the sleeve 1139 via the cable 1138 that passes about the pulley 1113. Rotation of the index wheel 1134 causes the engagement member 1135 to displace along the index arm 1136, which causes the portion 1160 to pass through the aligned slots 1141 until residing within the slots 1141 of a sufficient number of weights 1116*a* to provide the appropriate weight resistance.

As can be understood from FIGS. 50 and 52, the further the engagement member 1135 has passed across the weights 1116, the larger the number of weight slots 1141 within which the portion 1160 resides. As a result, the index arm 1136 is coupled to a larger number of weights 1116 and a greater weight resistance is provided to the user of the machine. Conversely, where the engagement member 1135 has passed across the weights 1116 to a lesser extent, the portion 1160 will reside within a smaller number of weight slots 1141. As a result, the index arm 1136 will be coupled to a smaller number of weights 1116 and a smaller weight resistance is provided to the user of the machine.

As with the first two embodiments of the present invention (as depicted in FIGS. 1-37), the index arm 1136 is coupled to a force transfer mechanism that transfers the lifting force exerted by a user on an exercise member to the index arm 1136. Therefore, as can be understood from FIG. 50, when the user applies an exercise force to the exercise member when performing an exercise movement on the machine, the index arm 1136 displaces vertically, taking the indexed/selected weight 1116*a*' upward relative to the non-indexed/non-selected weights 1116*a*".

k. Tenth Embodiment of the Weight Exercise Machine

Figure 54:
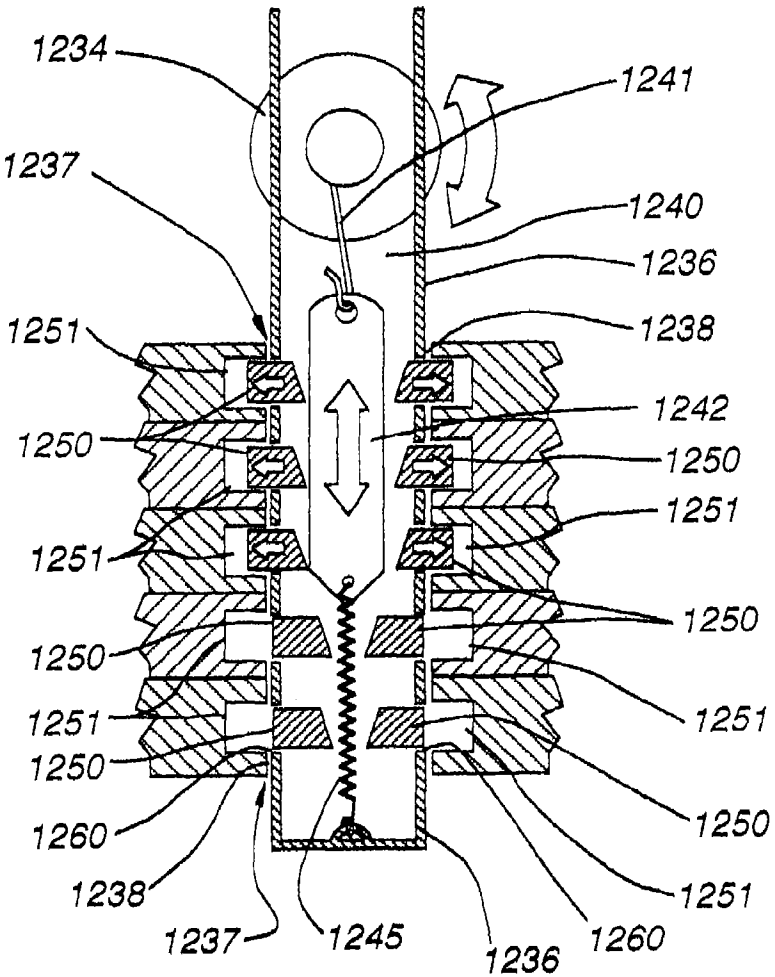
FIG. 54 is a cross-section elevation taken through FIG. 53.
Figure 53:
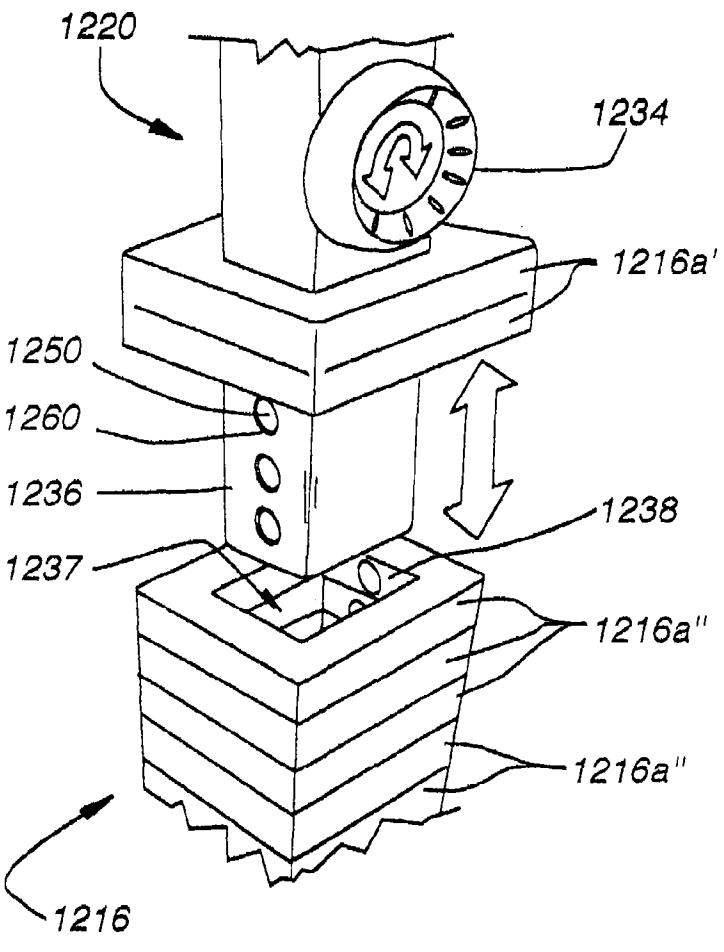
FIG. 53 is an isometric view of weights and weight index mechanism of the weight exercise machine.

For a discussion of the tenth embodiment of the weight exercise machine of the present invention, reference is made to FIGS. 53 and 54. FIG. 53 is an isometric view of weights 1216 and weight index mechanism 1220 of the weight exercise machine. FIG. 54 is a cross-section elevation taken through FIG. 53. As shown in FIG. 53, the weight index mechanism 1220 includes an index wheel 1234 and an index column 1236 vertically displaceable within an interior cavity 1237 formed by the aligned center holes 1238 of the stacked weights 1216*a*.

As indicated in FIG. 54, within a longitudinally extending cavity 1240 of the column 1236, a cable 1241 couples a top end of an indexing member 1242 to the index wheel 1234. A spring 1245 couples the bottom end of the indexing member 1242 to the bottom of the column 1236. Pairs of pins 1250 are located along the length of the column 1236 and are biased to reside within the cavity 1237 such that the exterior end of a pin 1250 is generally flush with the surface of the column 1236, as indicated in FIG. 53. Each pair of pins 1250 is paired with a pair of recesses 1251 in a corresponding weight 1216*a* in the weight stack 1216.

As can be understood from FIG. 53, when a user desires to select a weight resistance for an exercise movement to be performed on the machine, the user rotates the index wheel 1234, which, via the cable 1241, causes indexing member 1242 to displace vertically within the cavity 1240 of the column 1236. Wherever within the cavity 1240 of the column 1236 the indexing member 1242 ends up being positioned, the indexing member 1236 extends the pairs of pins 1250 out of their respective column holes 1260 into the recesses 1251 of the corresponding weights 1216*a*. The pins 1250 residing within the recesses 1251 of a weight 1216*a* couples the column 1236 to the weights 1216*a*.

As with the first two embodiments of the present invention (as depicted in FIGS. 1-37), the column 1236 is coupled to a force transfer mechanism that transfers the lifting force exerted by a user on an exercise member to the column 1236. Therefore, as can be understood from FIGS. 53 and 54, when the user applies an exercise force to the exercise member when performing an exercise movement on the machine, the column 1236 displaces vertically, taking the indexed/selected weights 1216*a*' upward relative to the non-indexed/non-selected weights 1216*a*".

In one embodiment, two or more weight stack 1216 and index column 1236 assemblies will be provided on a single machine to provide an expanded weight resistance level capability and increased weight increment selectability. The index columns 1236 will be coupled as a group to the force transfer mechanism.

l. Eleventh Embodiment of the Weight Exercise Machine

Figure 56:
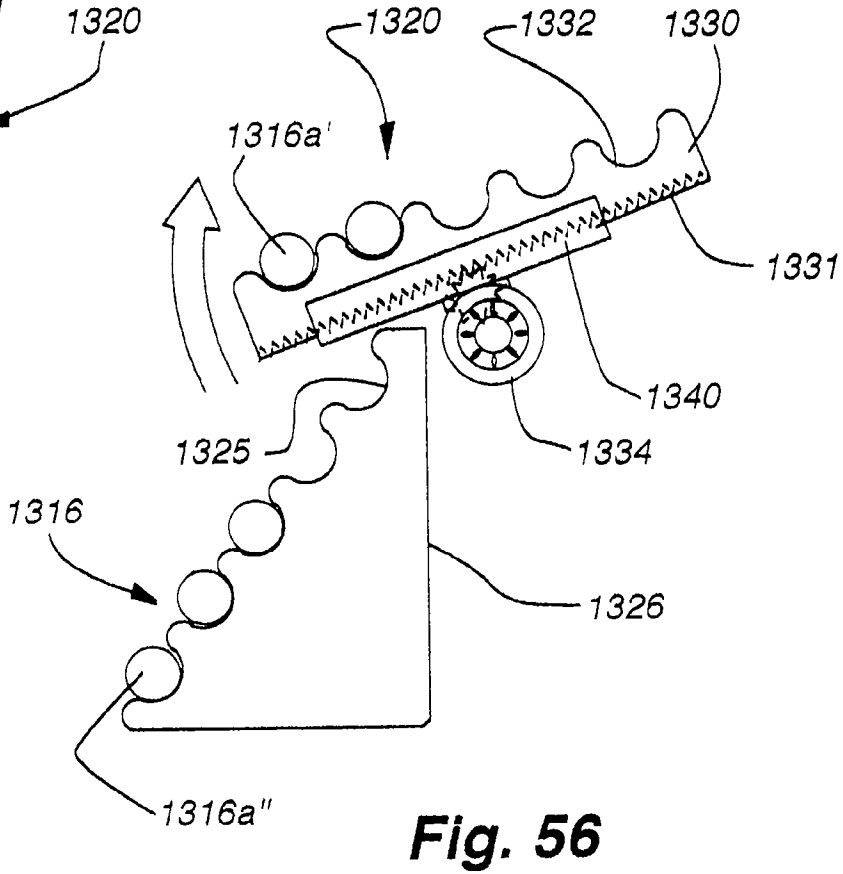
FIG. 56 is a side elevation of weights and index mechanism depicted in FIG. 55.
Figure 55:
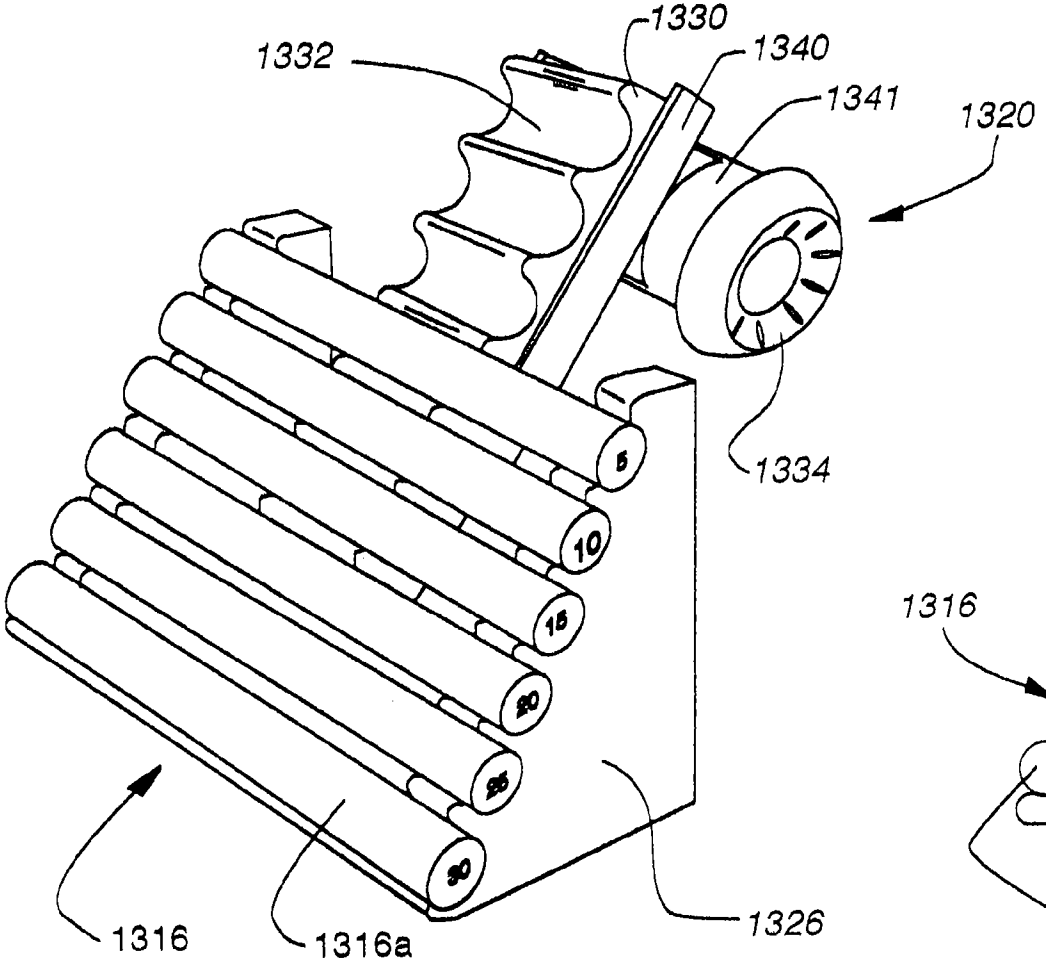
FIG. 55 is an isometric view of weights and weight index mechanism of the weight exercise machine.

For a discussion of the eleventh embodiment of the weight exercise machine of the present invention, reference is made to FIGS. 55 and 56. FIG. 55 is an isometric view of weights 1316 and weight index mechanism 1320 of the weight exercise machine. FIG. 56 is a side elevation of weights 1316 and index mechanism 1320 depicted in FIG. 55.

As shown in FIGS. 55 and 56, the weights 1316 are bars 1316*a* that reside in grooves 1325 in an inclined weight rack 1326 until engaged by the weight index mechanism 1320. The index mechanism 1320 includes an arm 1330 that has a gear rack 1331 along its bottom side and a plurality of grooves 1332 along its top side. The grooves 1332 are for receiving bars 1316 for displacement by a user's exercise force. The arm 1330 is longitudinally displaceable along a frame 1340 that includes an index wheel 1334, which is coupled to a gear that engages the gear rack 1331. The frame 1340 is pivotally mounted about an axle 1341.

As can be understood from FIG. 55, when a user desires to select a weight resistance for an exercise movement to be performed on the machine, the user pivots the index mechanism 1320 about the axle 1341 until the arm 1330 is positioned below the bars 1316*a* at a slope that is slightly greater than the slope of inclined weight-bearing portion of the inclined weight rack 1326. The user then rotates the index wheel 1334, which causes the arm 1330 to extend underneath the desired number of bars 1316*a*. As illustrated by the arrow in FIG. 56, the index mechanism 1320 is then pivoted about the axle 1341 to capture the desired number of bars 1316*a* with the grooves 1332 of the arm 1330. Once the appropriate number of bars 1316*a* is captured, the index mechanism 1320 can be displaced upward by an exercise force exerted by a user of the machine.

As with the first two embodiments of the present invention (as depicted in FIGS. 1-37), the frame 1340 is coupled to a force transfer mechanism that transfers the lifting force exerted by a user on an exercise member to the frame 1340. Therefore, as can be understood from FIG. 56, when the user applies an exercise force to the exercise member when performing an exercise movement on the machine, the index mechanism 1320 displaces vertically, taking the indexed/selected weight bars 1316*a*' upward relative to the non-indexed/non-selected weight bars 1316*a*".

In one embodiment, two or more weight rack 1326 and index mechanism 1320 assemblies will be provided on a single machine to provide an expanded weight resistance level capability and increased weight increment selectability. The multiple weight frames 1340 will be coupled as a group to the force transfer mechanism.

m. Twelfth Embodiment of the Weight Exercise Machine

Figure 57:
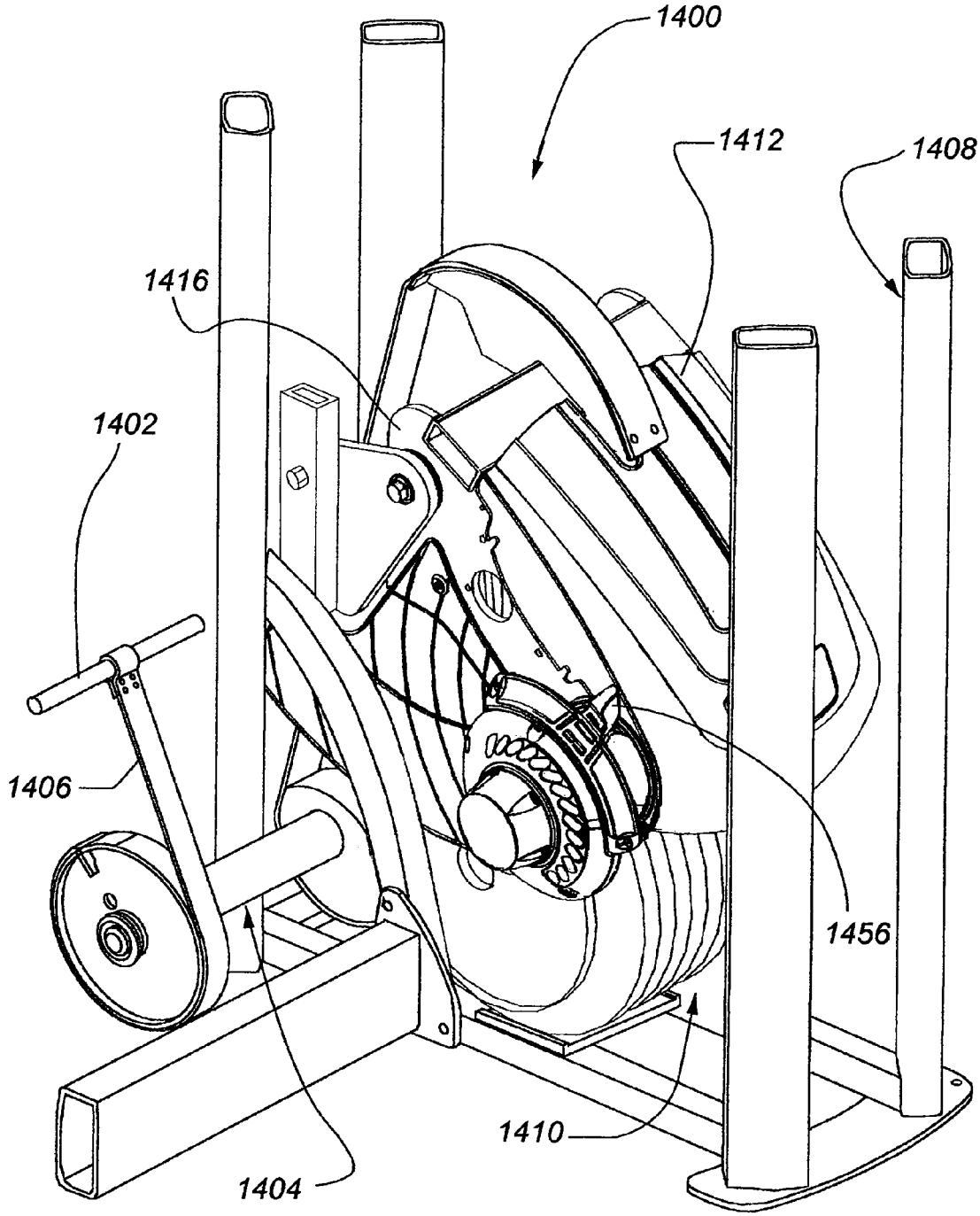
FIG. 57 is a isometric view of a twelfth embodiment of a weight and exercise machine showing only the part of the machine associated with the main weights.

A twelfth embodiment of a weight exercise machine 1400 is shown in FIGS. 57-83. With reference first to FIG. 57, the weight exercise machine 1400, like previously described embodiments, may include an exercise member 1402 that could take the form of many different types of exercise apparatus. The exercise member 1402 may be operatively associated with a force transfer mechanism 1404 using a non-extensible strap 1406, a cable, or other suitable connection element or system. The force transfer mechanism 1404 may be mounted on a main frame 1408 and operatively associated with a weight system 1410. A shroud 1412 may cover at least a portion of the weight system 1410. The shroud 1412 may minimize the potential for users of, or others who may be exposed to, the weight exercise machine 1400 to be injured by covering moving parts associated with the weight system 1410.

Figure 58:
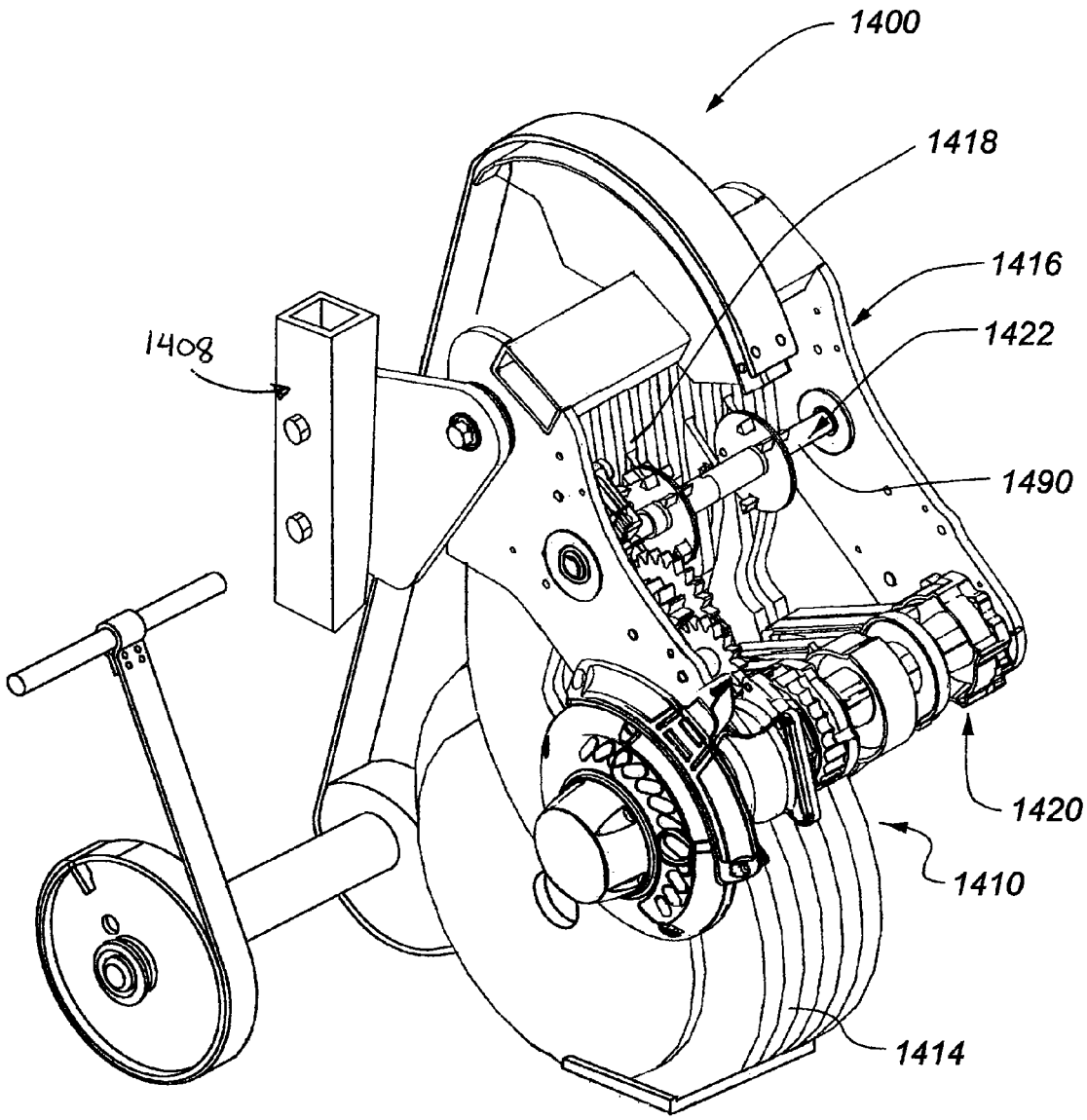
FIG. 58 is an isometric view similar to FIG. 57 where the shroud and frame are removed for clarity.
Figure 59:
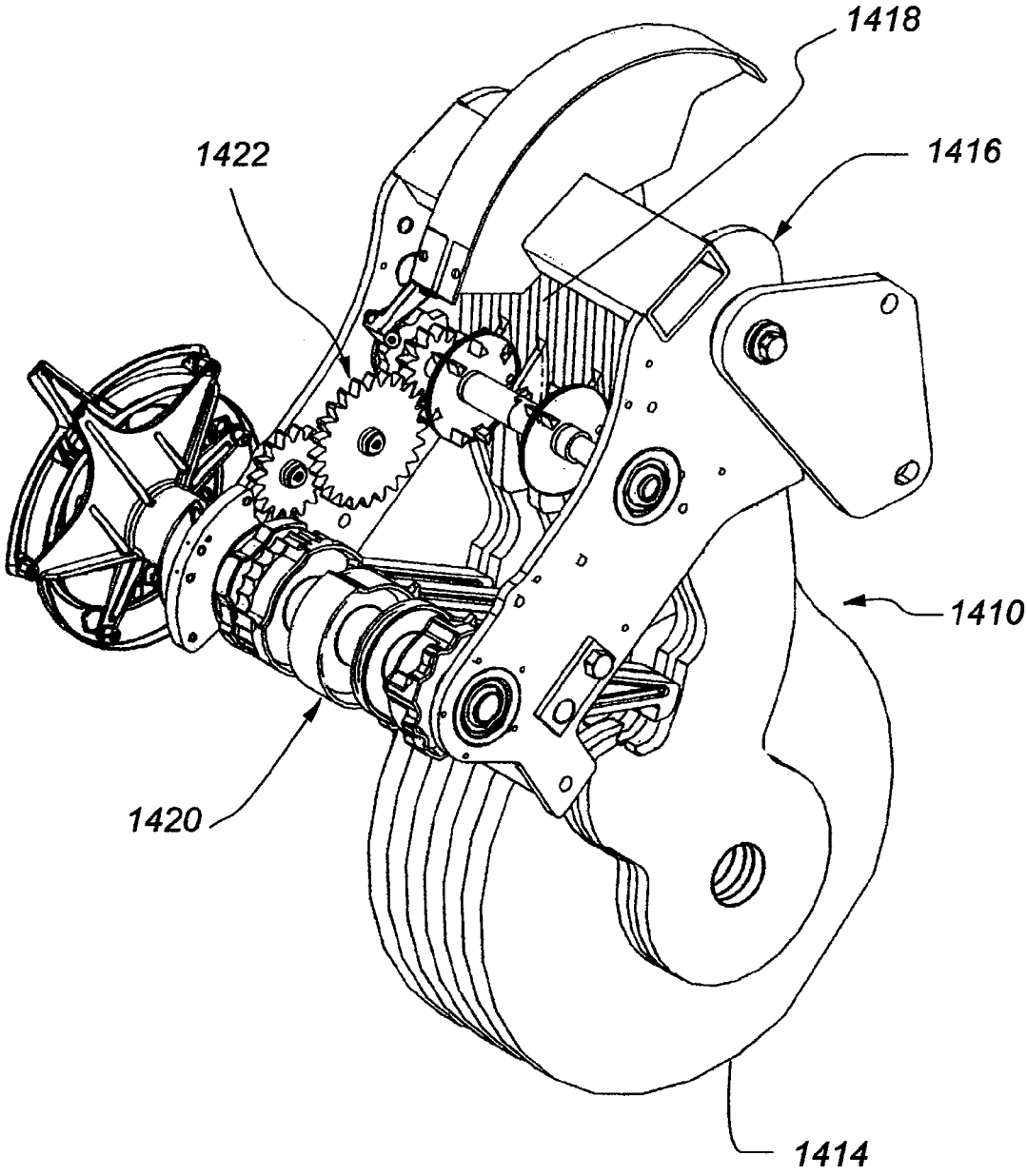
FIG. 59 is another isometric view of the machine depicted in FIG. 56 wherein the shroud, frame, force transfer mechanism, and exercise member for the machine are removed for clarity.

Referring to FIGS. 58 and 59, the weight exercise machine 1400 as illustrated in FIG. 57 is shown in FIG. 58 without the shroud 1412 and main frame 1408, and is shown at another angle without the shroud 1412, the main frame 1408, the force transfer mechanism 1404, and the exercise member 1402. The weight system 1410 may include a set of pivotal main weights or weight plates 1414 selectively coupled to a sub-frame 1416 pivotally supported by the main frame 1408 and a set of add-on weights 1418 that are also selectively coupled to the sub-frame 1416. The main weights 1414 may be selectively attached to the sub-frame 1416 using a main indexed system 1420, and the add-on weights 1418 selectively attached by an add-on indexed system 1422. The main indexed system 1420 and the add-on indexed system 1422 will be described separately as well as in combination for ease of understanding. Variations in these systems will also be described.

Figure 60:
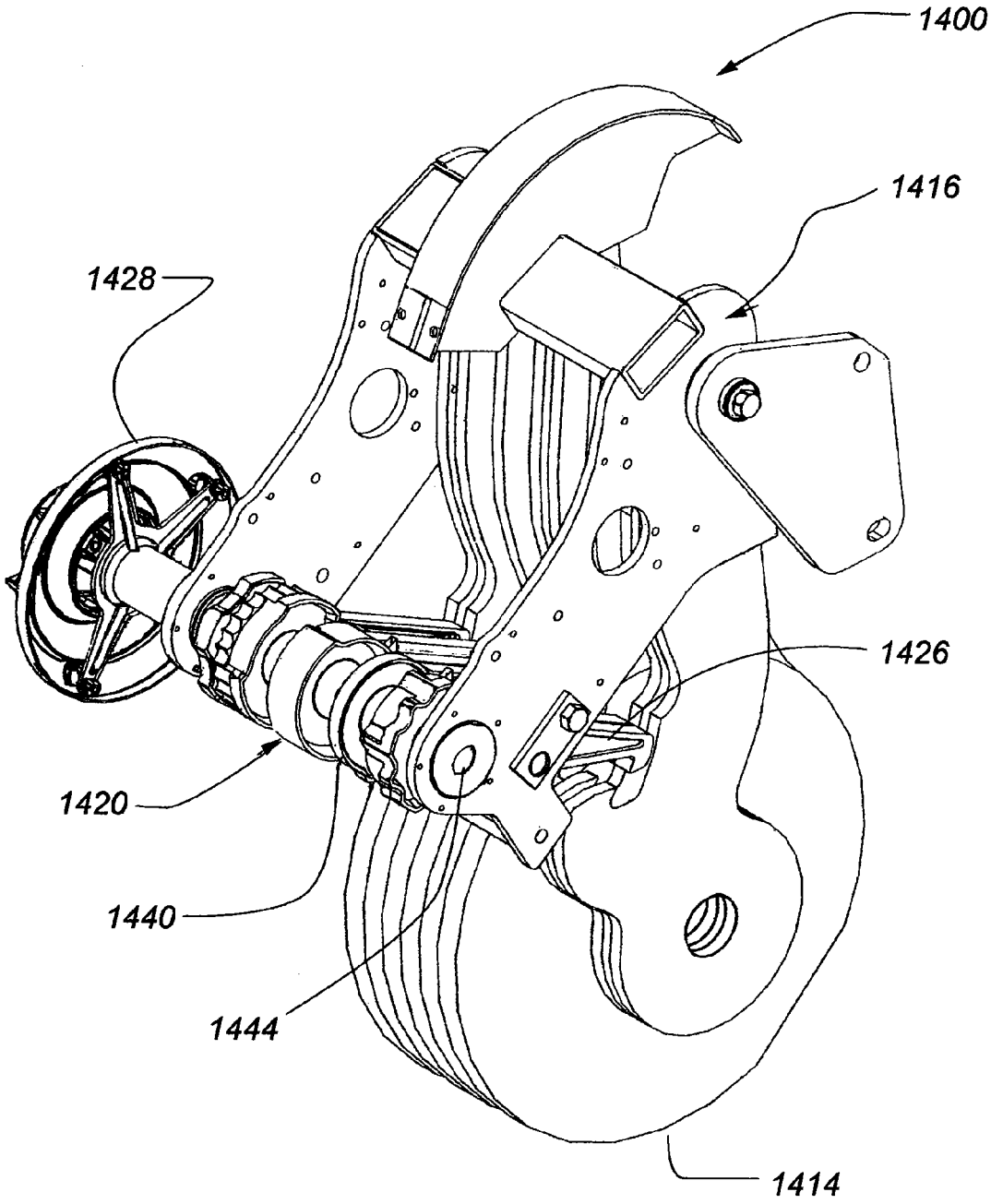
FIG. 60 is an isometric view similar to FIG. 59 with the add-on weight system removed.
Figure 61:
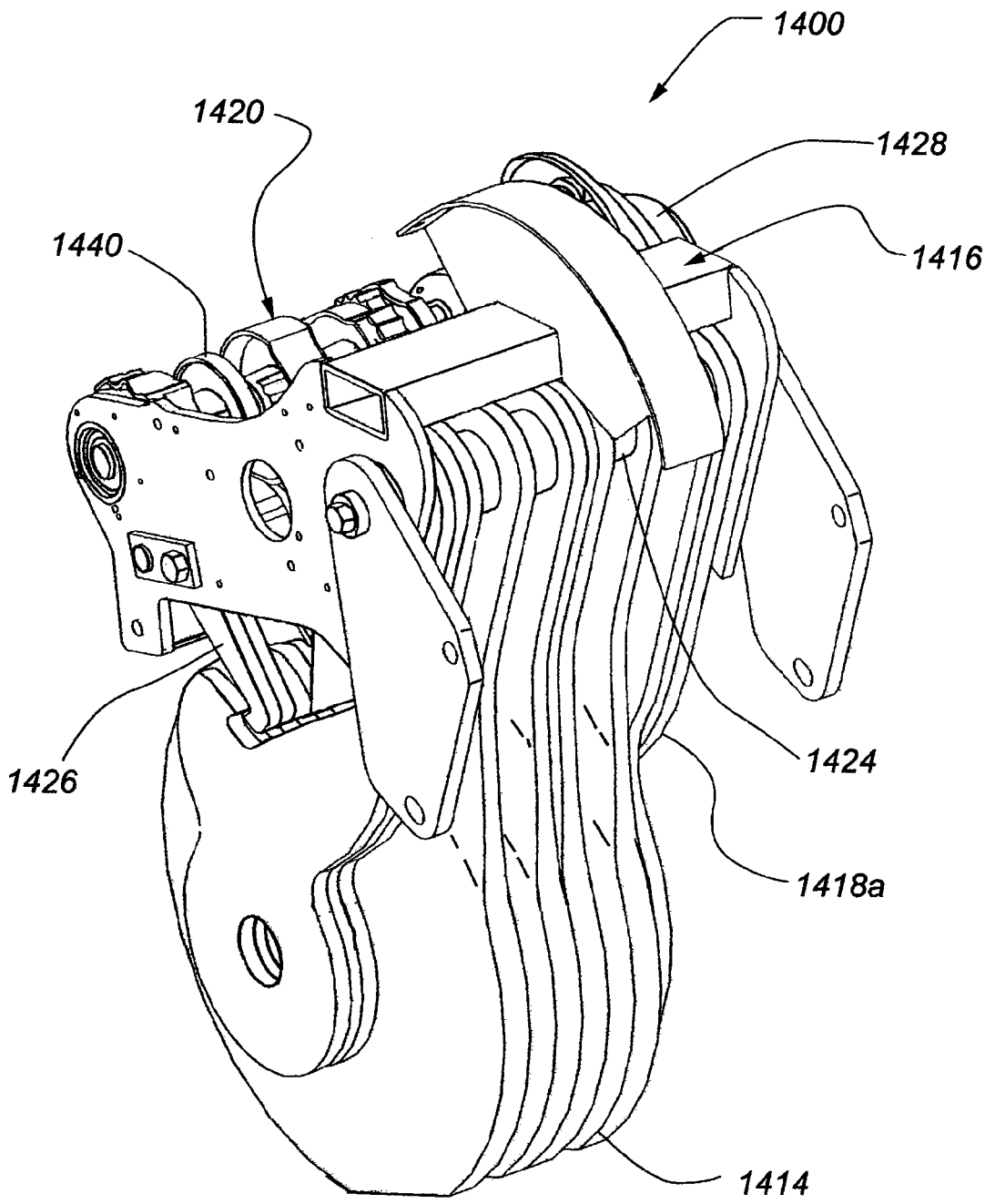
FIG. 61 is an isometric view looking at the rear of the machine with the add-on system removed.

Now turning to FIGS. 60 and 61, the weight exercise machine 1400 as illustrated in FIGS. 58 and 59 is shown in FIGS. 60 and 61 at various angles without the add-on weights 1418 and the add-on indexed system 1422. The main weights or weight plates 1414 are pivotally suspended from a pivot shaft 1424 (see FIG. 61) and are adapted to be selectively pivoted about the shaft 1424 through selective operative engagement with the sub-frame 1416 through the main indexed system 1420. The main indexed system 1420 may include hook arms 1426 configured to selectively engage or disengage one or more main weight plates 1414 for carrying the engaged weight plates 1414 through pivotal movement of the sub-frame 1416. The sub-frame 1416 pivots about the pivot shaft 1424 when the force transfer mechanism 1404 moves the sub-frame 1416 in a manner similar to the one described in the previous embodiments. This embodiment of the weight exercise machine 1400 differs in part from the prior embodiments in that the hook arms 1426 forming part of the main indexed system 1420 are normally engaged with an associated main weight plate 1414 and are selectively disengaged by rotative movement of an index wheel or dial 1428 associated with the hook arms 1426 in a manner to be described hereafter.

Figure 62:
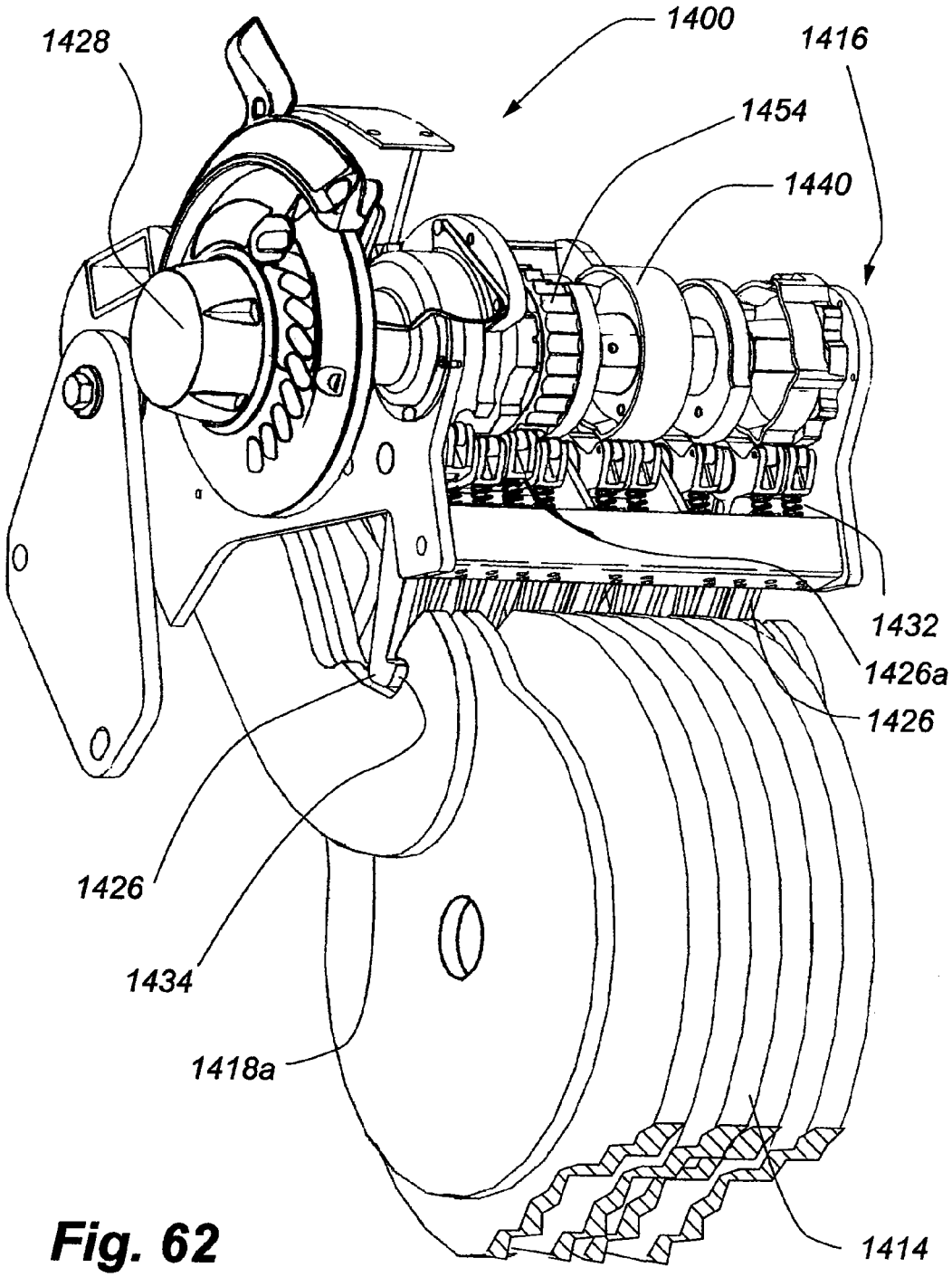
FIG. 62 is an isometric looking at the front of the machine with the add-on weight system removed.
Figure 63:
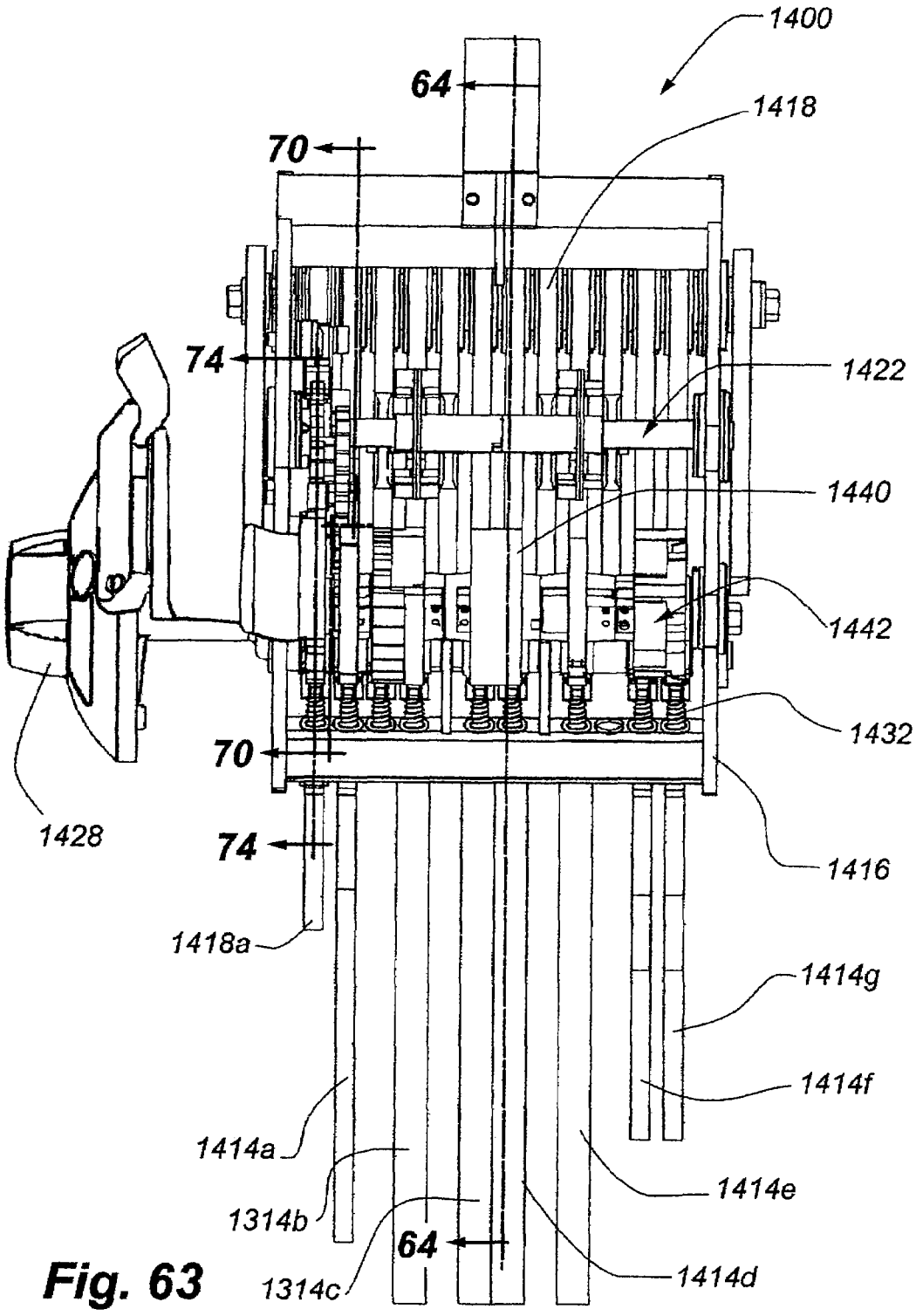
FIG. 63 is a front elevation view of the machine as shown in FIG. 59.
Figure 64:
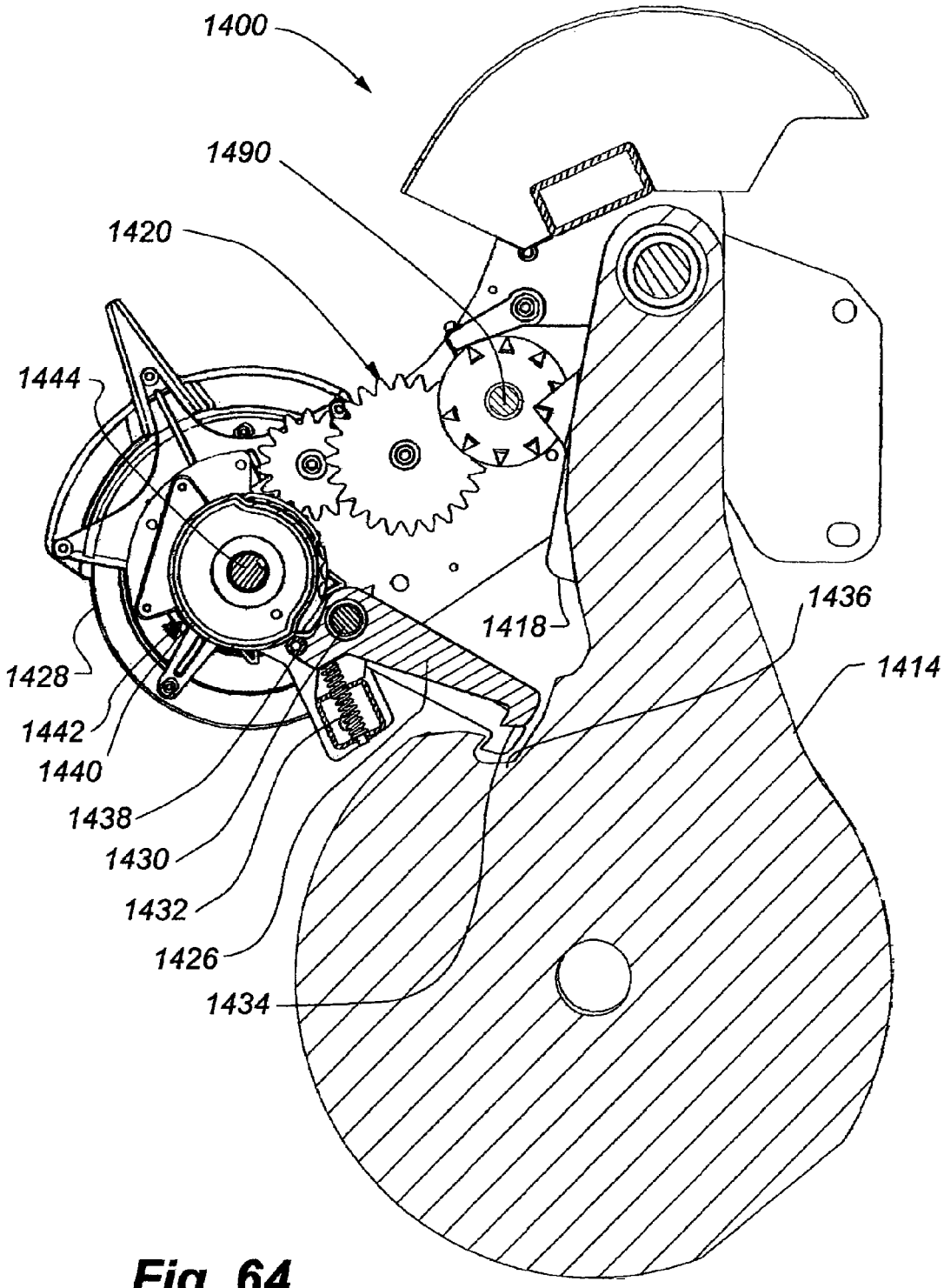
FIG. 64 is a section view of the machine taken along line 64-64 of FIG. 63.

FIG. 62 shows another perspective view of the weight exercise machine 1400 with similar components removed as in FIGS. 60 and 61. FIG. 63 shows yet another view of the weight exercise machine 1400 as shown in FIG. 62 except the add-on weights 1418 and the add-on indexed system 1422 are also shown in this figure. FIG. 64 is a cross-section view of the weight exercise machine 1400 taken along line 64-64 in FIG. 63. With reference to FIGS. 62-64, the hook arms 1426 are independently pivotal about a hook arm shaft 1430 (see FIG. 64) and are spring biased with independent springs 1432 into engagement with selected weights 1414 so a tip 1434 of a hook arm 1426 is normally positioned within a catch or slot 1436 (see FIG. 64) provided in an associated weight plate 1414. With reference to FIG. 64, each hook arm 1426 has a follower-roller 1438 at an end opposite the tip 1434. The follower-roller 1438 is adapted to ride along the peripheral edge of an associated cam 1440 of the main indexed system 1420 so as to sequentially engage raised and lowered segments of the cam's peripheral edge.

Figure 65:
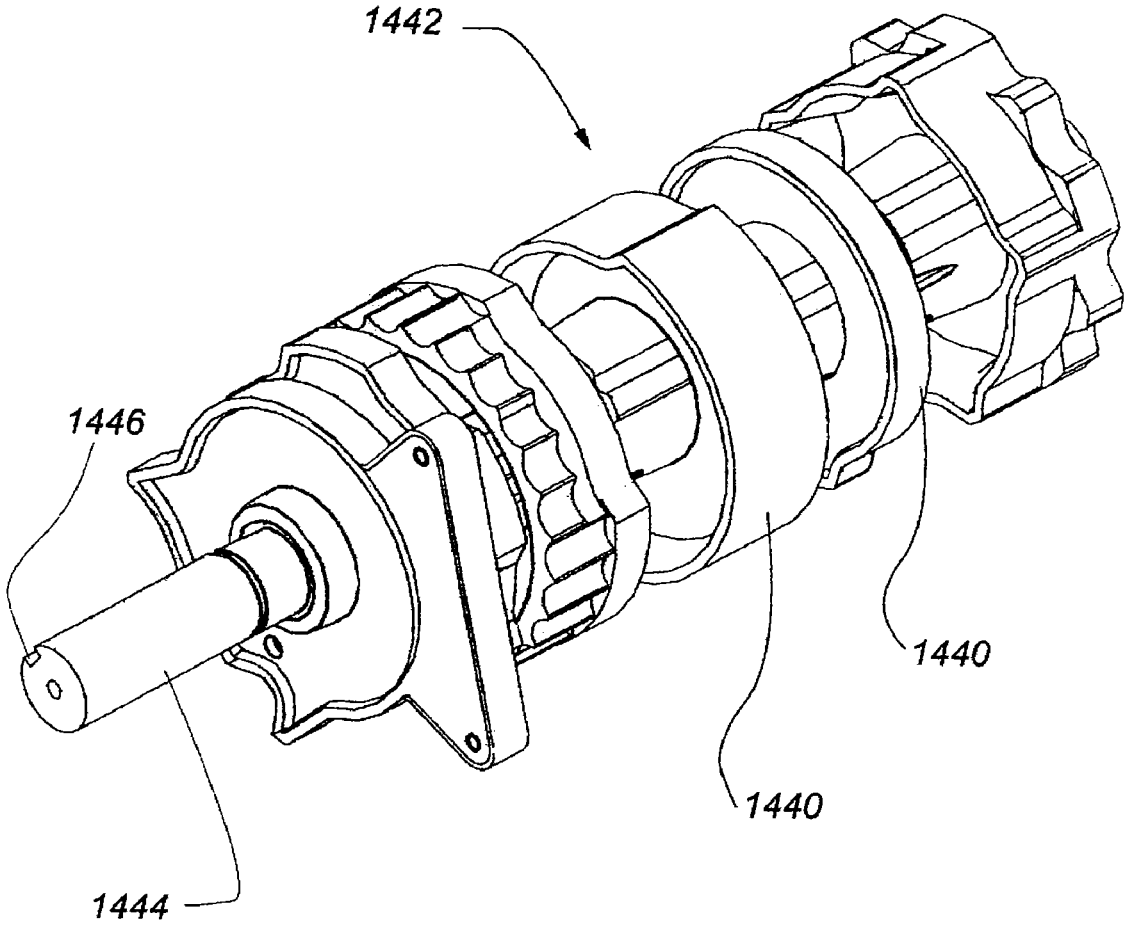
FIG. 65 is an isometric view of the cam mechanism used in the main weight system of the machine shown in FIG. 57.
Figure 66:
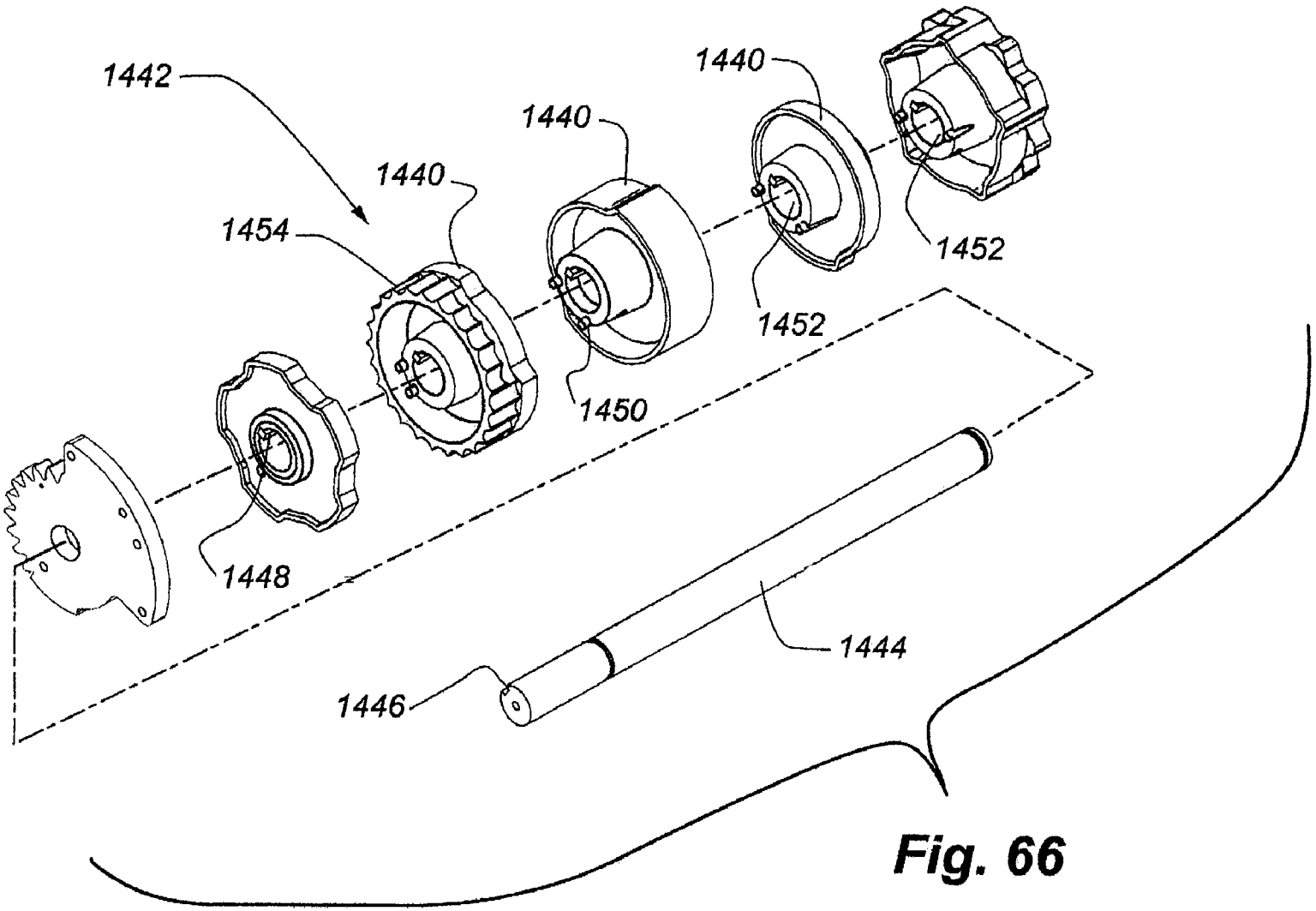
FIG. 66 is an exploded isometric view of the cam mechanism shown in FIG. 65.

The cam mechanism 1442 for the main weights 1414 may be best shown in FIGS. 65 and 66. Two or more cams 1440 with varying predetermined peripheral configurations are joined to a pivot or cam shaft 1444 for unitary movement therewith. The cam shaft 1444 may include a cam groove or slot 1446 for receiving a cam tab 1448 formed on a cam 1440 to cause the associated cam 1440 to coaxially rotate with the shaft 1444. Each cam 1440 may have cam tab 1448 formed on it.

Alternatively, less than all of the cams 1440 may have a cam tab 1448 formed on them. When fewer than all cams 1440 have a cam tab 1448 formed on them, the cams 1440 without cam tabs 1448 may be joined, directly or indirectly, with other cams 1440 that have a cam tab 1448 such that rotation of the cam 1440 with a cam tab 1448 will cause rotation of the cam 1440 without a cam tab 1448. Such a connection may be achieved, for example, by providing a cam 1440 with one or more cam prongs 1450 received within cam prong holes in an adjacent cam 1440.

Yet further, in lieu of or in combination with a cam slot 1446 and cam tab 1448 system, the cam shaft 1444 may take the form of a non-circular shaped cross-section along at least a portion of its length, such as a square, oval, or D-shaped cross-section, and a cam shaft hole 1452 of a cam 1440 receiving the cam shaft 1444 may take the form of a non-circular shaft that matches the cam shaft's 1444 shape such that the cam 1440 rotates with the cam shaft 1444. Yet still further, in lieu of or in combination with any of the previously described means for joining a cam 1440 to a cam shaft 1444 and/or other cams 1440, each cam 1440 may be joined for rotation to the cam shaft 1444 or to another cam by welding, mechanical fastening, adhering, by any other suitable connection method, by integrally form the cam 1440 with the cam shaft 1444, or by any combination thereof.

Returning to FIG. 60, the index wheel or dial 1428 may be mounted on the cam shaft 1444 for coaxial rotation therewith. Like the cams 1440, the index wheel or dial 1428 may be mounted for coaxial rotation using a slot and groove type system, an interconnection system between the index wheel 1428 and a cam 1440 joined to the cam shaft 1444 for rotation with the cam shaft 1444, by welding, mechanically fastening, adhering, by using some other suitable connection method, by integrally forming the index wheel 1428 with the cam shaft 1444, or by any combination of the foregoing.

With reference to FIGS. 60-64, each cam 1440 may be uniquely designed and aligned with an associated main weight 1414 of a predetermined weight value so that depending upon the circumferential position of a cam 1440 relative to the follower-roller 1438 on an associated hook arm 1426 (see FIG. 64), selected hook arms 1426 are pivoted about the hook arm shaft 1430 to remove the tip 1434 from the catch 1436 (see FIG. 64) in its associated weight 1414 or allow the tip 1434 of the hook arm 1426 to remain in the catch 1436 as desired.

As in previously described embodiments for a weight machine, the index wheel or dial 1428 may include indicia carried thereon indicative of various weights in select increments, such as ten pound increments, up to a predetermined maximum weight. Selected weights 1414 may be operatively engaged with their associated hook arms 1426 depending upon the total weight set on the index wheel 1428 as desired for an exercise. If, for example, 20 pounds of weight were desired, the cam 1440 associated with a 20-pound weight 1414 would remain engaged with its associated hook arm 1426 while all other hook arms 1426 associated with the main weights 1414 would be pivoted upwardly as viewed in FIG. 64 so as to be removed from operative engagement with an associated weight plate. Thereafter, when the pivotal sub-frame 1416 is pivoted about its pivot shaft 1424 by the force transfer mechanism 1404 (shown in FIG. 57), the 20-pound weight plate 1414 associated with its designated cam 1440 and hook arm 1426 is lifted in pivotal movement about the pivot shaft 1424 while the remaining main weight plates 1414 rest on the main frame 1408 (see FIG. 57) operatively detached from the pivotal sub-frame 1416.

Turning back to FIG. 66, the cam mechanism 1442 not only has one or more cams 1440 but may also include a positioning wheel 1454 mounted on the cam shaft 1444. In a manner similar to the methods described above for the cams 1440, the positioning wheel 1454 may be mounted on the cam shaft 1444 to rotate coaxially with the cam shaft 1444. The position wheel 1454 may be integrally formed with a cam 1440 as depicted in FIG. 66, or may be an individual component that is not integrally formed or otherwise fixedly connected to any of the cams 1440.

Turning now to FIG. 62, the positioning wheel 1454 may be associated with a hook arm 1426*a* that rides along a scalloped peripheral edge of the positioning wheel 1454 so as to provide a positive tactile and/or audible response to rotative movement of the index wheel 1428 between the various possible positions of the cam shaft 1444 (shown in FIG. 60) and the cams 1440 that are mounted for fixed rotational movement therewith. Such tactile and/or audible response may provide an indication to a user when a predetermined weight load is successfully selected by the user.

This embodiment of the weight exercise machine 1400 differs from that of the previously described embodiments in that the index wheel 1428 is mounted coaxially with the cam shaft 1444 and therefore requires no gearing between the index wheel 1428 and the cam shaft 1444. Further, the main weight plates 1414 are normally engaged with their associated hook arms 1426 rather than disengaged.

Figure 67:
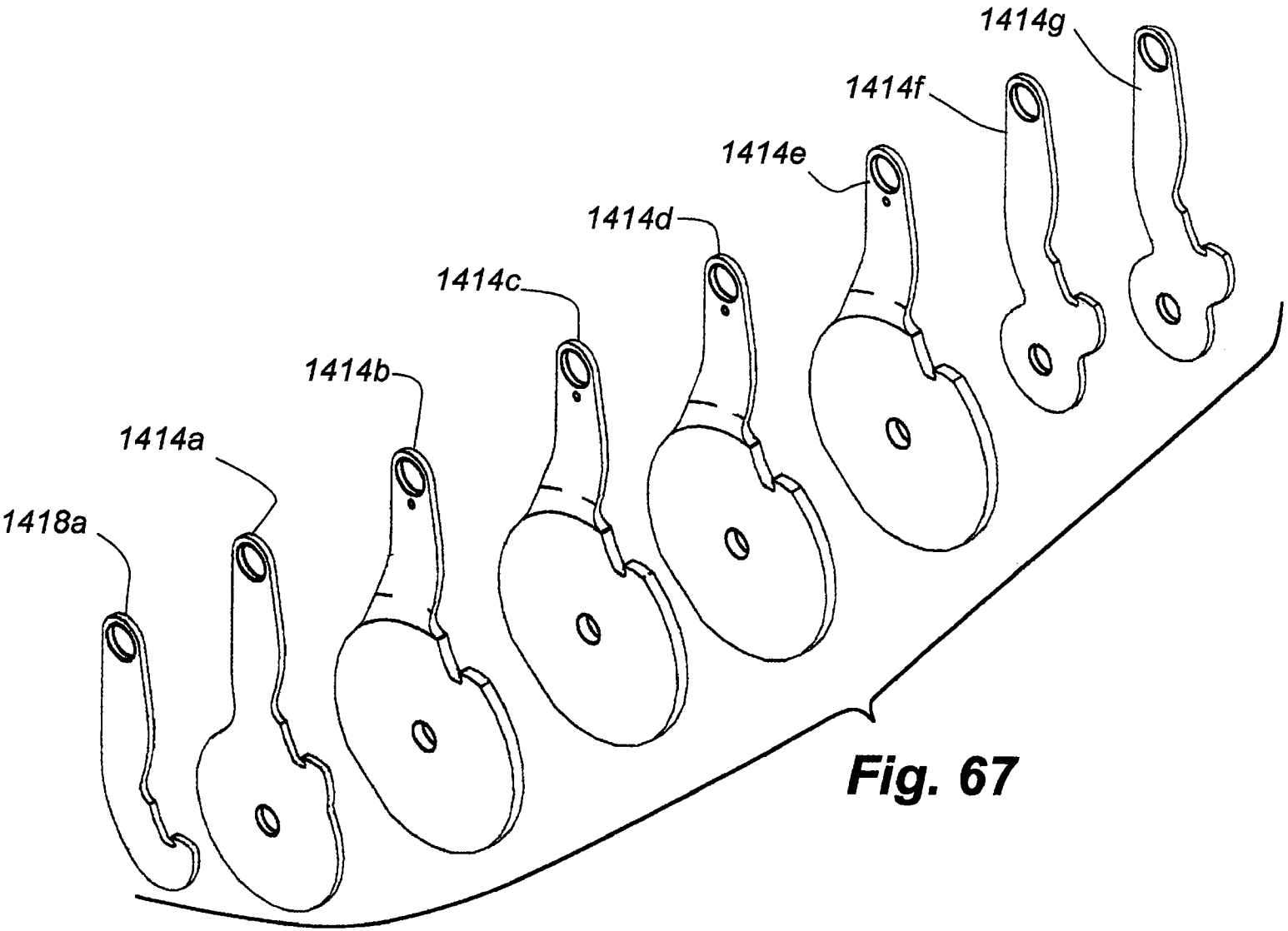
FIG. 67 is an isometric of the main weights for the machine shown in FIG. 57.

The various sizes and configurations of one potential setup for the main plates 1414*a-g* can be seen in FIGS. 63 and 67 among other figures. The configuration of the main weights 1414*a-g* may be generally similar to the main weight configuration described with reference to the first embodiment or may take any other suitable configuration.

With reference to FIGS. 63 and 67 and beginning at the index wheel 1428 end of the stack of weights, there is first a 5-pound add-on weight 1418*a* (to be described later), then a 20-pound main weight 1414*a*, then a 50-pound main weight 1414*b*, then two 50-pound main weights 1414*c-d* (that can be connected into one 100-pound plate), then another 50-pound main weight 1414*e* and finally two 10-pound main weights 1414*f-g*. The sub-frame 1416 including the cam mechanism 1442 may also weigh 10 pounds. Accordingly, the total weight of the seven main weights 1414*a-g* and the sub-frame 1416 in this configuration is 250 lbs, wherein by selectively varying the number of main weights 1414*a-g* joined to the sub-frame 1416, a user may select a resistance from 10 to 250 lbs in 10 lb increments. However, it is further envisioned that variations in the total number of main weights 1414, the configurations illustrated, and/or the weight of each main weight 1414 can also be made. These changes may include, but are not limited to, using more or less main weights 1414 and/or different weight values for the main weights 1414 to change the range of resistance available for selection by a user and/or the increment of the resistance within the resistance range.

Referring to FIGS. 62 and 68-75, one possible add-on weight system will be described. The add-on weight system may take the form of the 5-pound weight plate 1418*a* positioned proximate the main weights 1414*a-g* as described above, and four 1-pound add-on weights 1418*b*, 1418*c*, 1418*d* and 1418*e*. In a second option, the add-on weight system may include just the 5-pound weight 1418*a*. In the first option, the machine could achieve selected weights in 1-pound increments from 1 to 9 pounds while in the second option the machine could achieve selected weights in only 5-pound increments.

Figure 68:
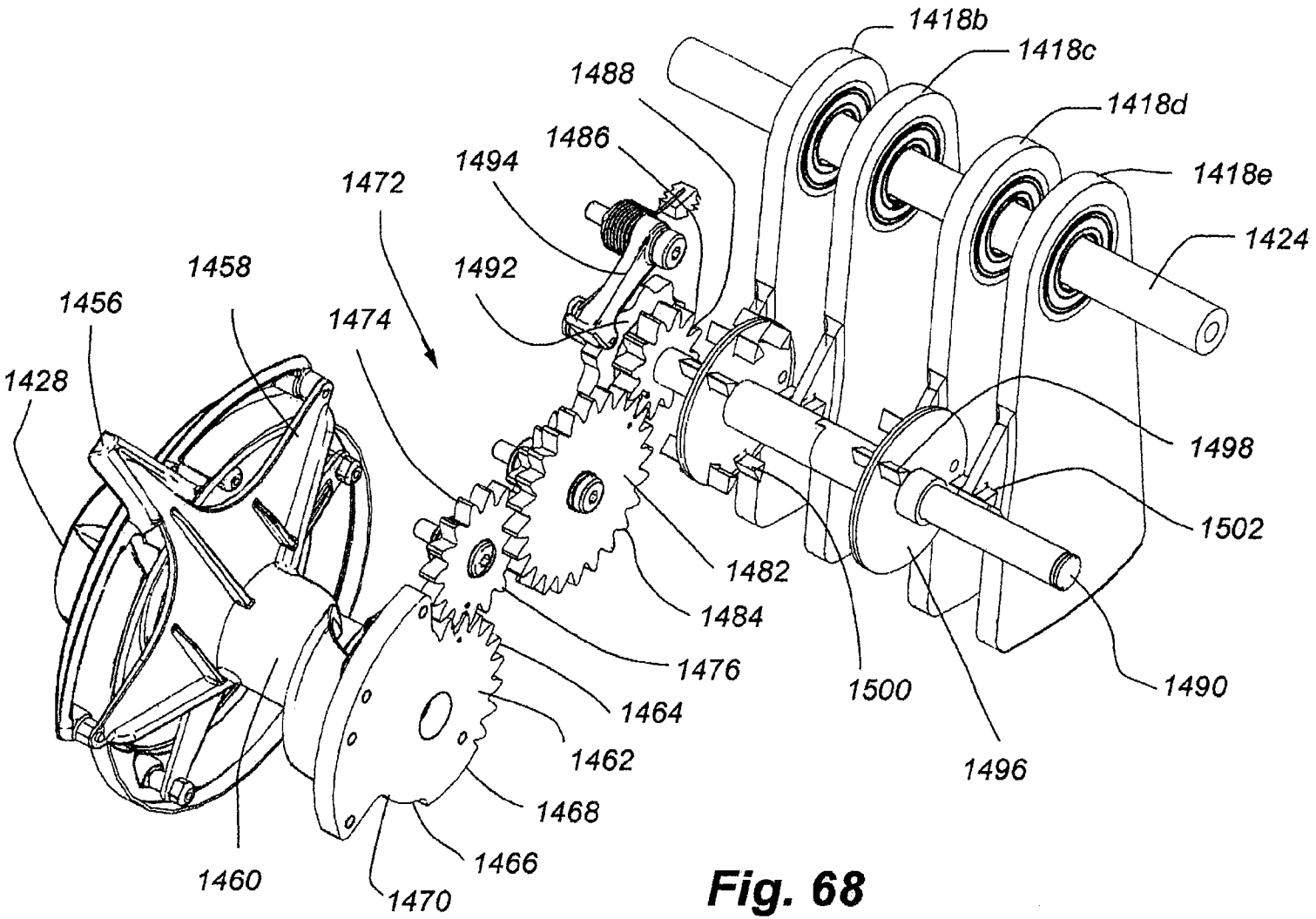
FIG. 68 is an isometric view from the right side of the add-on system of the machine shown in FIG. 57.
Figure 69:
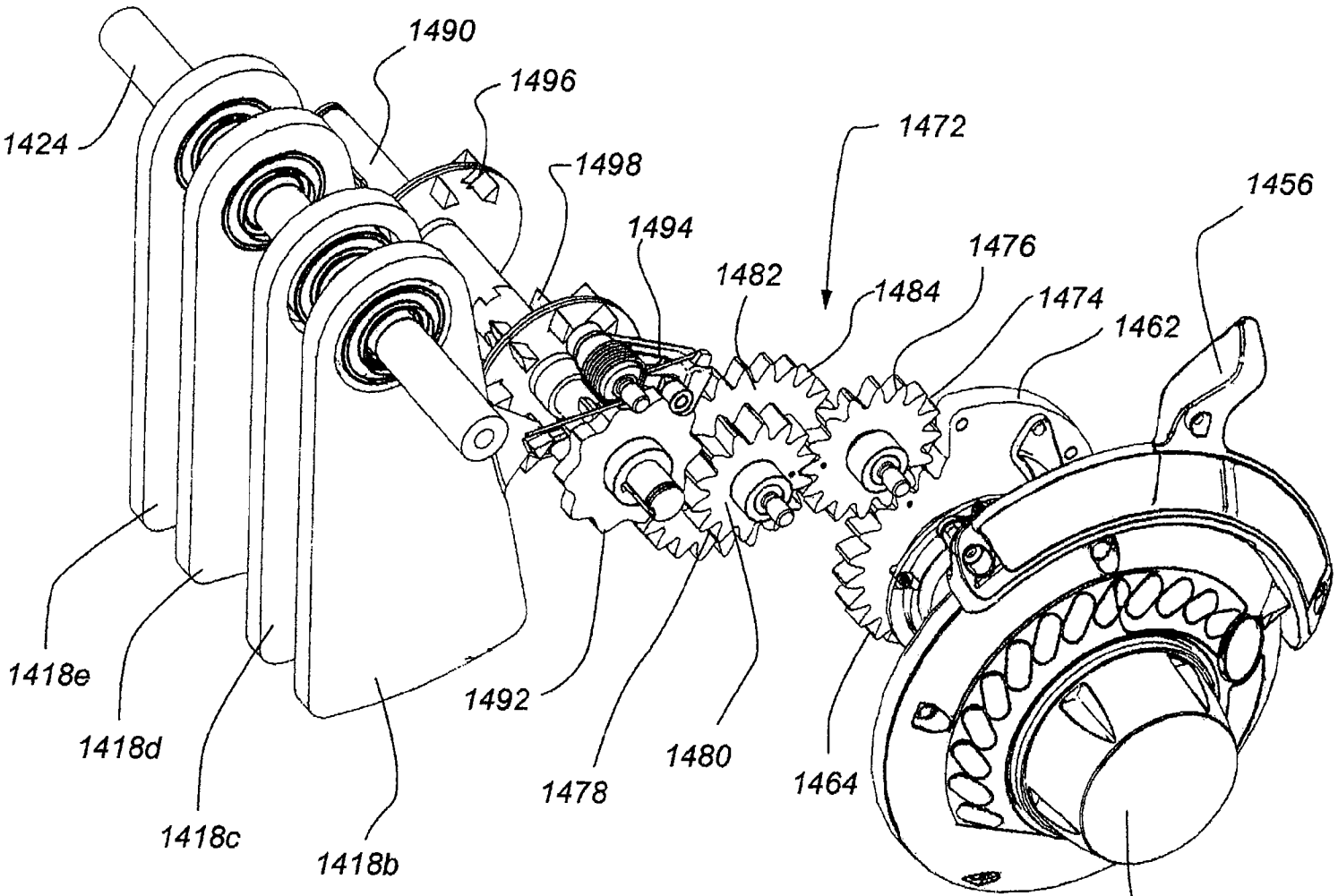
FIG. 69 is an isometric view from the left (or user) side of the add-on system of the machine shown in FIG. 57.
Figure 70:
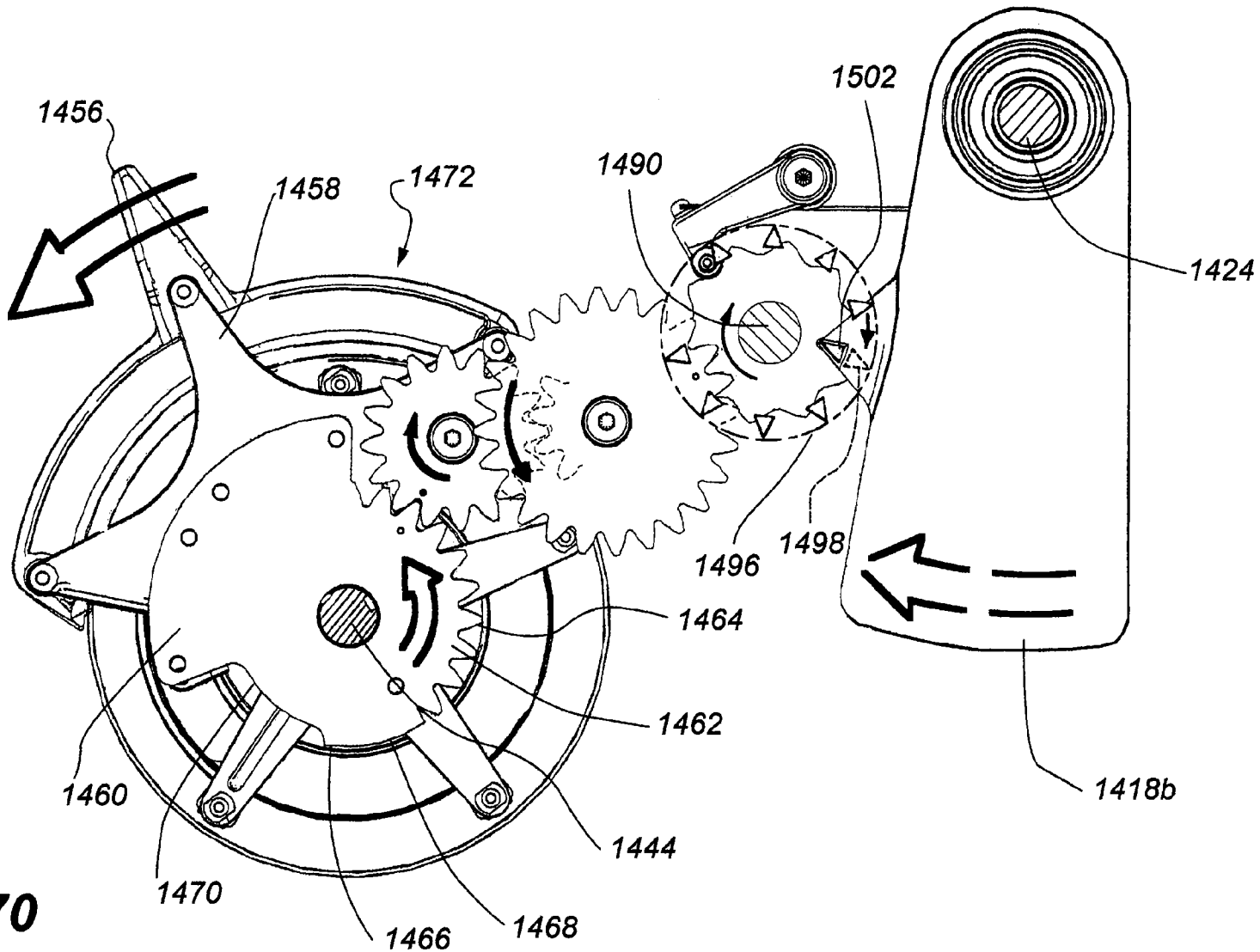
FIG. 70 is a section view taken along line 70-70 of FIG. 63 with the sub-frame omitted for clarity.
Figures 71, 72:
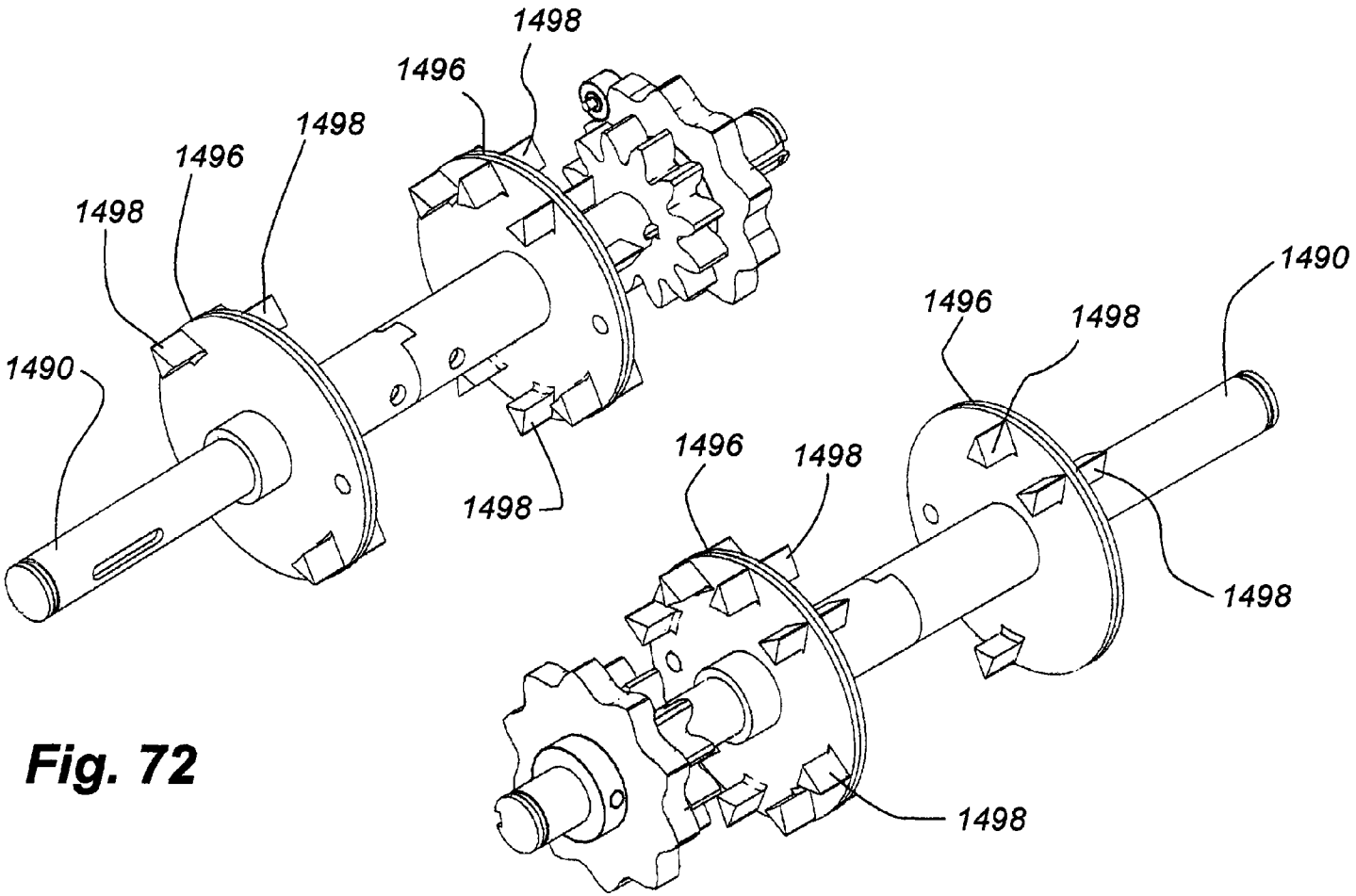
FIG. 71 is an isometric view of the lift mechanism associated with the add-on weights.
FIG. 72 is an isometric view of the lift mechanism shown in FIG. 75 from an opposite angle.

With primary reference to FIGS. 68-70, the add-on weight system for the first option may include an add-on toggle 1456 coaxially mounted to the main weight cam shaft 1444 adjacent to the index wheel or dial 1428. The add-on toggle 1456 may be mounted to pivot or rotate about the axis of the main weight cam shaft 1444. The add-on toggle 1456 may further include indicia indicating weights between one and nine pounds. By pivoting or otherwise moving the add-on toggle 1456 relative to the main weight cam shaft 1444, the add-on weights 1418*a-e* can be individually engaged and disengaged with the sub-frame 1416 (sub-frame 1416 not shown in FIGS. 68-70 for clarity of the add-on weight system) to aggregate with the main weights 1414*a-g* (shown in FIG. 62 and other figures) so that resistances in 1-pound increments between 1 and 9 pounds are obtainable.

As shown in FIGS. 68 and 70 and other figures, the add-on toggle 1456 may be mounted on a star base 1458 including an add-on toggle hub 1460 forming a bearing on the main weight cam shaft 1444. The add-on toggle hub 1460 carries on its end closest to the main weights 1414*a-g* a partial gear wheel 1462 including gear teeth 1464 along one portion of its periphery and an add-on gear cam surface 1466 with an elevated 1468 and a lowered 1470 segment along another portion of its periphery. The partial gear wheel 1462 is operatively associated with a gear train 1472 rotatably mounted on the sub-frame 1416 (sub-frame 1416 not shown in FIGS. 68 and 70 for clarity of the add-on weight system).

Turning to FIGS. 68 and 69 among other figures, the gear teeth 1464 of the partial gear wheel 1462 mesh with the gear teeth 1474 of a first small gear 1476 in the gear train 1472 that in turn mesh with the gear teeth 1478 of a second small gear 1480 that is fixed to a large gear 1482. The gear teeth 1484 of the large gear 1482 mesh with the gear teeth 1486 of a third small gear 1488 fixed to a lift shaft 1490 of the add-on weight system. The third small gear 1490 may be keyed to a positioning wheel 1492 including two or more equally spaced notches or scallops formed in its peripheral surface for engagement with a spring-biased snap arm 1494 that follows the contour of the positioning wheel 1492 to provide audible and/or tactile feedback to an operator between the various positions of the add-on toggle. As shown in FIG. 58 and other figures, the lift shaft 1490 itself is pivotally mounted on the pivotal sub-frame 1416 for movement with the sub-frame 1416 and for independent rotational movement about its own axis.

With reference to FIGS. 68-71 among other figures, the lift shaft 1490 carries two lift wheels 1496, which may be keyed to the lift shaft 1490, or otherwise joined to the light shaft 1490 in a manner similar one described above for joining the cams 1440 to the main cam shaft 1444, for rotation therewith. Each lift wheel 1496 may include one or more circumferentially, but differently spaced tabs or dogs 1498 on opposite faces thereof. There are a different number of dogs 1498 on each face so that individual add-on weights 1418*b-e* may be selectively engaged with the lift shaft 1490 in any desired combination, as will be explained hereafter. Each dog 1498 may be generally pyramidal in shape so as to define a generally flat and radially inward directed face 1500 for a purpose to be described hereafter.

With particular reference to FIGS. 68 and 69, each 1-pound add-one weight 1418*b-e* is pivotally supported on pivot shaft 1424, which sub-frame 1416 also pivots around as described above. The 1-pound add-on weights 1418*b-e* can only be moved from their rest position through operative engagement with a dog 1498 on an associated lift wheel 1496. Such engagement results in the pivoting of any engaged 1-pound add-on weight 1418*b-e* around pivot shaft 1424 when sub-frame 1416 is pivoted around pivot shaft 1424.

Figure 73:
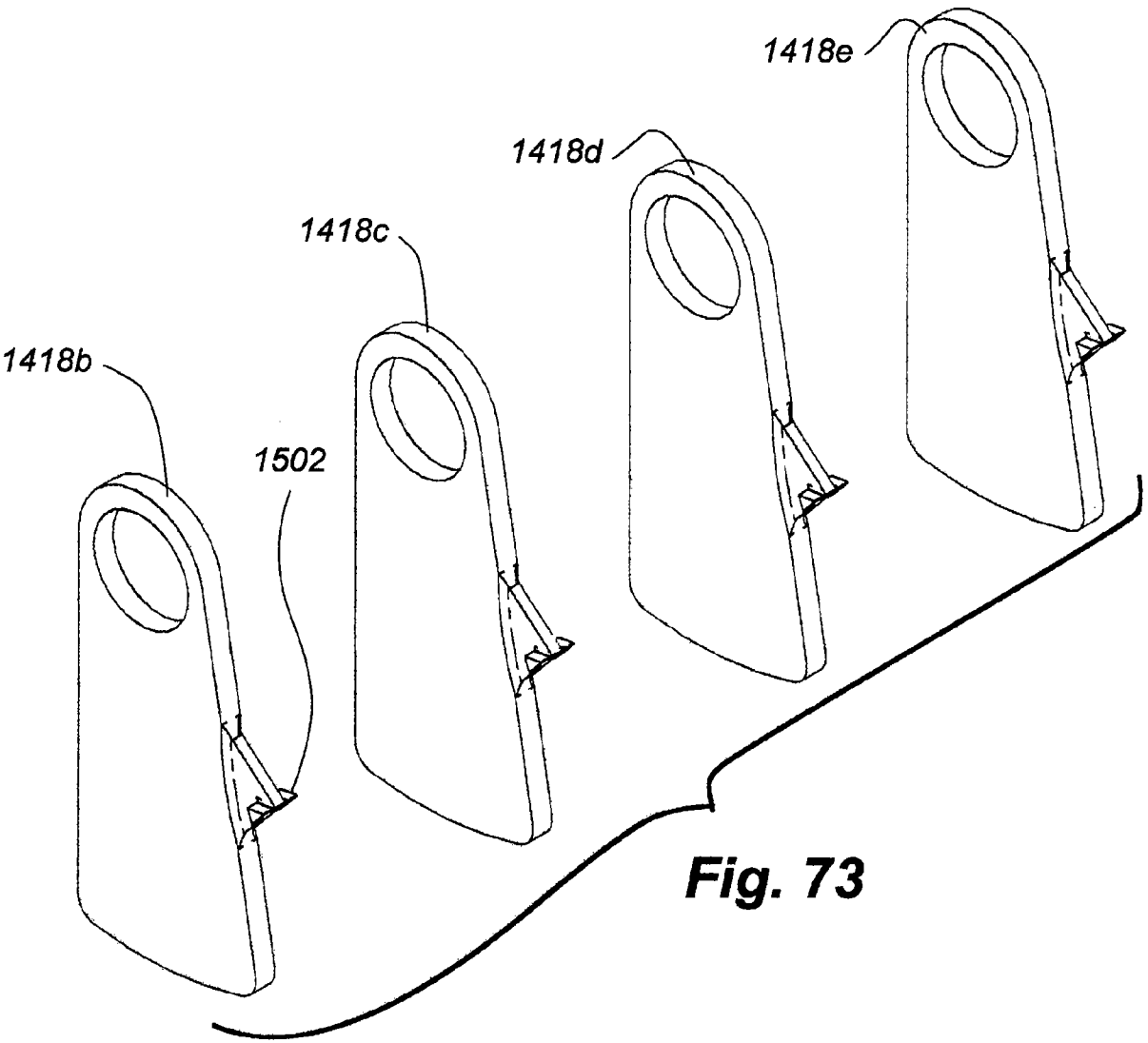
FIG. 73 is an isometric view of the add-on weights.

Turning to FIGS. 68 and 73, each of the 1-pound add-on weights 1418*b-e* may be planar in configuration and may include a lift tab 1502 projecting from one edge thereof toward an associated lift wheel 1496. The four 1-pound add-on weights 1418*b-e* may be mounted on the pivot shaft 1424 so as to be in adjacent planar alignment with one side or face of one of the lift wheels 1496 so that each 1-pound add-on weight 1418*b-e* is associated with at least one side of one of the lift wheels 1496. The lift tabs 1502 are sized to fit between adjacent dogs 1498 on an associated side of an associated lift wheel 1496 to avoid engagement between the lift tabs 1502 and the lift wheel 1496 when pivoting the sub-frame 1416 around the pivot shaft 1424. The lift tabs 1502 are also positioned radially inward of the dogs 1498 on the associated side of the associated lift wheel 1496 when the sub-frame 1416 is in its rest position so that upon rotation of the lift wheel 1496, the dogs 1498 on the lift wheel 1496 can be positioned radially outward of a lift tab 1502 of an associated 1-pound add-on weight 1418*b-e* if that particular 1-pound add-on weight is desired to be included in an exercise as shown, for example, in FIG. 70. With reference to FIG. 70, a 1-pound add-on weight 1418*b* is shown in a position aligned with a dog 1498 shown in dashed lines so that upon pivotal movement of the lift shaft 1490 with the sub-frame 1416 around pivot shaft 1424, the dog 1498 engages the lift tab 1502 on the add-on weight 1418*b*, thus pivoting the add-weight 1418*b* around pivot shaft 1424 with the pivoting of lift shaft 1490 around pivot shaft 1424.

With continued reference to FIG. 70, the add-on toggle 1456 is correlated through the gear train 1472 described previously so that dependent upon whether 1, 2, 3, or 4 pounds of weight are desired to be added to the selected weights in the main weight system for a particular exercise, the dogs 1498 on the lift wheels 1496 are radially aligned with the lift tabs 1502 of the add-on weights 1418*b-e* such that the number of selected 1-pound add-on weights 1418*b-e* lifted with the sub-frame 1416 correspond to the desired additional weight. The lift tabs 1502 for the add-on weights 1418*b-e* that are not desired for an exercise will pass between the dogs 1498 of an associated lift wheel 1496 so that no dog 1498 will engage the lift tab 1502 of that add-on weight.

With reference to FIGS. 63, 64, 68, 69 and other figures, the gear ratio of gear train 1472 extending from the partial gearwheel 1462 to the lift shaft 1490 may be sized such that circumferential movement of the first small gear 1476 along the geared portion of the partial gear wheel 1462 rotates the lift shaft 1490 through substantially two revolutions. During each revolution, each of the four 1-pound add-on weights 1418*b-e* can be selected or deselected so as to add one, two, three, or four pounds to the main weights 1414*a-g* for movement with the pivotal sub-frame 1416. Before the second revolution, however, all of the 1-pound add-on weights 1418*b-d* are dropped from the lift wheels 1496 and the 5-pound weight 1418*a* carried on the main cam shaft 1444 with the main weights 1414*a-g* is picked up so as to be carried by the pivotal sub-frame 1416 during an exercise program.

After the 5-pound weight has been picked up through movement of the add-on toggle 1456, the 1-pound add-on weights 1418*b-e* are again sequentially picked up so that six, seven, eight, or nine pounds of weight can be picked up for addition to the main weights 1414*a-g* for use in a given exercise. In other words, while the cam shaft 1444 is operative to select any desirable amount of weight between 10 and 250 pounds using the main weights 1414*a-g*, additional weight in 1-pound increments up to nine additional pounds can be added through the add-on weight system.

Although the gear ratio of the gear train 1472 has been described as causing approximately two revolutions of lift shaft 1490 to add between 1 and 9 pounds of weight in 1-pound increments, the gear train 1472, the lift wheels 1496, and the add-on weights 1418*a-e* may be configured for such a range to be provided in more or less than two revolutions of lift shaft 1490. Further, the number of add-on weights 1418*a-e*, the number of associated lift wheels 1496, and/or the weight of the add-on weights may be varied to provide any desired add-on weight range and increment. Yet further, for a given number of add-on weights 1418*b-e* pivotally joined to lift shaft 1490, two lift wheels 1496 may be associated with one or more of each such add-on weight 1418-*e* to provide engagement on both sides of an add-on weight 1418*b-e* when engaging the add-on weight 1418*b-e* with the lift shaft 1490. Such dual support may provide better support of an add-on weight by the associated lift wheels 1496 and/or may provide a more uniform load distribution on the lift shaft 1490. On the other hand, engaging just one side of the add-on weight 1418*b-e* as shown in the figures with a lift wheel 1496 allows for a minimal number of required lift wheels 1496 to engage a given number of add-on weights 1418*b-e*.

Although a gear train 1472 is described for selectively engaging and detaching the add-on weights 1418*b-e* associated with the lift shaft 1490 by movement of the add-on toggle 1456, other mechanical systems, including, but not limited to, cables and pulleys, mechanical links, combinations of the foregoing systems, and so on may be used to achieve such selective engagement and detachment.

Figure 74:
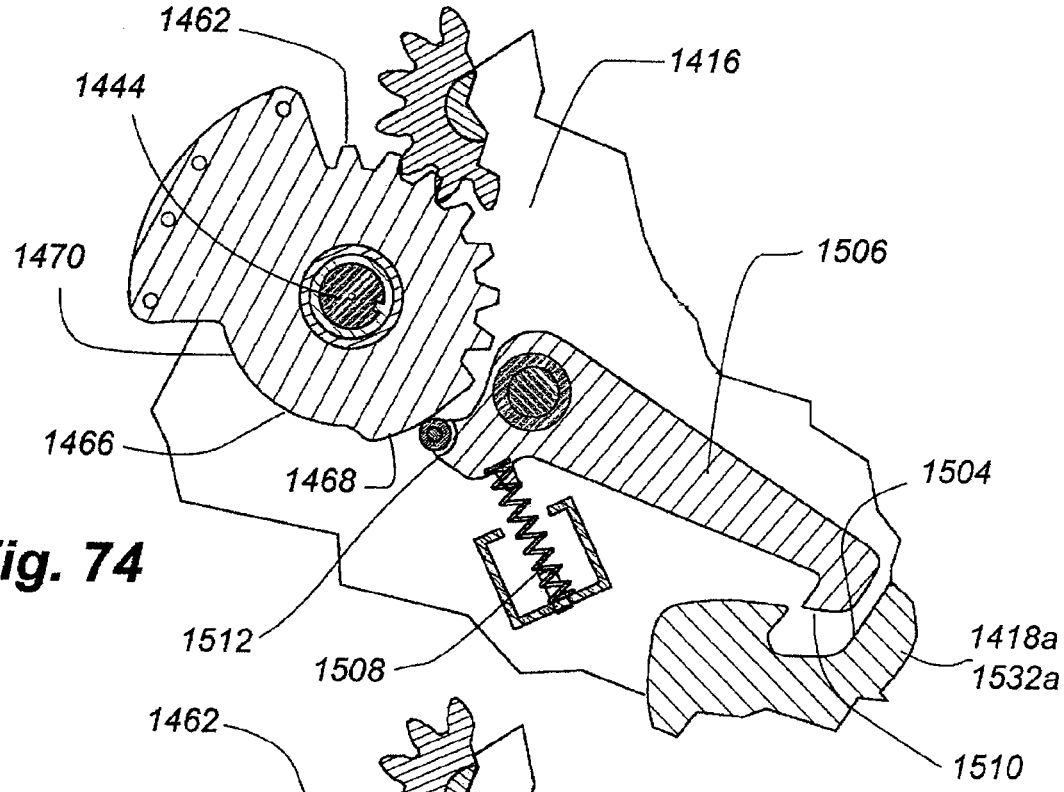
FIG. 74 is a fragmentary vertical section view taken along line 74-74 in FIG. 63 showing the system for engaging or disengaging an add-on weight carried with the main weights and showing the system in a non-latching condition.
Figure 75:
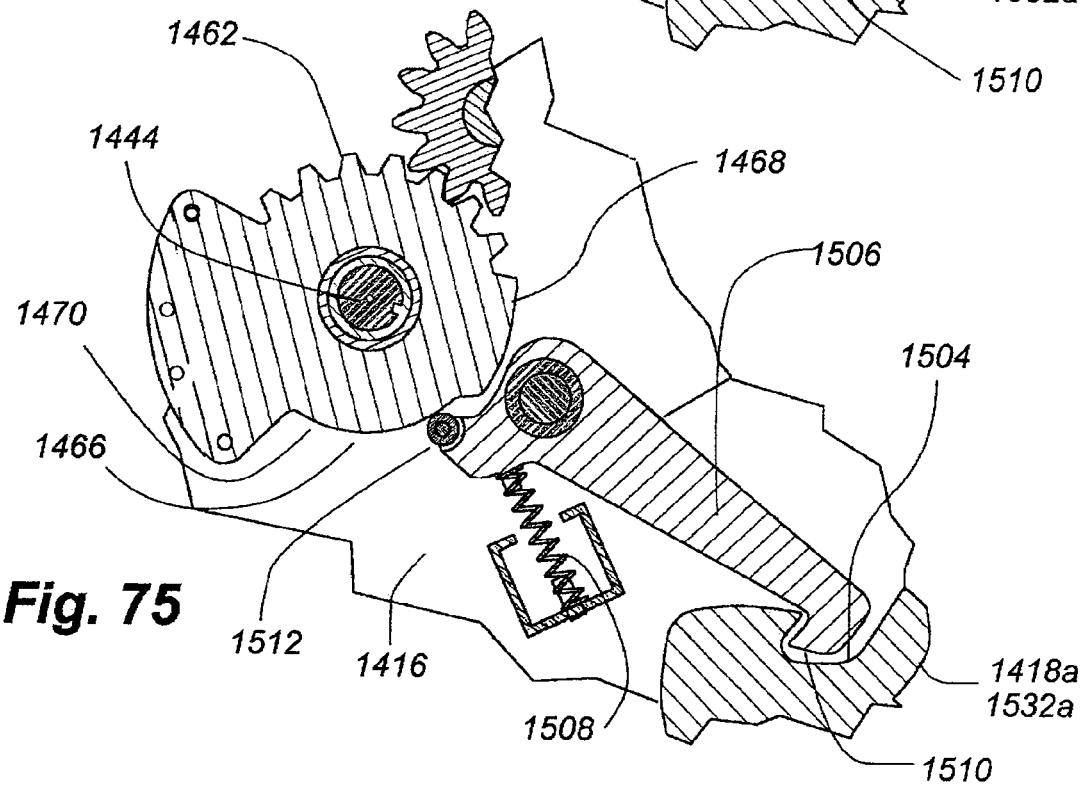
FIG. 75 is a section view similar to FIG. 74 showing the system in a latching condition.

Turning to FIGS. 74 and 75, the 5-pound weight 1414*b* pivotally mounted with the main weights 1414*a*-1414*g* on the pivot shaft 1424 (pivot shaft shown in FIG. 61) includes a slot or catch 1504 in its upper surface adapted to cooperate with an add-on weight hook arm 1506 that is independent of the previously described hook arms 1426 and is biased into the catch 1504 with a coil spring 1508 anchored or otherwise connected to the pivotal sub-frame 1416 in any suitable manner. The hook arm 1506 includes a tip 1510 that is selectively engageable with the catch 1504 in the top of the 5-pound add-on weight 1418*a* and has a follower-roller 1512 at its opposite end that remains in engagement with the add-on weight cam surface 1466 along the surface of the partial gearwheel 1462. The cam surface 1466 has its raised or elevated segment 1468 adjacent to the gear portion and its lowered segment 1470 separated from the gear portion of the partial gear wheel 1462 by the elevated segment 1468.

With reference to FIGS. 68, 70, 74 and 75, movement of the partial gear wheel 1462 is coordinated so when the first small gear 1476 is at the left end of the gear portion as viewed in FIG. 74, and the toggle 1456 rotates the partial gear wheel 1462 in a counterclockwise direction, the first small gear 1476 follows the gear portion of the partial gear wheel 1462 so as to rotate the lift shaft 1490 for selective engagements of the lift wheels 1496 with the add-on weights 1418*b-e*. As the follower-roller 1512 initially moves along the geared portion of the partial gear wheel 1462, the add-on gear cam surface 1466 of the partial gear wheel 1462 retains the hook arm 1506 in a non-engaged position relative to the 5-pound add-on weight 1418*a*. During this initial movement of the partial gear wheel 1462, the 1-pound add-on weights 1418*b-e* are selectively engaged with the lift wheels 1496 to add one, two, three, or four pounds of weight to the lift shaft 1490 for pivotal movement with pivotal movement of the sub-frame 1416.

Further movement of the partial gear wheel 1462 in a counterclockwise direction causes the follower-roller 1512 to drop off the raised portion 1468 of the add-on gear cam surface 1466 of the partial gear wheel 1462 and onto the lowered portion 1470 of the add-on gear cam surface 1466, as shown in FIG. 75, so that the tip 1510 of the hook arm 1506 engages the catch 1504 of the 5-pound add-on weight 1418*a* thus resulting in this weight being carried with the pivotal sub-frame 1416 during an exercise.

When the follower-roller 1512 on the hook arm 1506 initially drops from the elevated segment 1468 to the lowered segment 1470, the lift shaft 1490 has completed one revolution, and thus no 1-pound add-on weights 1418*b-e* are engaged with the lift wheels 1496. Movement of the partial gear wheel 1462 further in a counterclockwise direction allows the hook arm 1506 to remain engaged with the 5-pound add-on weight 1418*a* while the gear train 1472 connected to the lift shaft 1490 again causes the lift shaft 1490 to rotate so as to selectively engage the lift wheels 1496 with one or more of the one-pound add-on weights 1418*b-e* up to four additional pounds.

In other words, and with reference to FIGS. 57, 68, 70, 74 and 75, as the add-on toggle 1456 is moved in a clockwise direction from its leftmost position as viewed in FIG. 57 (this would be counterclockwise as viewed in FIGS. 68, 70, 74, and 75), indicia adjacent to the add-on toggle 1456 running from one pound to nine pounds is sequentially illustrated. If the add-on toggle 1456 is moved into alignment with mark for 1-pound, then only a single 1-pound add-on weight 1418 is engaged with a lift wheel 1496 for movement with the pivotal sub-frame 1416. Further movement to the right of the add-on toggle 1456 (as viewed from FIG. 57) engages the lift wheels 1496 with additional one-pound add-on weights 1418*b-e* (i.e., from two to four of the add-on weights 1418*b-e*). With continued movement of the add-on toggle 1456 to the right (as viewed from FIG. 57), the 1-pound add-on weights 1418*b-e* are disengaged from the lift wheels 1486 and the 5-pound add-on weight 1418*a* is engaged, thus resulting in five pounds of weight in addition to the weight provided by any main weights 1414*a-g*. With still continued movement of the add-on toggle 1456 to the right (as viewed from FIG. 57), any number of the 1-pound add-on weights 1418*b-e* (i.e., from one to four) would be again engaged with the lift wheels 1486 and added to the 5-pound weight to obtain anywhere from six to nine pounds of additional weight.

Although the main weight system and the add-on weight system have been described above with minimal reference to each other, the two systems are incorporated into the same machine for independent but coordinated operation. For example, with reference to FIGS. 57-60, the main weights 1414*a-g* can be selectively engaged with the sub-frame 1416 by rotating the main index wheel 1428 until the indicia shows the desired weight for set of main weights. During rotation of the main index wheel 1428, the cam shaft 1444 will rotate therewith, thus positioning the cams 1440 fixed on the cam shaft 1444 into positions that allow disengagement of the hook arms 1426 from undesired main weights 1414*a-g*, which are normally engaged with their associated main weights 1414*a-g*.

When the desired weight in 10-pound increments is set with the main index wheel 1448 and the hook arms 1426 correspondingly engage or disengage their associated main weight plates 1418*a-g*, the main weight plates 1418*a-g* associated with an exercise in 10-pound increments will move with the sub-frame 1416. With reference to FIGS. 68-75, to refine that weight between one and nine pounds in one-pound increments, the add-on toggle 1456 is shifted. The gear train 1472 associated with the add-on toggle 1456 positions the dogs 1498 on the associated lift wheels 1496 relative to the lift tabs 1502 on the 1-pound add-on weights 1418*b-e* so that only the preselected number of 1-pound add-on weights will be operatively engaged with the lift wheels 1496. Further pivoting of the add-on toggle 1456 will engage the 5-pound add-on weight 1418*a* after disengaging the 1-pound add-on weights 1418*b-e* from the lift wheels 1496. The add-on toggle may be further pivoted to re-engage as many of the 1-pound add-on weights 1418*b-e* with the lift wheels 1496 as may be desired to obtain an add-on weight between six and nine pounds in one pound increments.

Since the lift wheels 1496 are mounted on a lift shaft 1490 that moves with the pivotal sub-frame 1416, as are the hook arms 1426 associated with the main weights 1414*a-g*, the hook arms 1426 and the dogs 1498 on the lift wheels 1496 that are associated with the lift shaft 1490 will carry, with pivotal movement of the sub-frame 1416, the main and add-on weights 1414, 1418 engaged therewith so that the preset and desired weight for a given exercise is lifted by the force transfer mechanism 1404 through the sub-frame 1416.

Figure 77:
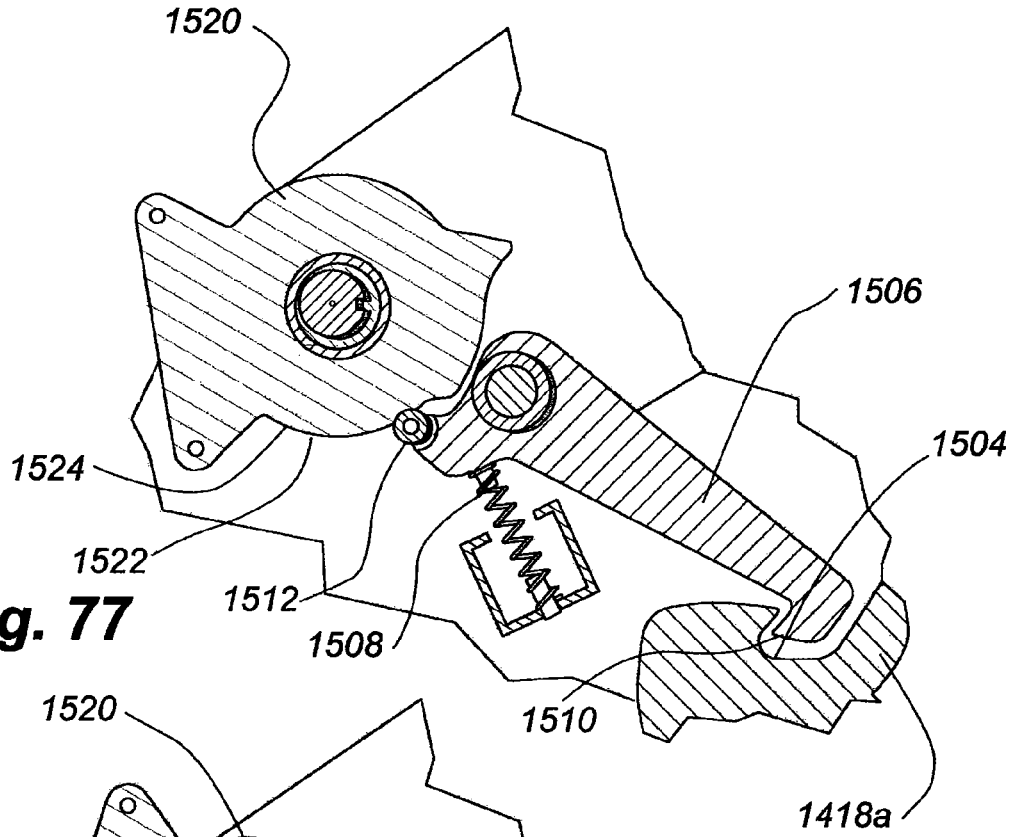
FIG. 77 is a section similar to FIG. 76 with the system in an engaged position.
Figure 76:
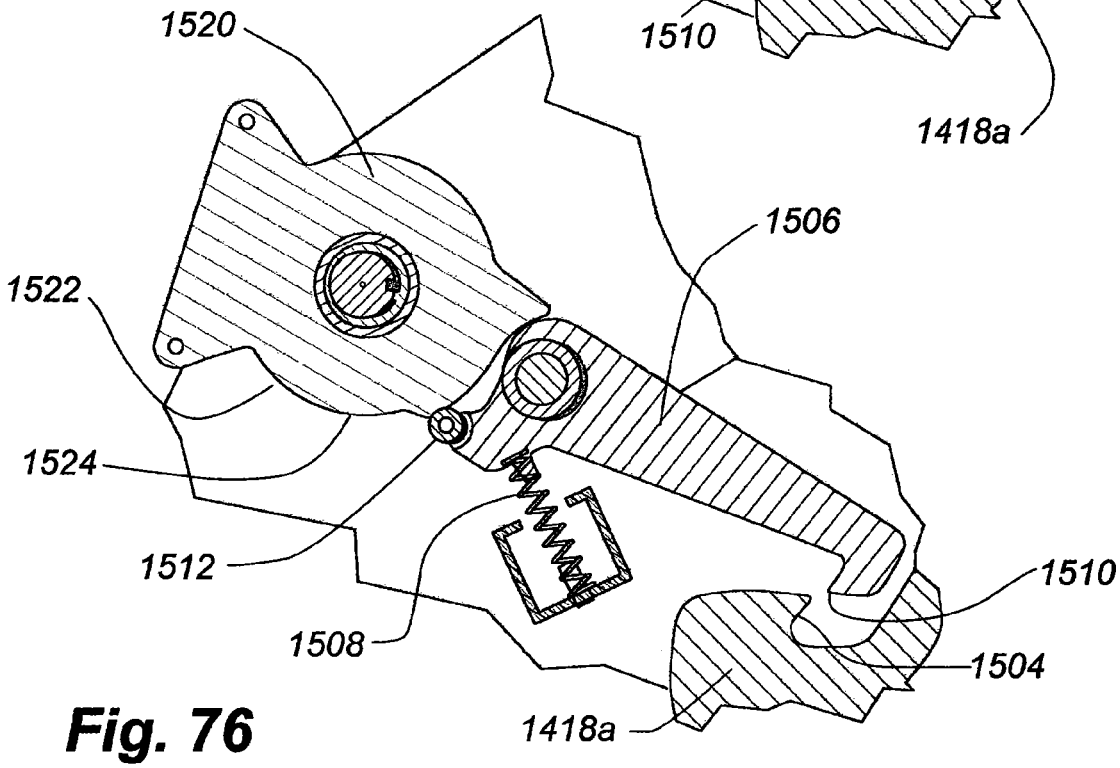
FIG. 76 is a section view similar to FIG. 74 wherein there is no separate add-on weight system but only one add-on weight mounted with the main weights and with the system in a disengaged condition.

In an alternative to the afore-described twelfth embodiment of the weight exercise machine 1400, the 1-pound increment add-on portion of the machine can be removed or omitted, and the partial gearwheel 1462 (as shown in FIG. 74 among other figures) replaced with an add-on weight cam 1520 that is associated only with the hook arm 1506 for the 5-pound add-on weight 1418*a* as shown in FIGS. 76 and 77. In this arrangement, the add-on toggle 1456 (shown in FIG. 57) would have indicia indicating an add-on weight of zero or five pounds, which changes the 1-pound incremental capability of the weight exercise machine 1400 to a machine having 5-pound increments. In other words, by selectively picking up the 5-pound add-on weight 1418*a* as will be described hereafter, five pound weight increments can be added to the main weights 1414*a-g* selected with the main index wheel 1428.

With reference to FIG. 76, the cam 1520 includes a cam peripheral surface 1522 engageable with the follower-roller 1512 on the hook arm 1506. The cam surface 1522 is such that the hook arm 1506 is pivoted in a counterclockwise direction as view in FIG. 77 so that the tip 1510 is disengaged from the catch 1504 formed in the 5-pound add-on weight 1418*a*. However, movement of the add-on toggle 1456 in a counterclockwise direction (as viewed from FIG. 68) will rotate the add-on weight cam 1520 in a counterclockwise direction causing the follower-roller 1512 to drop into a depressed cam segment 1524 of the cam peripheral surface 1522, thus allowing the hook arm 1506 to pivot in a clockwise direction so that the tip 1510 of the hook arm 1506 is inserted into the catch 1504 formed on the 5-pound add-on weight 1418*a* as shown in FIG. 77 so that the 5-pound weight is lifted with the pivotal sub-frame 1416 during an exercise.

Figure 78:
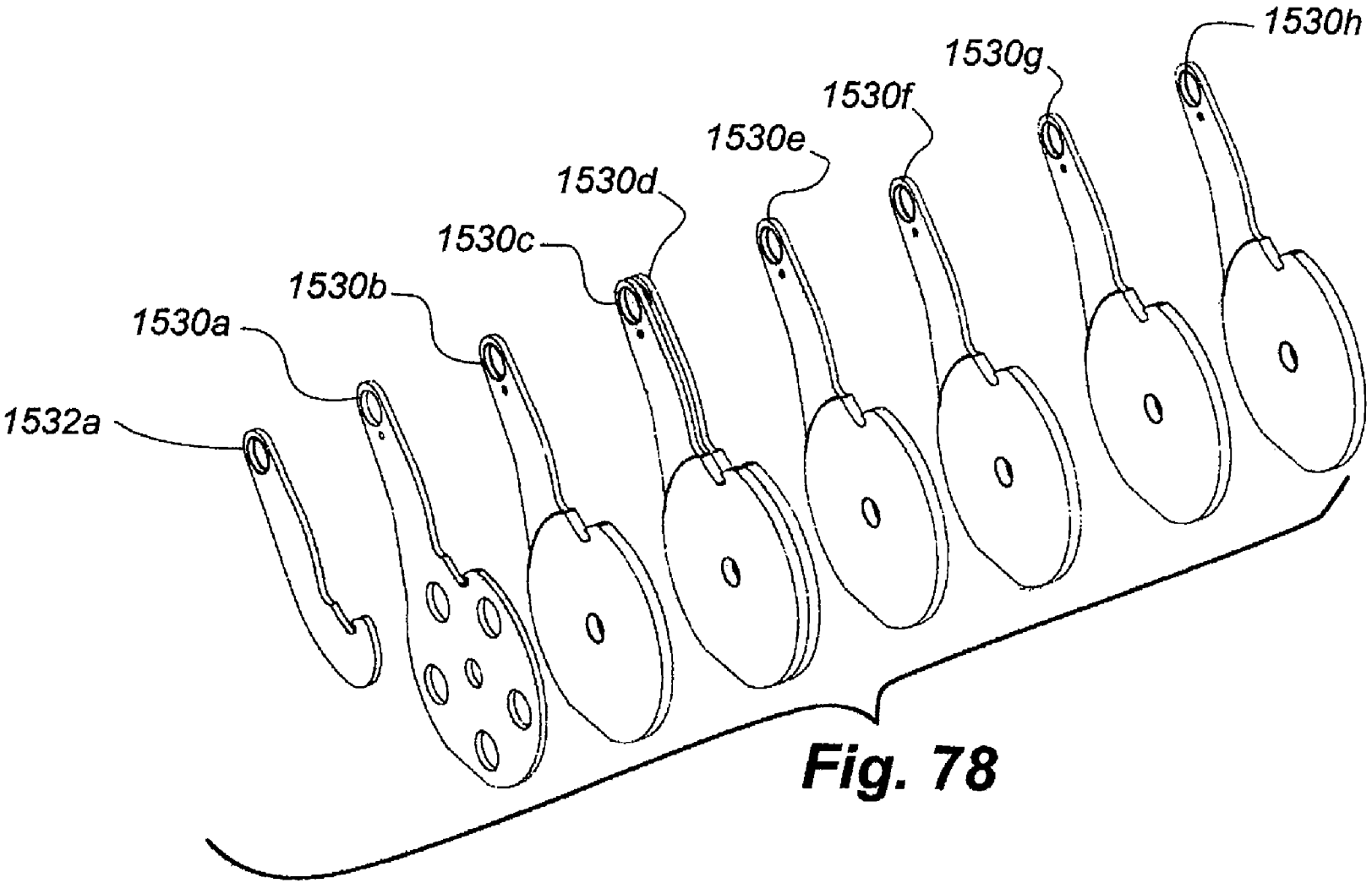
FIG. 78 is an isometric of the weight plates in a 400-pound version of the machine.

A 250-pound system has been described above, but can be modified to a 400-pound system, or any other poundage system, as desired. In the 400-pound system, the main weights 1530, as shown in FIG. 78, would be, commencing at the user end of the rack (i.e., starting from the left-hand side as viewed in FIG. 78), a 25-pound weight 1530*a*, a 50-pound weight 1530*b*, two 50-pound weights 1530*c-d* (which could be connected together), then four individual 50-pound weights 1530*e-h*. These weights may be of a similar configuration to the weights described for the 250-pound system. The cam shaft (not shown), which may be similar to the cam shaft described above for the 250-pound system, to which the main weight weights 1530*a-h* can be selectively connected, would weigh 25 pounds. Further, similar to the 250-pound system, a 5-pound add-on weight 1532*a* may be selectively joined to the cam shaft.

Selection of the weight plates in the main weight set would be similar to that previously described for the 250-pound set-up except the indicia on the main index wheel 1428 would run from 25 pounds (i.e. the weight of the pivotal sub-frame 1416 and cam shaft 1444) to 400 pounds depending upon which of the main weights 1530*a-h* were selected with the main index wheel 1428.

One embodiment of an add-on weight system for the 400-pound main weight system is shown in FIGS. 79-83. In this system, a gear train 1540 similar to that described for the 250-pound main weight system above may be used to engage add-on weights 1532*b-d* with a lift shaft 1542. As with the 250-pound main weight system, mechanical systems other than a gear train system, such as a cable and pulley system, may be used to engage the add-on weights 1532*b-d* with a lift shaft 1542.

Figure 79:
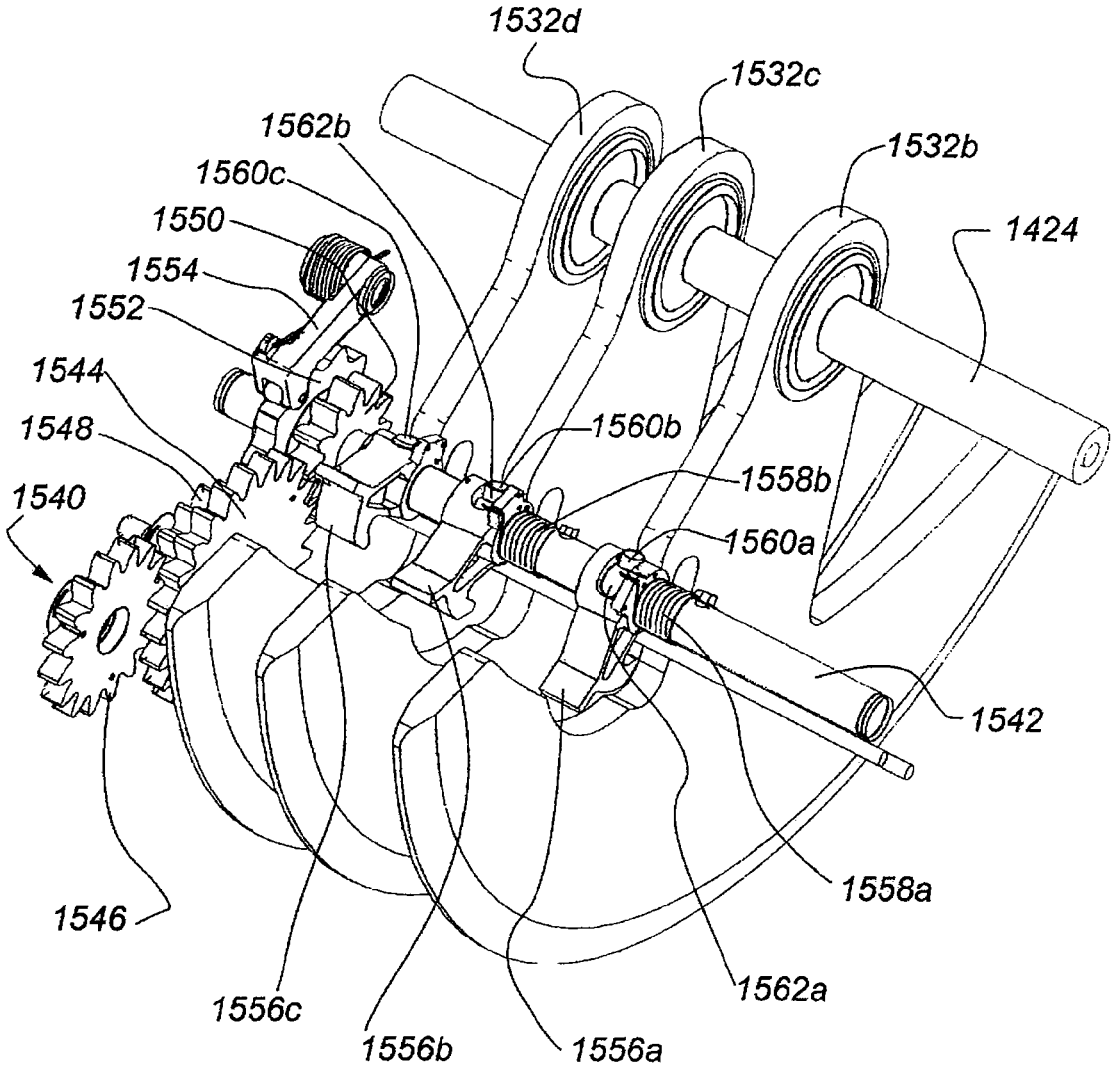
FIG. 79 is an isometric view of an alternative to an add-on weight system.
Figure 80:
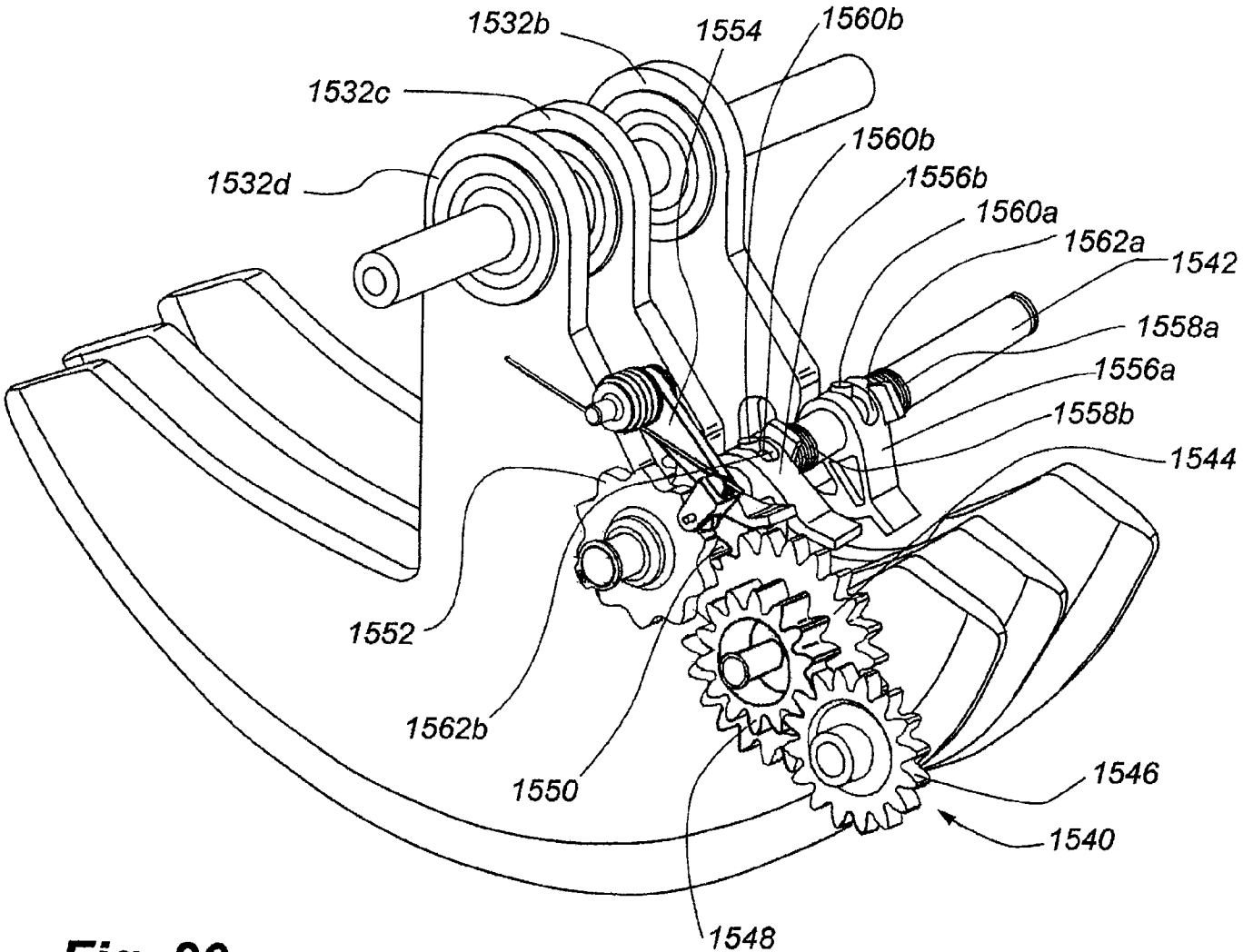
FIG. 80 is an isometric from a different view of the add-on system shown in FIG. 79.

With reference to FIGS. 79 and 80 along with other figures, the gear train 1540 may include a large gear 1544 and first 1546, second 1548, and third 1550 small gears similar to that previously described for the 250-pound main weight system. As with the 250-pound main weight system, the lift shaft 1542 may be rotated via the gear train 1540 using an add-on toggle 1456 (not shown) concentric with the main index wheel 1428 (as shown, for example, in FIG. 68 and other figures), and the gear train may be driven by a partial gear wheel 1462 that could be similar to that shown in FIG. 68 and other figures. In this variation, however, transition of the first small gear 1546 across the geared portion of the partial gear wheel 1462 will rotate the lift shaft 1542 through less than one full revolution rather than through two full revolutions as in the previously described embodiment shown, for example, in FIG. 68 as the gearing through the size of the gears is modified. Similar to the 250-pound system, there may also be a positioning wheel 1552 with a snap arm 1554 for giving tactile and/or audible feedback to an operator of the system.

Returning to FIGS. 74 and 75, in the 400-pound version of the weight exercise machine 1400, the 5-pound add-on weight 1532*a*, which is mounted with the main weights 1530*a-h* (not shown) on pivot shaft 1424, is engaged or disengaged with hook arm 1506 depending upon whether the follower-roller 1512 is positioned on the raised 1468 or lowered 1470 segment of the peripheral surface of the partial gear wheel 1462. As with the 250-pound main weight version, the hook arm 1506 is normally disengaged from the 5-pound add-on weight 1532*a* as shown in FIG. 74 but as the partial gear wheel 1462 is rotated in a counterclockwise direction as shown in FIGS. 74 and 75 with the follower-roller 1512 moving from the raised segment 1468 to the lowered segment 1468 of the partial gearwheel 1462, the tip 1510 of the hook arm 1506 engages the 5-pound add-on weight 1532*a* so that if the add-on toggle 1456 (not shown in FIGS. 74 and 75) is moved no further, only five pounds in weight would be added to the system to resist the pivoting of the sub-frame 1416 relative to the main frame 1408 (also not shown in FIGS. 74 and 75) via the force transfer mechanism 1404 (not shown) as described above for the 250-pound system.

Turning back to FIGS. 79 and 80, as the add-on toggle 1456 (not shown) is rotated, so is the first small gear 1546 that is engaged with the gear teeth 1464 (not shown) on the geared segment of the partial gear wheel 1462 (not shown). Even though this causes the lift shaft 1542 associated with other add-on 5-pound weights 1532*b-d* to rotate, no additional weights in the add-on system described hereafter are added to the sub-frame 1416 until the add-on toggle 1456 moves through its initial 36 degrees of pivotal movement, which is what is required to engage the 5-pound add-on weight plate 1532*a* with cam shaft 1444 as previously described above with reference to FIGS. 74 and 75 among other figures. The engagement of the other 5-pound add-on weights 1532*b-d* with the lift shaft 1542 will be described hereafter.

With continued reference to FIGS. 79 and 80, the third gear 1534 pivots the lift shaft 1542 in reversible directions depending upon the direction of movement of the add-on toggle 1456 (not shown). The lift shaft 1542 includes three axially spaced hooks 1556*a-c*, which receive the lift shaft 1542 through holes defined therein. As the lift shaft 1542 rotates about its axial axis, at least some of the spaced hooks 1556*a-c* may move rotatably relative to the lift shaft 1542 about the lift shaft's 1542 axial axis as described in more detail below. Each spaced hook 1556*a-c* may selectively engage an associated add-on weight 1532*b-d* to selectively engage these add-on weights 1532*b-d* with the lift shaft 1542.

The three hooks 1556*a-c* operatively joined to the lift shaft 1542 may be referred to as the inner hook 1556*c* (i.e., the hook closest to the gear train 1540), the middle hook 1556*b*, and the outer hook 1556*a*. The hooks 1556*a-c* are mounted on the lift shaft 1542 so as to project away from the lift shaft 1542 in 36-pound circumferentially discreet increments. Such a configuration causes the hooks 1556*a-c*, beginning with the outer hook 1556*a*, to sequentially engage a hook's 1556*a-c* associated weight plate 1532*b-d* as the lift shaft 1542 is rotated in a counterclockwise direction as viewed from the right end of lift shaft 1542 in FIG. 79. While the outer hook 1556*a* is positioned to be the first of the three hooks 1556*a-c* to engage its respective add-on weight 1532*b*, it is mounted on the lift shaft 1542 at an angle of 72 degrees relative to its add-on weight 1532*b* when the add-on toggle 1456 is in its right most position (as viewed in FIG. 68) so as not to engage the add-on weight 1532*b* until the add-on toggle 1456 is rotated 72 degrees counterclockwise (as viewed in FIG. 68), thus rotating, via the gear train 1540, lift shaft 1542 72 degrees counterclockwise (as viewed from the right side of the lift shaft 1542 in FIG. 79).

Such a configuration results in the 5-pound add-on weight 1532*a*, as shown in FIGS. 74 and 75, first engaging cam shaft 1444, via hook 1506, after the add-on toggle 1456 is moved 36 degrees counterclockwise from its rightmost position (as viewed in FIG. 68). Further movement of the add-on toggle 1456 through another 36 degree counterclockwise rotation then results in engagement of outer hook 1556*a* with associated add-on weight 1532*b*, thus engaging add-on weight 1532*b* with lift shaft 1542. Continued movement of add-on toggle 1456 through yet further 36 degree counterclockwise rotations result in middle hook 1556*b*, followed by inner hook 1556*d*, engaging their respective add-on weights 1532*c-d* until all four add-on weights 1532*a-d* are engaged with their respective shafts 1444 and 1542, and thus pivotally move with sub-frame 1416 as described in more detail above with respect to the add-on weight system for the 250-pound main weight system.

Although the increments for joining each add-on weight 1532*a-d* to a respective shaft 1444, 1542 are described as 36 degree increments, thus requiring movement of the add-on toggle 1456 through a total counterclockwise movement of 144 degrees for all four add-on weights 1532*a-d* to engage their respective shafts 1444, 1542 for movement with sub-frame 1416, the increments required for each add-on weight 1532*a-d* to engage a shaft 1444, 1542 may be any predetermined increment greater than or less than 36 degrees. Further, the increment could vary for each add-on weight 1532*a-d*. For example, the increment for the first add-on weight 1532*a* to be engaged with the cam shaft 1444 could be 18 degrees, while the further increments for the other add-on weights 1532*b-d* to be engaged with lift shaft 1542 could be 24 degrees. The foregoing example is merely illustrative and is not intended to limit the increments to any particular amount, or to limit whether the increments remain constant or vary for each subsequent add-on weight 1532*a-d* to engage its respective shaft 1444, 1542.

The outer 1556*a* and middle 1556*b* hooks are each joined to a coil spring 1558*a, b*. Each coil spring 1558*a-b* is wrapped around and joined to the lift shaft 1542. As lift shaft 1542 is rotated in counterclockwise direction as viewed from its right end in FIG. 79, each coil spring 1558*a-b* causes the respective hook 1556*a-b* to which it is joined to rotate counterclockwise with lift shaft 1542. The outer and middle hooks 1556*a-b* continue to rotate with lift shaft 1542 until each hook 1556*a-b* engages its associated add-on weight 1532*b-c*. Upon such engagement, the outer and middle hooks 1556*a-b* cease to rotate with lift shaft 1542 as lift shaft 1542 continues to be rotated counterclockwise. Instead, lift shaft 1542 moves counterclockwise relative to the outer and middle hooks 1556*a-b*, thus causing tension in the coil spring 1558*a-b* joined to the hook 1556*a*,-*b*. This resulting tension biases the outer and middle hooks 1556*a-b* against their associated add-on weights 1532*b-c*, thus further securing the hooks 1556*a-b* to the add-on weights 1532*b-c*.

Lift shaft 1542 further includes pins 1560*a-c* that project radially outward from lift shaft 1542. The pins 1560*a-b* associated with the outer and middle hooks 1556*a-b* are received within slots 1562*a-b* defined in these hooks 1556*a-b*. In their initial positions, these pins 1560*a-b* are proximate the right end of slots 1562*a-b* as shown in FIG. 79. When middle and outer hooks 1556*a-b* engage their respective weight plates 1532*b-c*, these pins 1560*a-b* move from the right end of their respective slots 1562*a-b* to the left end of the slots 1562*a-b* as the lift shaft 1542 is further rotated in a counterclockwise direction. The pin 1560*c* associated with the inner hook 1556*c* is received within a hook hole defined in this hook 1556*c*. The hook hole is sized to approximately match the diameter of the pin 1560 so that any rotational movement of the lift shaft 1542 causes the inner hook 1556*c* to rotate with the lift shaft 1542.

The slot 1562*a* of the outer hook 1556*a* is sized to have a length from its right end to its left approximately equal to the sum of the degree increments required for the middle and inner hooks 1556*b-c* to engage their respective add-on weights 1532*c-d*. Similarly, the slot 1562*b* of the middle hook 1556*b* is sized to have a length from its right end to its left end approximately equal to the degree increment required for the inner hook 1556*c* to engage its respective add-on weight 1532*d*. Such a configuration results in pins 1560*a-b* being positioned proximate the left end of their respective slots 1562*a-b* when all three hooks 1556*a-c* are engaged with their respective add-on weights 1532*b-d*. When the pins 1560*a-b* are positioned adjacent to the left ends of their respective slots 1562*a-b*, further counterclockwise rotation of lift shaft 1542 is restricted, thus providing a stop for further movement of the add-on toggle 1456 by an operator in a counterclockwise direction once all add-on weights are operatively engaged with the sub-frame 1416.

Additionally, by positioning the pins 1560*a-b* proximate the left ends of their respective slots 1562*a-b*, the hooks 1556*a-c* are disengaged in the reverse order that they engaged their respective add-on weights 1532*b-d* as lift shaft 1542 is rotated in a clockwise direction as viewed from the right end of lift shaft 1542. More particularly, as lift shaft 1542 is rotated clockwise, inner hook 1556*c* rotates clockwise with lift shaft 1542 and thus disengages from its associated add-on weight 1532*d*. Meanwhile, the tension in coil springs 1558*a-b* cause the outer and middle hooks 1556*a-b* to remain engaged with their respective add-on weights 1532*b-c* as the lift shaft 1542 is rotated clockwise. However, the pins 1560*a-b* associated with the outer and middle hooks 1556*a-b* begin moving from their positions at the left end of the slots 1562*a-b* in the outer and middle hooks 1556*a-b* to the right end of these slots 1562*a-b*.

As the lift shaft 1542 continues to be rotated in a clockwise direction, the pin 1560*b* associated with the middle hook 1556*b* engages the right end of the slot 1562*b* in middle hook 1556*b*. Once engaged with the right end of the slot 1562*b* in middle hook 1556*b*, this pin 1560*b* causes the middle hook 1556*b* to rotate clockwise with lift shaft 1542 as lift shaft 1542 is further rotated clockwise, thus disengaging middle hook 1556*b* from its associated add-on weight 1532*c*. Meanwhile, outer hook 1556*a* remains engaged with its associated add-on weight 1532*b* as the pin 1560*a* associated with it continues to move towards the right end of the slot 1562*a* in outer hook 1556*a*. As the lift shaft 1542 continues to be rotated in a clockwise directions, the pin 1560*a* associated with the outer hook 1556*a* eventually engages the right end of the slot 1560*a* in outer hook 1556*a*. In a manner similar to the one described for the middle hook 1556*b*, further clockwise rotation of the lift shaft 1542 after engagement of the pin 1560*a* associated with the outer hook 1556*a* with the right end of the slot 1560*a* formed in this hook 1556*a* causes the outer hook 1556*a* to disengage from its associated weight 1532*b*.

Once each of the add-on weights 1532*b-d* associated with the lift shaft 1542 are disengaged from lift shaft 1542, the add-on weight 1532*a* associated with the cam shaft 1444 may be disengaged from cam shaft 1444 in a manner similar to the one described for the similar add-on weight 1418*a* described above in connection with the 250-pound system by further clockwise rotation of the add-on toggle 1456.

Figure 81:
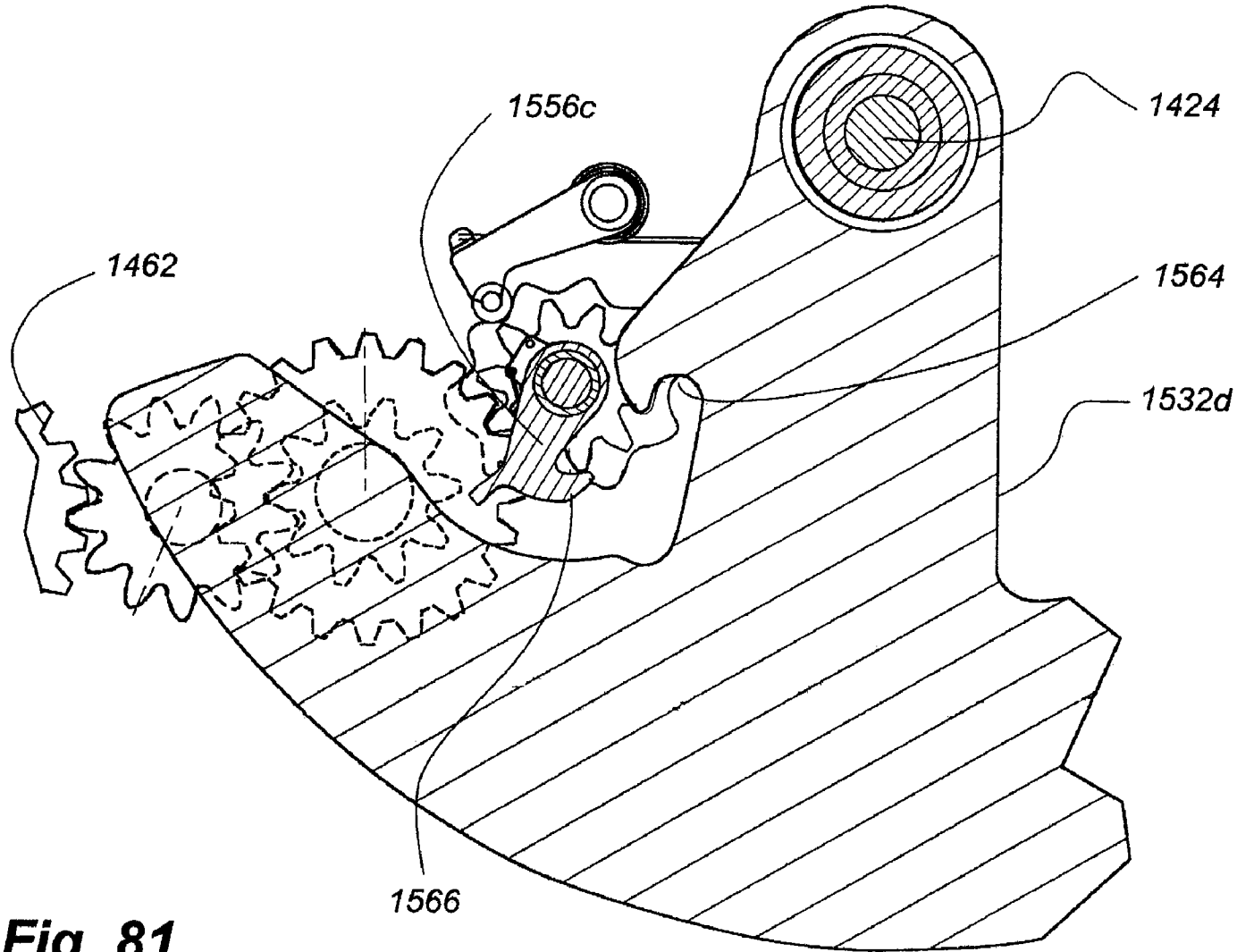
FIG. 81 is a vertical section through the add-on system shown in FIGS. 79 and 80 with the system disengaged from an associated weight plate.
Figure 82:
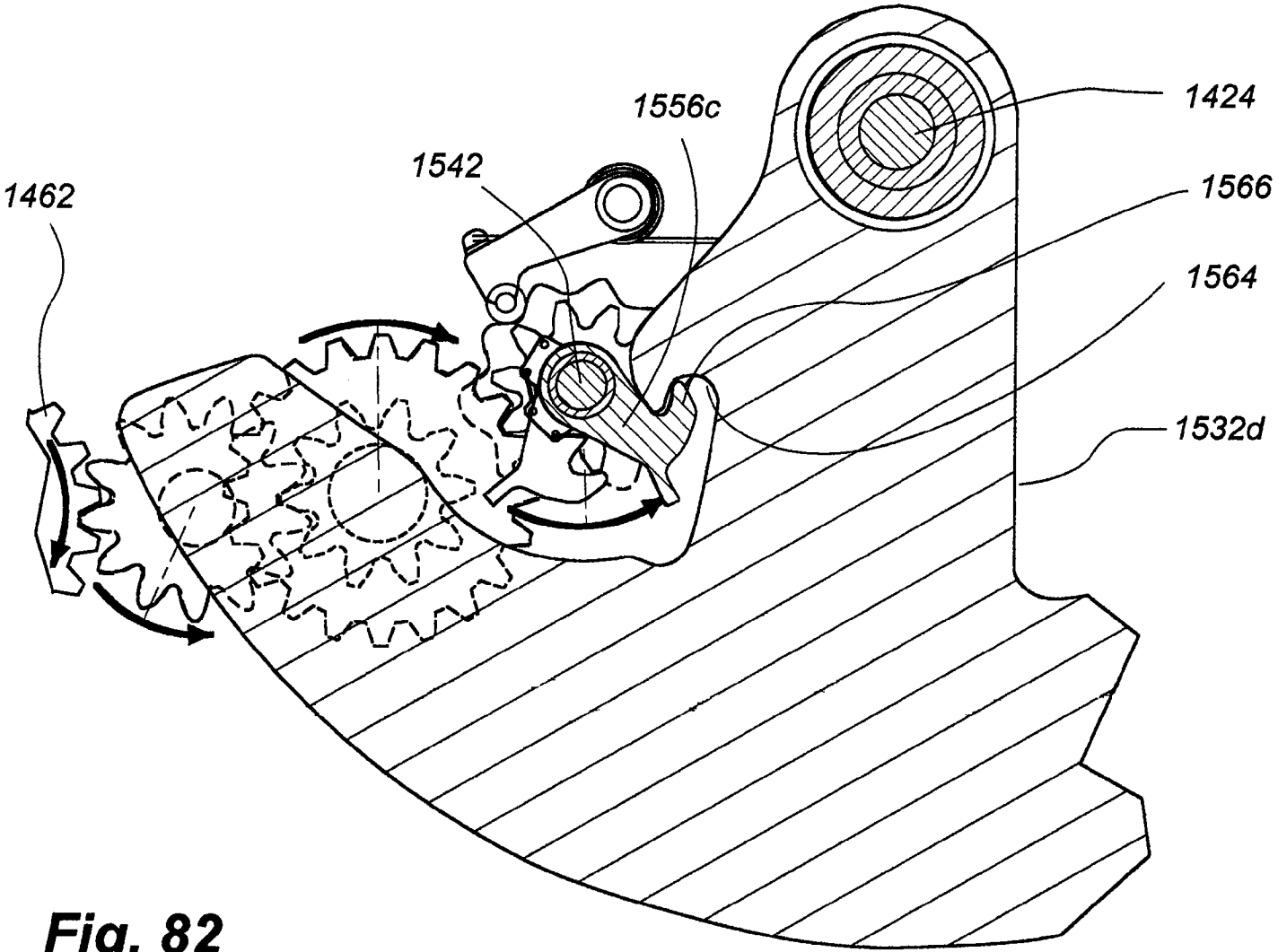
FIG. 82 is a section similar to FIG. 81 with the system engaging an associated add-on weight plate.
Figure 83:
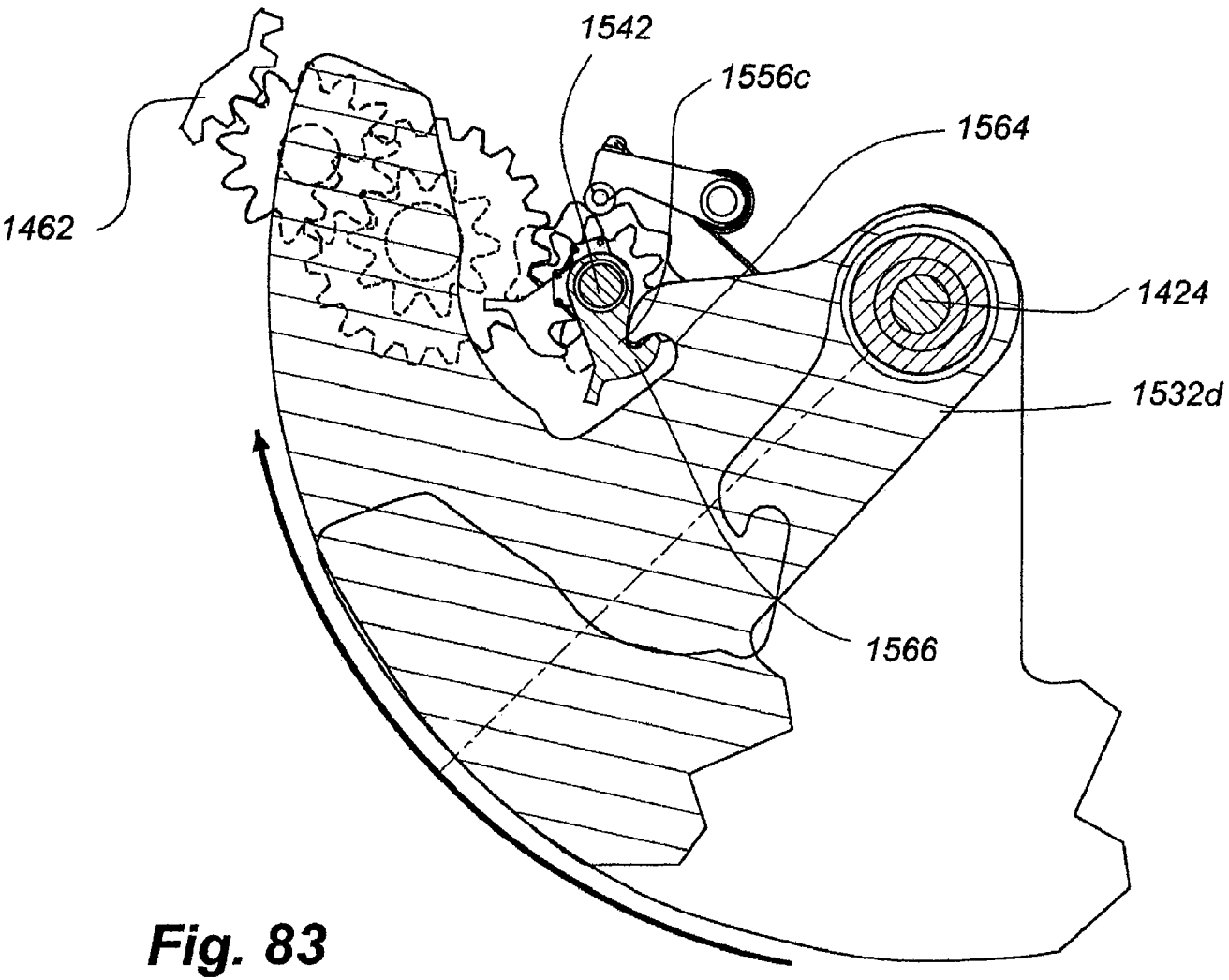
FIG. 83 is a section similar to FIG. 82 with the engaged weight plate shown as pivotally lifted.

With reference to FIGS. 80-83, each add-on weight 1532*b-d* associated with the lift shaft 1542 may have a generally crescent configuration. With particular reference to FIGS. 81-83 among other figures, a catch 1564 may be formed in each such add-on weight 1532*b-d* to cooperate with an associated hook 1556*a-c*, each of which may include a lip 1556 that can be selectively inserted into or removed from the catch 1564. When the lip 1566 is inserted into the catch 1564, the add-on weight 1532*b-d* associated with the hook 1556*a-c* can be pivoted about pivot shaft 1424 as shown in FIGS. 81-83 and thus lifted with the pivotal sub-frame 1416 (not shown) during an exercise. Of course, if a hook 1556*a-c* is not engaged with its associated weight 1532*b-d*, as shown, for example, in FIG. 81, that add-on weight 1532*b-d* will not be lifted upon pivotal movement of the sub-frame 1416.

With reference to FIGS. 57, 74, 75, 79, 82, and 83 among others, the operation of the second embodiment of weight add-on system for the twelfth embodiment of a weight exercise machine 1400 shall be described. Pivotal movement of the add-on toggle 1456 directly associated with the partial gear wheel 1462 in a counterclockwise direction as viewed in FIG. 82 causes the lift shaft 1542 to pivot in a counterclockwise direction. This initial movement of the partial gear wheel 1462 also causes the follower-roller 1512 on hook arm 1506 to move along the add-on gear cam surface 1466 until the follower-roller 1512 moves from the elevated surface 1468 to the lowered surface 1470. Once the follower-roller engages the lowered surface 1470, the hook arm 1506 engages the add-on weight 1532*a* associated with the cam shaft 1444 thus resulting in this add-on weight 1532*a* being liftable with the sub-frame 1416.

Further rotation of add-on toggle 1456 in a counterclockwise direction continues to cause the lift shaft 1542 via the gear train 1540 to rotate in a counterclockwise direction until the outer hook 1556*a* engages its associated add-on weight plate 1532*b* via engagement of the hook's lip 1566 with the add-on weight's catch 1564. The engagement of the outer hook 1556*a* with its associated add-on weight 1532*b* results in the add-on weight 1532*a* being liftable with the sub-frame 1416. The add-on toggle 1456 may continue to be rotated in a counterclockwise direction until the inner and middle hooks 1556*b-c* engage their respective add-on weights 1532*c-d* in a manner similar to between the outer hook 1556*a* and its associated weight 1532*b*. Like the outer add-on weight 1532*b*, the engagement of the middle and inner hooks

1556*b-c* with their associated add-on weights 1532*c-d* result in these add-on weights 1532*c-d* being liftable with the sub-frame 1416.

Of course, clockwise rotation, or rotation in an opposite direction, of the add-on toggle 1456, after the sub-frame 1416 is returned to its neutral position, will cause the hooks 1556*a-c* to sequentially disengage from their associated add-on weights 1532*b-d* as described in more detail above from the inner hook 1556*c* to the outer hook 1556*a*, and finally result in the add-on weight 1532 positioned proximate the main weights 1530*a-h* being disengaged from the sub-frame 1416.

For purposes of illustration, if the machine were set up with a 400-pound main weight system, as set described, the add-on weights 1532*a-d* could each be five pounds so there would be three 5-pound add-on weights 1532*b-d* mounted on the pivot shaft 1424 and a fourth 5-pound add-on weight 1543*a* carried with the main weights 1530*a-h*, each of which could be selectively picked up or not with the add-on system described above. In this manner, the 400-pound system would have 20 additional add-on pounds of weight which could be added in 5-pound increments giving the system a 5-pound incremental operative capability. However, although described as using four 5-pound add-on weights, any number of add-on weights may be used to form any desired amount of incremental operative capability for the weight exercise machine 1400, the weight for each such add-on weight may be more or less than five pounds, and the weight for each such add-on may be the same as or may differ from the other add-on weights.

Although various representative embodiments of a weight exercise machine have been described above with a certain degree of particularity, those skilled in the art could make numerous alterations to the disclosed embodiments without departing from the spirit or scope of the inventive subject matter set forth in the specification and claims. All directional references (e.g., upper, lower, upward, downward, left, right, leftward, rightward, top, bottom, above, below, vertical, horizontal, clockwise, and counterclockwise) are only used for identification purposes to aid the reader's understanding of the embodiments of the present invention, and do not create limitations, particularly as to the position, orientation, or use of the invention unless specifically set forth in the claims. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other.

In some instances, components are described with reference to "ends" having a particular characteristic and/or being connected with another part. However, those skilled in the art will recognize that the present invention is not limited to components which terminate immediately beyond their points of connection with other parts. Thus, the term "end" should be interpreted broadly, in a manner that includes areas adjacent, rearward, forward of, or otherwise near the terminus of a particular element, link, component, part, member or the like. In methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

What is claimed is:

1. A weight exercise machine comprising:

a first frame including a first shaft;

a second frame operatively associated with the first frame and pivotable relative to the first frame about the first shaft;

at least one first weight including an aperture, the first shaft passing through the aperture to pivotally join the at least one first weight to the first frame, and the at least one first weight pivotable relative to the first frame about the first shaft;

a second shaft including at least one cam thereon operatively associated with at least one of the at least one first weight to selectively operatively associate and to selectively disassociate the at least one of the at least one first weight with the second frame; and a weight selector operatively associated with the second shaft; wherein:

the weight selector is rotatable around an axis;

the axis is substantially co-axial with the second shaft; and when the second frame is pivoted relative to the first frame:

the at least one weight pivots relative to the first frame about the first shaft when operatively associated with the second frame; and the at least one weight remains substantially stationary with respect to the first frame when the at least one weight is disassociated from the second frame.

2. The machine of claim 1, further comprising at least one arm operatively associated with the at least one cam, the at least one arm operating in conjunction with the at least one cam to selectively operatively associate and to selectively disassociate the at least one of the at least one first weight associated with the at least one cam with the second frame.

3. The machine of claim 2, wherein at least one of the at least one arm and at least one of the at least one first weight are selectively engageable to and detachable from each other.

4. The machine of claim 3, wherein at least one of the at least one cam is operative to move at least one arm engageable and detachable with at least one first weight into and out of engagement with the at least one first weight.

5. The machine of claim 1, wherein the weight selector includes a system associated therewith for indicating weight between a minimum and a maximum weight.

6. The machine of claim 1, further comprising the second frame operatively associated with an exercise member against which a user exerts an exercise force.

7. The machine of claim 1, further comprising:

a second weight pivotally mounted on the first shaft; and a second weight selector operatively associated with the second weight to selectively operatively associate and to selectively disassociate the second weight with the second frame.

8. The machine of claim 1, further comprising:

at least one second weight pivotally mounted on the first shaft; and a second weight selector operatively associated with the at least one second weight to selectively operatively associate and to selectively disassociate at least one of the at least one second weight with the second frame.

9. The machine of claim 8, further comprising:

a third shaft;

at least one weight engagement member operatively associated with the third shaft and the second weight selector; wherein:

the at least one weight engagement member and the second weight selector operate in conjunction to selectively operatively associate and to selectively disassociate the at least one of the at least one second weight with the second frame.

10. The machine of claim 9, wherein at least one of the at least one weight engagement member includes at least one engagement tab for selective engagement with the at least one of the at least one second weight.

11. The machine of claim 9, wherein at least one of the at least one weight engagement member comprises a hook for selective engagement with the at least one of the at least one second weight.

* * * * *